US006949003B2

(12) United States Patent
Hornsby et al.

(10) Patent No.: US 6,949,003 B2
(45) Date of Patent: Sep. 27, 2005

(54) CARD INTERACTIVE AMUSEMENT DEVICE

(75) Inventors: James R. Hornsby, St Louis, MI (US); Joseph L. McGowan, St. Charles, MI (US); Christopher N. Hall, St. Louis, MI (US); David M. Niehaus, St. Louis, MI (US)

(73) Assignee: All Season Toys, Inc., Malibu, CA (US)

( * ) Notice: Subject to any disclaimer, the term of this patent is extended or adjusted under 35 U.S.C. 154(b) by 0 days.

(21) Appl. No.: 10/071,545

(22) Filed: Feb. 8, 2002

(65) Prior Publication Data

US 2002/0123297 A1 Sep. 5, 2002

Related U.S. Application Data

(63) Continuation-in-part of application No. 09/966,680, filed on Sep. 28, 2001, and a continuation-in-part of application No. 09/931,570, filed on Aug. 16, 2001.

(60) Provisional application No. 60/236,231, filed on Sep. 28, 2001.

(51) Int. Cl.[7] ..... A63H 29/22; A63H 30/00; A63F 9/24

(52) U.S. Cl. ..... 446/484; 456/175; 456/473; 456/454; 463/2; 463/43; 463/51; 463/52

(58) Field of Search ..... 434/311; 463/6, 463/30, 43–47, 52, 51, 2, 23; 446/175, 456, 435, 436, 437, 454

(56) References Cited

U.S. PATENT DOCUMENTS 4,190,256 A 2/1980 Rudden, Jr.
4,492,372 A * 1/1985 Lorence et al. ..... 472/130
4,729,564 A 3/1988 Kuna et al.
4,861,031 A * 8/1989 Simms ..... 273/295
4,938,483 A 7/1990 Yavetz
5,100,138 A 3/1992 Wilde
5,314,336 A 5/1994 Diamond et al.
5,411,259 A * 5/1995 Pearson et al. ..... 463/36
5,766,077 A 6/1998 Hongo
5,768,223 A * 6/1998 Li et al. ..... 369/30.02
5,791,652 A 8/1998 Nielsen
5,888,135 A * 3/1999 Barton et al. ..... 463/39
5,959,281 A 9/1999 Domiteaux
6,012,961 A 1/2000 Sharpe, III et al.
6,022,273 A 2/2000 Gabai et al.
6,071,166 A * 6/2000 Lebensfeld et al. ..... 446/175
6,083,104 A 7/2000 Choi
6,142,475 A 11/2000 Hennessey
6,254,486 B1 * 7/2001 Mathieu et al. ..... 446/175
6,346,025 B1 2/2002 Tachau et al.

FOREIGN PATENT DOCUMENTS

WO WO 9530973 A2 * 11/1995 ..... G07F/17/00

* cited by examiner

*Primary Examiner*—Jessica Harrison
*Assistant Examiner*—Dmitry Suhol
(74) *Attorney, Agent, or Firm*—Richard B. Klar; Law Office of Richard B. Klar

(57) ABSTRACT

An amusement device has a body, wherein the body has features, at least one motor for powering the device and at least some of the features, and an information receiving structure for receiving information from an information carrying item that is separate or discrete from the amusement device.

21 Claims, 56 Drawing Sheets

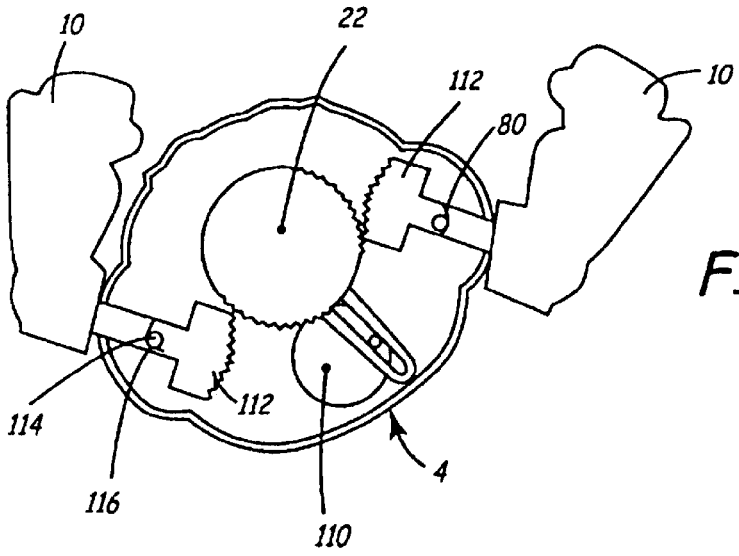
FIG. 9A
FIG. 9B
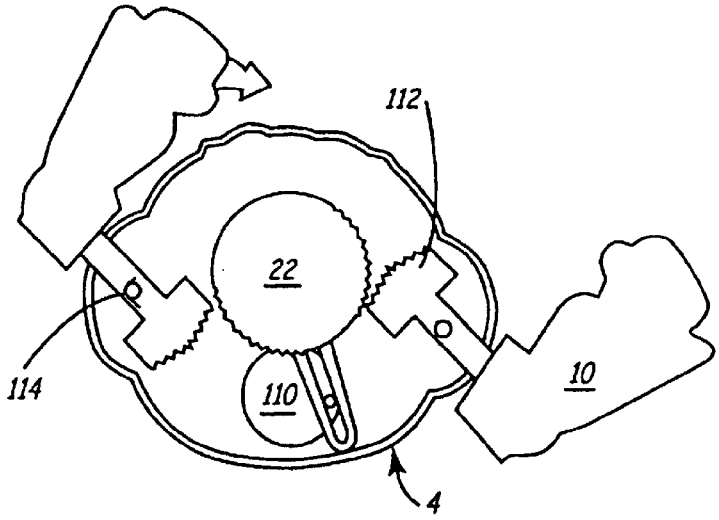
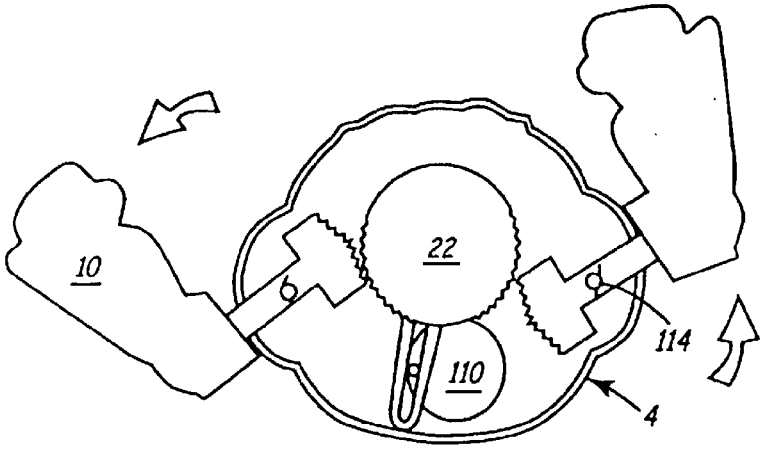
FIG. 9C

FIG. 25
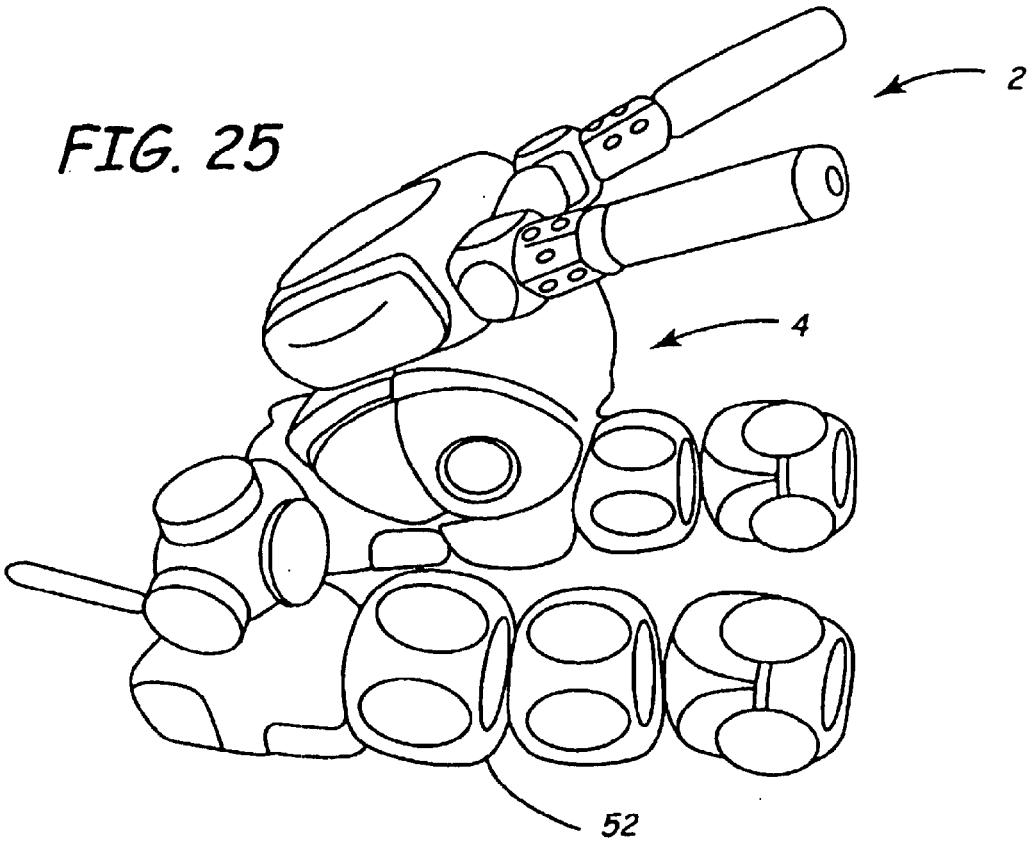
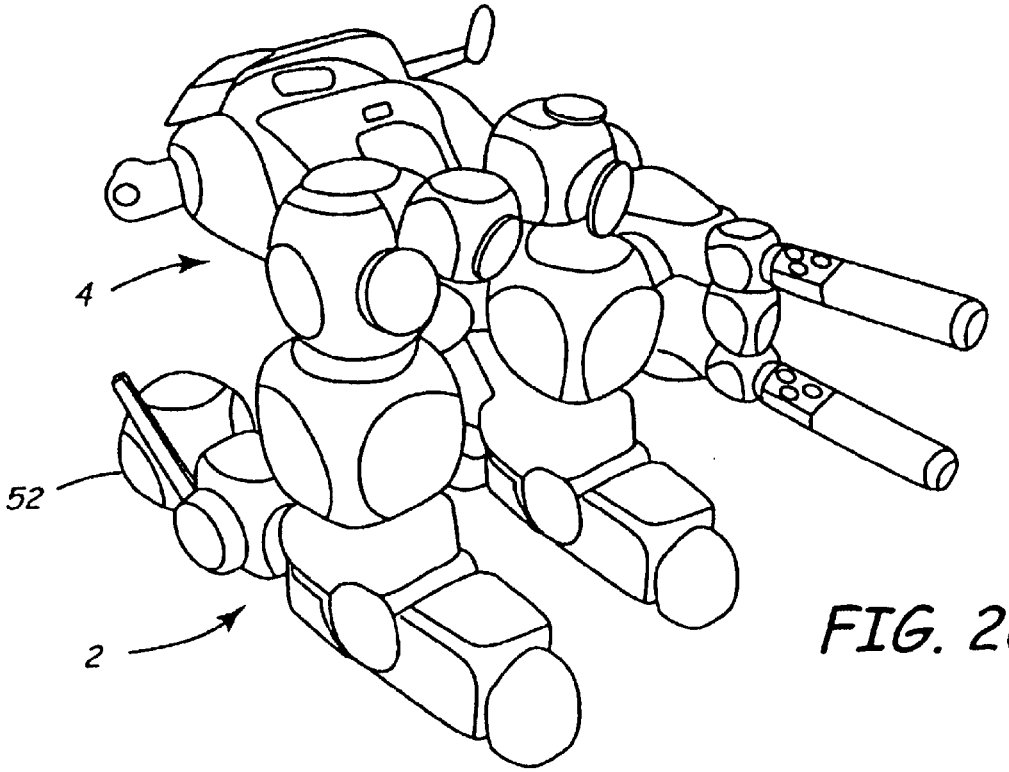
FIG. 26

FIG. 28A
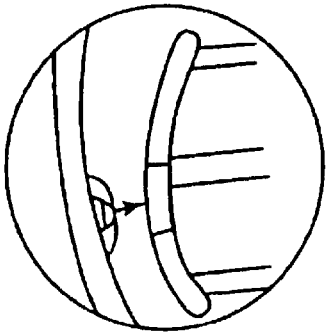
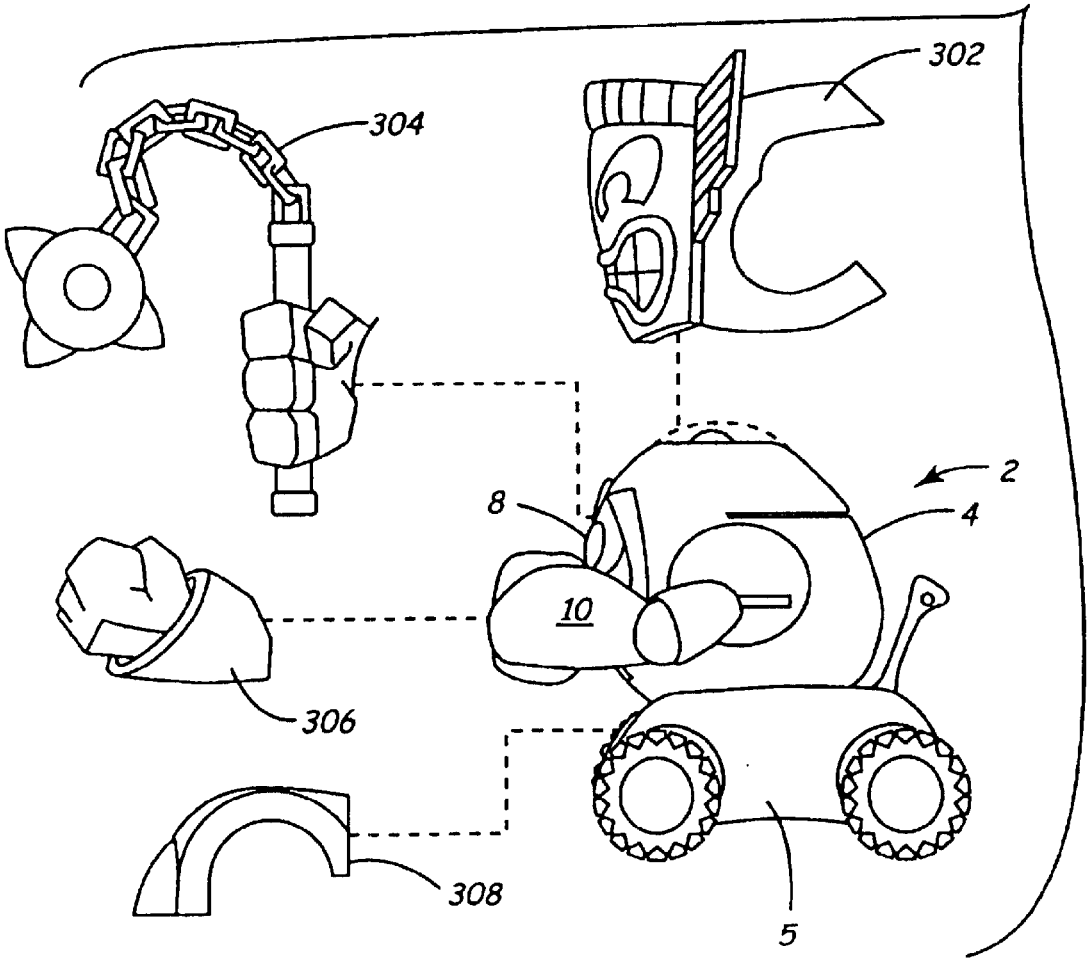
FIG. 28B

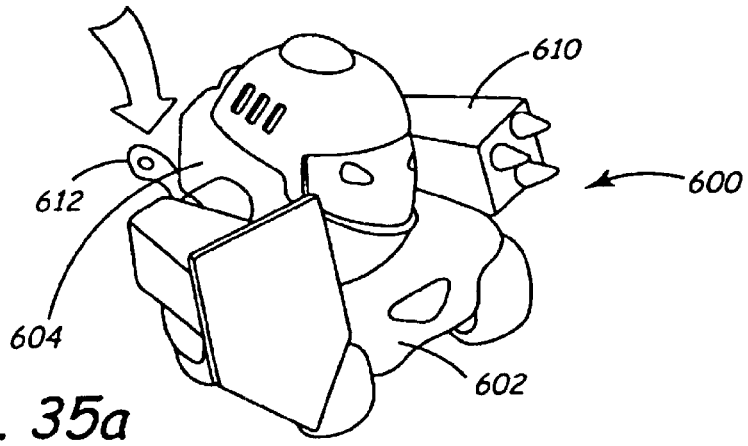
FIG. 35a
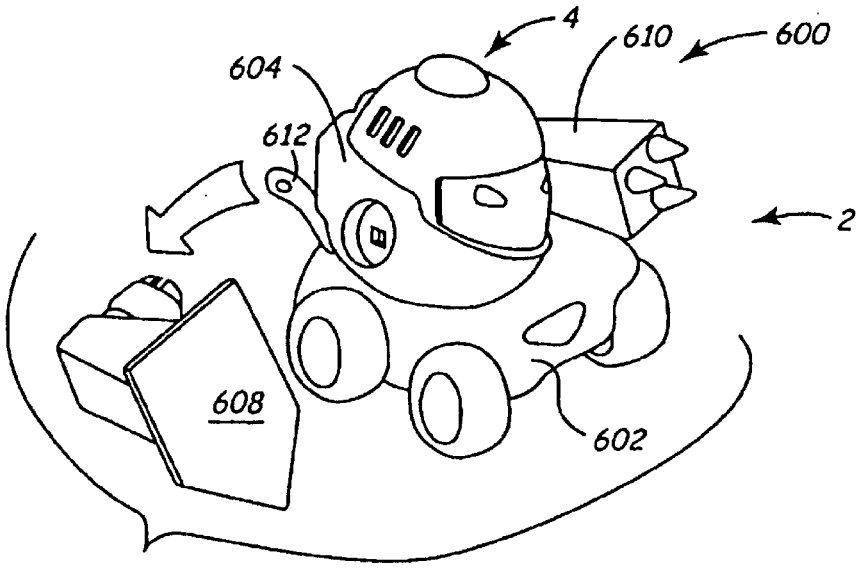
FIG. 35b
FIG. 35c
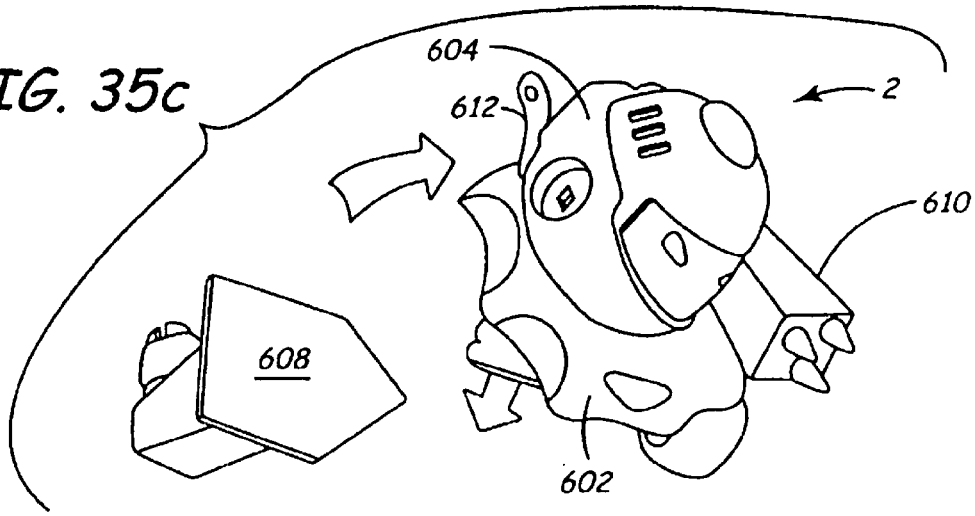

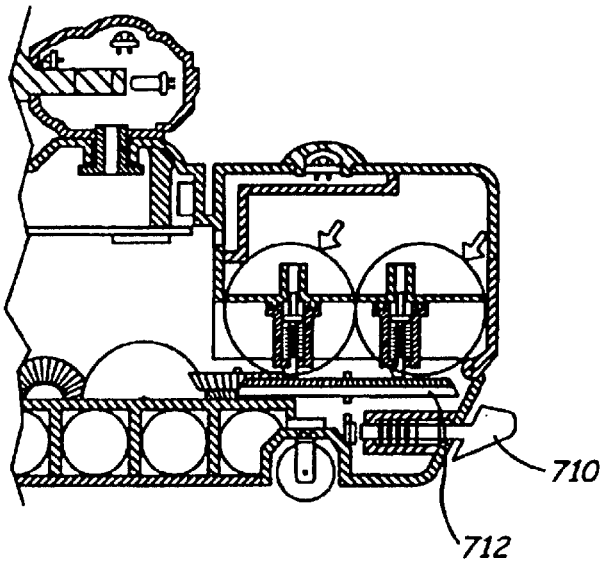
FIG. 41a
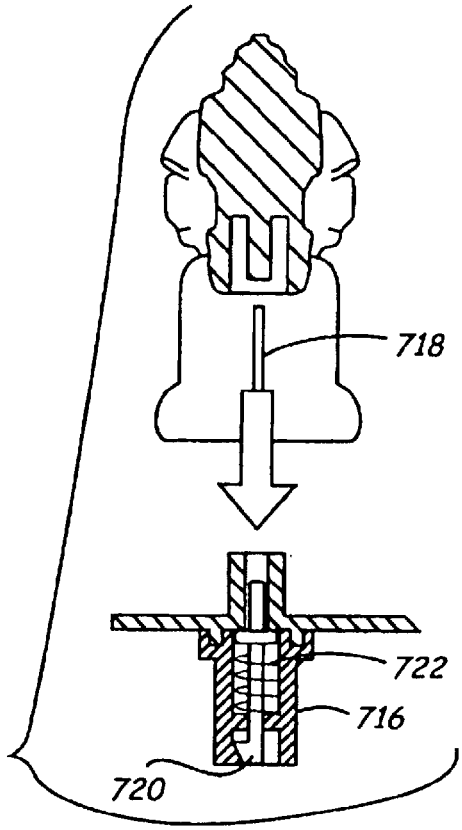
FIG. 41b
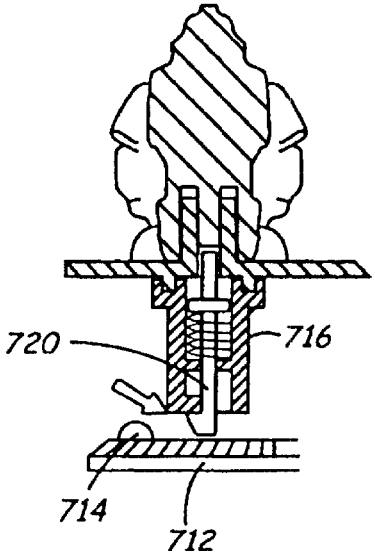
FIG. 41c
FIG. 41d
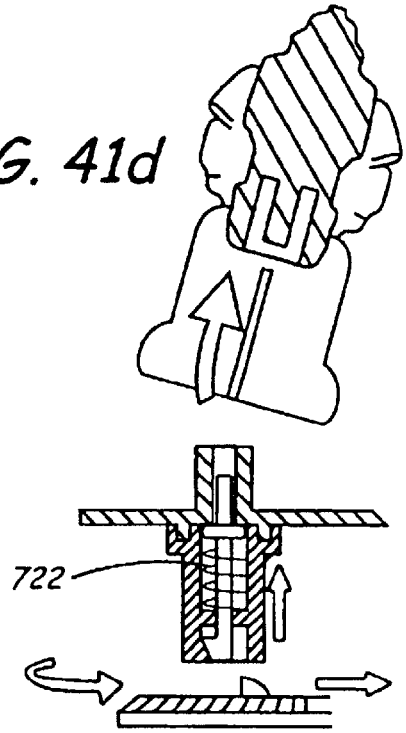

CARD INTERACTIVE AMUSEMENT DEVICE

CROSS REFERENCE TO RELATED APPLICATIONS

The present application claims the priority of a U.S. provisional patent application Ser. No. 60/236,231, filed Sep. 28, 2000, and is a continuation-in-part of U.S. non-provisional patent application Ser. No. 09/931,570, filed Aug. 16, 2001, and is a continuation-in-part of U.S. non-provisional patent application Ser. No. 09/966,680, filed Sep. 28, 2001, all three of which are incorporated herein by reference.

BACKGROUND

The present invention relates to amusement devices or toys, and the accompanying Figures and this description depict and describe embodiments of amusement devices in accordance with the present invention, and features and components thereof. The present invention also encompasses methods of making and using embodiments of the amusement devices, including playing games with them.

U.S. Pat. No. 5,314,336 discloses a toy and a method for providing audio output representative of a message optically sensed by the toy. A child may place a specially marked object in front of a toy which is capable of recognizing the marks on the object and then being able to articulate a word, phrase or sentence in response to the markings. Visible codes, invisible codes or holograms may be located on the objects to mark them.

U.S. Pat. No. 5,959,281 discloses an interactive system for reading cards, wherein the system comprises a card bearing an image and encoded information and a talking hand-held card reader for reading the encoded information on the card and playing back an audible message associated with the image or encoded information. In one aspect, the invention is also a talking hand-held card reader having a housing which is shaped to resemble a person, place, aspect or thing associated with the image or encoded information on the card being read. While the device or system of the '281 patent improves the interactivity of such devices, and while it provides a portable card and card reader system, interactivity and entertainment is limited. In other words, while the housing is adapted to play back an audible message, and the hand-held card reader is a portable, independent stand-alone unit and may be shaped as various items, including a vehicle, the housing itself is not operable or powered to move apparently of its own volition or to interact with other housings. Nonetheless, the disclosure and teachings of the '281 patent are incorporated herein by reference.

U.S. Pat. No. 6,012,961 discloses an electronic toy including a reprogrammable data storage device, including digital memory, whereby a user can selectively download program information into the data storage device to change the independent operating characteristics of the toy. In one embodiment, the toy consists of an animatronic teddy bear having a reprogrammable digital memory. Program information may be transferred into the toy's memory by removable cables connected between a computer and a control processor in the toy. Program information can also be provided by a remote computer system. The toy has a data input port for communication with a computer. The toy might comprise a fire engine having a speaker for outputting audio and a drive motor for driving the wheels of the vehicle and the memory may be programmed with control data for controlling sound and operation of the drive motor and/or associated steering mechanisms. The toy can include an input device for inputting data to the software of the toy for varying the control data and audio data that is sent to the toy's output devices. The input would change the generated output to correspond to the state specified by the software for a given input state. For example, the animatronic toy might include pressure switches, optical inputs or a microphone for inputting voice data to the software. In this regard, the software would be responsive to the input. While the toy is operable in three modes, a download mode, an interactive tether mode and an untethered stand-alone mode, there is no disclosure about interactivity between toys, nor a card swipe system wherein collectible cards are adapted to provide information to a mobile amusement device. Nonetheless, the disclosures of the '961 patent are incorporated by reference herein.

U.S. Pat. No. 6,022,273 discloses an interactive doll wherein the doll comprises a wireless computer controlled toy including a computer system operative to transmit a first transmission via a wireless transmitter and at least one toy including a wireless receiver and operative to carry out at least one action based on the transmission received. The patent mentions vehicles whose motion is controlled by human user via remote control devices, computer control of a toy via wired connection, a doll responsive to an external signal and radio controlled toys. The toy may include a plurality of toys and may include at least a first and second toy wherein the first toy is operative to transmit a toy-to-toy transmission to the second toy via a wireless transmitter and the second toy is operative to carry out at least one action based on the toy-to-toy transmission. In another embodiment of the invention there is provided a game system including a computer system operative to control a computer game and having a display operative to display at least one display object and at least one toy in wireless communication with the computer system. The computer game includes a plurality of game objects and the plurality of game objects includes at least one display object and at least one toy. Examples of actions which a toy in accordance with the invention may perform include move a portion of the toy, move the entire toy or produce a sound, and may also include reacting to signals transmitted by another toy. There is no disclosure of using a collectible game card to impart performance characteristic information to an amusement device wherein the amusement device is interactive with a human user and with other amusement devices. Nonetheless, the teachings of the '273 patent are incorporated herein by reference.

U.S. Pat. No. 5,791,652 discloses domino games and methods of play wherein cards are provided that contain indicia which direct or represent dominos and corresponding orientations. U.S. Pat. No. 6,142,475 discloses a collectible card game, and U.S. Pat. No. 4,190,256 discloses a path forming game. None of these patents suggest using a card or a card-like game piece as an information or command and control information carrying device to play a game, for collection purposes, and to actuate interactive amusement devices.

Although the above-noted patents represent advancements in interactive amusement devices and the use of such devices, there is still room for improvement in the interactivity and interest provided by such amusement devices.

SUMMARY

In one embodiment, the present invention provides an amusement device having a body, wherein the body carries features, at least one motor for powering the device and at least some of the features, and an information receiving structure for receiving information from an information carrying item discrete from the amusement device, wherein a microprocessor operably couples the motor and the information receiving structure.

In one embodiment, the present invention comprises an interactive amusement device comprising a body, a transport element moveably connected to the body, a motor associated with the body, the motor operably coupled to the transport element, a microprocessor operably coupled to the motor, and a data reader-writer operably coupled to the microprocessor. In one embodiment, the data reader-writer receives data from a data storage device. In one embodiment, the data comprises enhancement data adapted to affect, change, enhance or diminish a function of the device. In one embodiment, the data storage device is a card or a card-like item. In some embodiments, interactive amusement device of the present invention further comprises at least two limbs moveably connected to the body, wherein the motor is operably coupled to the at least two limbs. In some embodiments, the interactive amusement device of the present invention further comprises a wireless receiver operably coupled to the microprocessor and, in some embodiments, a remote wireless transmitter operably coupled by wireless communication with the wireless receiver.

In one embodiment, the present invention comprises an interactive amusement device comprising a body, at least one launch mechanism connected to the body, a motor associated with the body, and operably coupled to the launch mechanism. The launch mechanism is adapted to launch or fire one or more objects from the body. In some embodiments, the object(s) to be launched may comprise one or more figures, for example soldier figures. In some embodiments, a microprocessor may be operably coupled to the motor, and a data reader-writer operably coupled to the microprocessor. The data reader-writer may receive data from a data storage device. In one embodiment, the data comprises performance changing data adapted to affect, change, enhance or diminish a function of the device. In some embodiments, the launch-capable interactive amusement device of the present invention further comprises, with or without the data reader-writer, a wireless receiver operably coupled to the microprocessor and, in some embodiments, a remote wireless transmitter operably coupled by wireless communication with the wireless receiver.

In some embodiments, the present invention comprises an interactive amusement device comprising a body, a transport element moveably connected to the body, a motor associated with the body, the motor operably coupled to the transport element, a microprocessor operably coupled to the motor, and a data reader-writer operably coupled to the microprocessor, wherein the data reader-writer receives data from a data storage device, and a unit wireless transmitter comprising a transmitter, a receiver or both associated with the body, the unit wireless transmitter capable of wireless communication with a second interactive amusement device and/or with a remote wireless unit, for example, a hand-held wireless controller.

In some embodiments of the present invention, the transport element comprises at least two wheels and, in other embodiments, comprises at least two legs.

In one embodiment, the present invention comprises remote controlled amusement devices that can interact with each other through sending and receiving appropriate signals.

In one embodiment, the present invention comprises amusement devices that can receive information and/or commands from a card which is passed or "swiped" through a slot on the amusement device.

In some embodiments, the present invention comprises amusement devices that may produce light and/or sound, that are mobile, and that may discharge, launch or fire projectiles or shots at each other.

In some embodiments, the present invention comprises remote controlled, robotic amusement devices that can interact with a user and with each other through sending and receiving appropriate signals, wherein the amusement devices can receive information and/or commands from a card which is passed or "swiped" through an appropriate receptacle, e.g., a slot, on the amusement devices, and wherein the amusement devices may produce light and/or sound, be mobile, and may discharge, launch or fire projectiles or shots at each other. In some embodiments, the interaction among the amusement devices may comprise the amusement devices doing "battle" (e.g., competing, fighting, etc.) with each other, the inter-amusement device signals may comprise infra-red (IR) signals, and the information and/or commands may comprise actuation, attack or defense commands.

In one embodiment, the present invention provides an amusement device in the form of a robot, wherein the robot may be actuated interactively directly by a user or by another robot. In one embodiment, the user may interact with a robot of the present invention by supplying it with operational information or commands carried on a card or the like. In one embodiment, the present invention comprises a number of such cards carrying information or commands for the amusement devices of the present invention, the cards further carrying information suitable for using the cards to play a card game. The present invention encompasses a method of playing a card game, including a game involving robots, wherein the robots may receive commands or information from the cards and act accordingly, including acting or performing actions which complement the card game. The cards are also suitable for being collected and/or traded.

In one embodiment, the present invention comprises playing a game using a number of information carrying cards, which are also collectable, wherein the game involves building or accumulating a "battle" deck comprising a number of cards carrying game, control, command and/or response information, distributing the cards to players, and players using the cards against each other to try to achieve victory over other players. The information carrying game cards may be used to actuate robots which act or perform according to the information carried on a card and/or in conjunction or association with the games played with the game cards.

In one embodiment, the games of the present invention are played in a series of turns with game cards which may be collected by potential game players by purchasing, trading or otherwise accumulating them. Any or all of the cards may carry game playing symbols, indicia, graphics or game information, and any or all of the cards may carry information in the form of a bar code, magnetic strip, hologram, an embedded microprocessor or chip, or other suitable information storing and communicating devices or methods. More than one information storing and communicating device or method may be used on a single card. In addition to being used in the playing of a game, the cards may be used to communicate information or commands to the amusement devices of the present invention.

In one embodiment, the present invention comprises an interactive amusement system comprising a body, at least two transport elements moveably connected to the body, at least two arms moveably connected to the body, a motor associated with the body, the motor operably coupled to the at least two transport elements, a microprocessor operably coupled to the motor, the microprocessor being adapted to command the motor to perform an action, a data card reader associated with the body, the data card reader adapted to receive enhancement data from a data card and transmit the enhancement data to the microprocessor, wherein the enhancement data provides an enhanced function ("enhanced function" being intended to mean any changed, affected, expanded or diminished operation or perfomance), a wireless receiver associated with the body, the wireless receiver adapted to receive a wireless communication and transmit the wireless communication to the microprocessor, a unit wireless transmitter associated with the body, the unit wireless transmitter operably coupled with the microprocessor and capable of wireless communication with a second interactive amusement device and with a remote wireless transmitter operably coupled by wireless communication with the wireless receiver. The at least two transport elements may be selected from the group consisting of: (1) at least two wheels, (2) at least two legs, and (3) at least two tracks. The enhanced functions may be selected from the group consisting of: (1) increased mobility, (2) increased speed, (3) performance of an additional function, (4) expanded defense, and (5) diminished defense.

In some embodiments, the robot devices may be mobile, and have a light source or light sources and sound producing features.

In some embodiments, the amusement devices of the present invention may comprise a mechanical or electromechanical mechanism guided by automatic controls. In some embodiments, the mechanism may have at least some generally human physical attributes, e.g., eyes, arms, a head or the like, and, in some embodiments, it may have at least some generally human performance attributes, e.g., self-initiated movement, including movement of appendages, the ability to make sounds or speak, or the like. In some embodiments, the amusement device mechanism of the present invention may have at least some of the attributes of easily recognizable machines such as land vehicles, water vehicles, aircraft and the like. In some embodiments, the amusement device of the present invention may be a whimsical creature or character having any combination of generally human attributes and machine attributes. In some embodiments, the present invention comprises adjunct, secondary, peripheral and/or accompanying amusement devices, such as drones, minions, companions, pets, soldiers or the like, and, in some embodiments, the invention comprises equipment or devices for use with the amusement devices of the present invention, such as armor, shields, vehicles, weapons, game pieces, cards, game boards or the like.

In some embodiments, the robot amusement devices of the present invention include features, structures and/or apparatus for reading or receiving information, processing the information, and acting or providing an output based on the information.

In some embodiments, the present invention comprises a card game played using a number of information carrying cards, wherein the cards also may be read by one or more of a plurality of robotic devices, and wherein the robotic devices may interact with the players of the game and/or other robotic devices, and/or may act out portions of the game.

The present invention should be well suited for amusing children of all ages, and even adults may enjoy the games and the actions of the robots.

BRIEF DESCRIPTION OF THE FIGURES

The accompanying Figures provide various views of embodiments of the present invention, including depictions of the exterior appearance, assembly and detailed views of structures and features, including internal structures and features, and depictions of the operation or use.

FIG. 9, including FIGS. 9A, 9B and 9C, depict the operation of one embodiment of features of one embodiment of the present invention, namely, arms or appendages.

FIG. 14, including

FIG. 16, including

FIG. 25 is a perspective view of another embodiment of the amusement device depicted in FIG. 3.

FIG. 26 is a perspective view of another embodiment of the amusement device depicted in FIG. 3.

FIG. 27, including

FIG. 28, including FIGS. 28*a–c*, depict details of armor and its use on an embodiment of the present invention.

FIG. 35, including FIGS. 35*a–c*, depicts a function of an embodiment of the present invention.

FIG. 41, including FIGS. 41*a–d*, depicts details of the embodiment depicted in FIG. 38, including one operation thereof.

FIG. 44, including

DESCRIPTION

Figure 1:
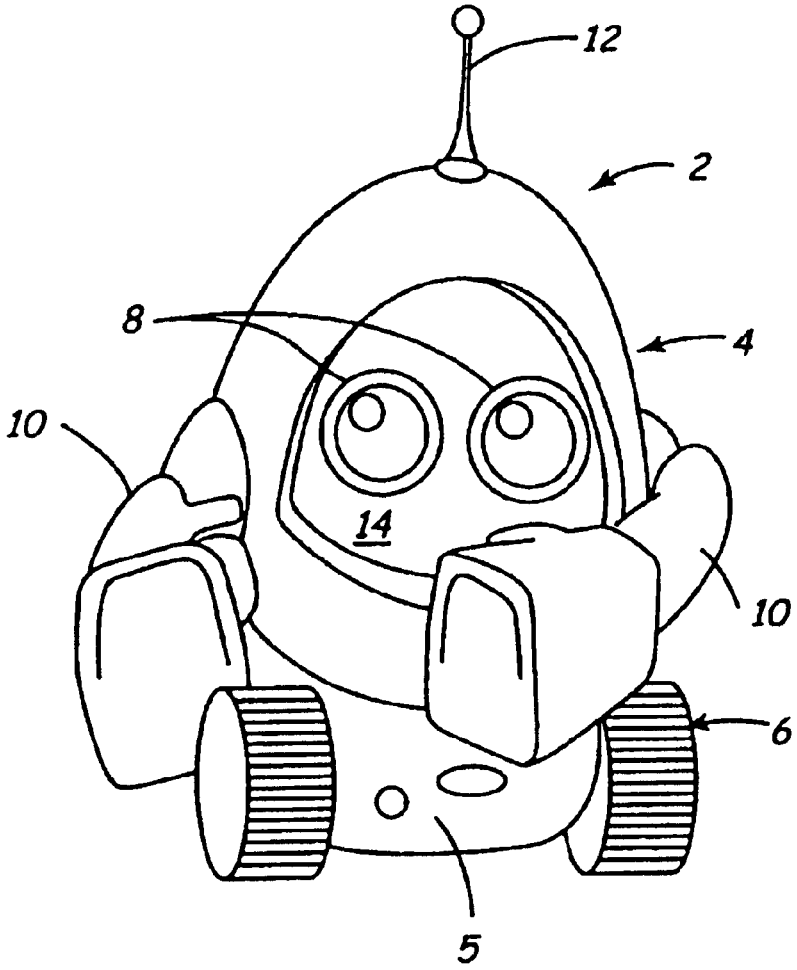
FIG. 1 depicts one embodiment of an amusement device in accordance with the present invention.

Features and advantages of the amusement device and game method of the present invention will become more fully apparent and understood with reference to the accompanying Figures, Appendices A, B and C attached hereto, and this description, which describe and depict exemplary embodiments of mechanized, substantially automatic robot amusement devices, embodiments of methods of their use, including with or in games, and embodiments of their operations.

In one embodiment, the robot amusement device is automated at least in the sense that it will operate independently, and, in some instances, apparently of its own volition, when actuated. As used herein, the term "amusement device" is intended to mean any toy, object or structure which entertains people, or which has the attribute or objective of appealing to, diverting or occupying at least some of the attention or interest of a person, whether adult or child. The term "amusement device" is particularly intended to encompass mechanical or electromechanical toys, objects or structures controlled or actuated by input from a person or another toy object or structure, including but not limited to those wherein the input is carried on or provided by a separate object or item and communicated to the toy, object or structure by inserting the separate object or item into the toy, object or structure, swiping the object or item through the toy, object or structure, or bringing the object or item into proximity to the toy, object or structure. The term "amusement device" is thus intended to encompass toys of any various form wherein the user provides input, which may be control or command input, that is "read," i.e., received or perceived and processed or translated into an output such as an action, sound or display.

As used herein, the terms "robot," "robot device," "robot amusement device," "robotic," "robotic device," "robotic amusement device" and the like are intended to mean and encompass (1) mechanisms and devices guided by automatic controls; (2) apparatus or devices, including automatic apparatus and devices, that perform functions ordinarily ascribed to humans; (3) apparatus and devices that operate with what appears to be intelligence, including almost human intelligence; and (4) machines that may look generally like a human being and perform various complex acts of a human being.

Fastening, mounting, attaching or connecting the components of the present invention to form the robot device as a whole, unless specifically described otherwise, are intended to encompass conventional fasteners such as screws, nut and bolt connectors, threaded connectors, snap rings, hose clamps such as screw clamps and the like, rivets, nuts and bolts, toggles, pins and the like. Components may also be connected by welding, friction fitting or deformation, if appropriate. Electrical connections may be made using appropriate electrical components and connection methods, including conventional, commercially available electronic components, connectors and devices such as suitable wiring, connectors, power supplies, printed circuit boards, microchips, speakers, lights, liquid crystal displays, infrared ("IR") systems of receivers and emitters, audio components, inputs, including bar code reading type devices, outputs and the like. Unless specifically otherwise disclosed or taught, materials for making components of the present invention are selected from appropriate materials such as metal, metallic alloys, fibers, plastics and the like, and appropriate manufacturing or production methods including casting, extruding, molding and machining may be used.

Any references to front and back, right and left, top and bottom and upper and lower are intended for convenience of description, not to limit the present invention or its components to any one positional or spatial orientation.

Referring then to FIG. 1, one embodiment of the amusement devices of the present invention is depicted. The device 2 comprises a body 4 carried on a base 5 providing and housing a transport mechanism 6. The body 4 carries a plurality of operable features and decorative features, including, for example, eyes 8, arms 10, an antenna 12 and a "face" 14. Additional features may be provided as well. At least some of the features are moveable, e.g., the arms 10, the body 4 is movably coupled relative to the base 5, and the body 4 and base 5 together are movable across a surface in selected directions by the transport mechanism 6, including transport elements such as wheels 7 or, in other embodiments, tracks or legs.

Figure 2:
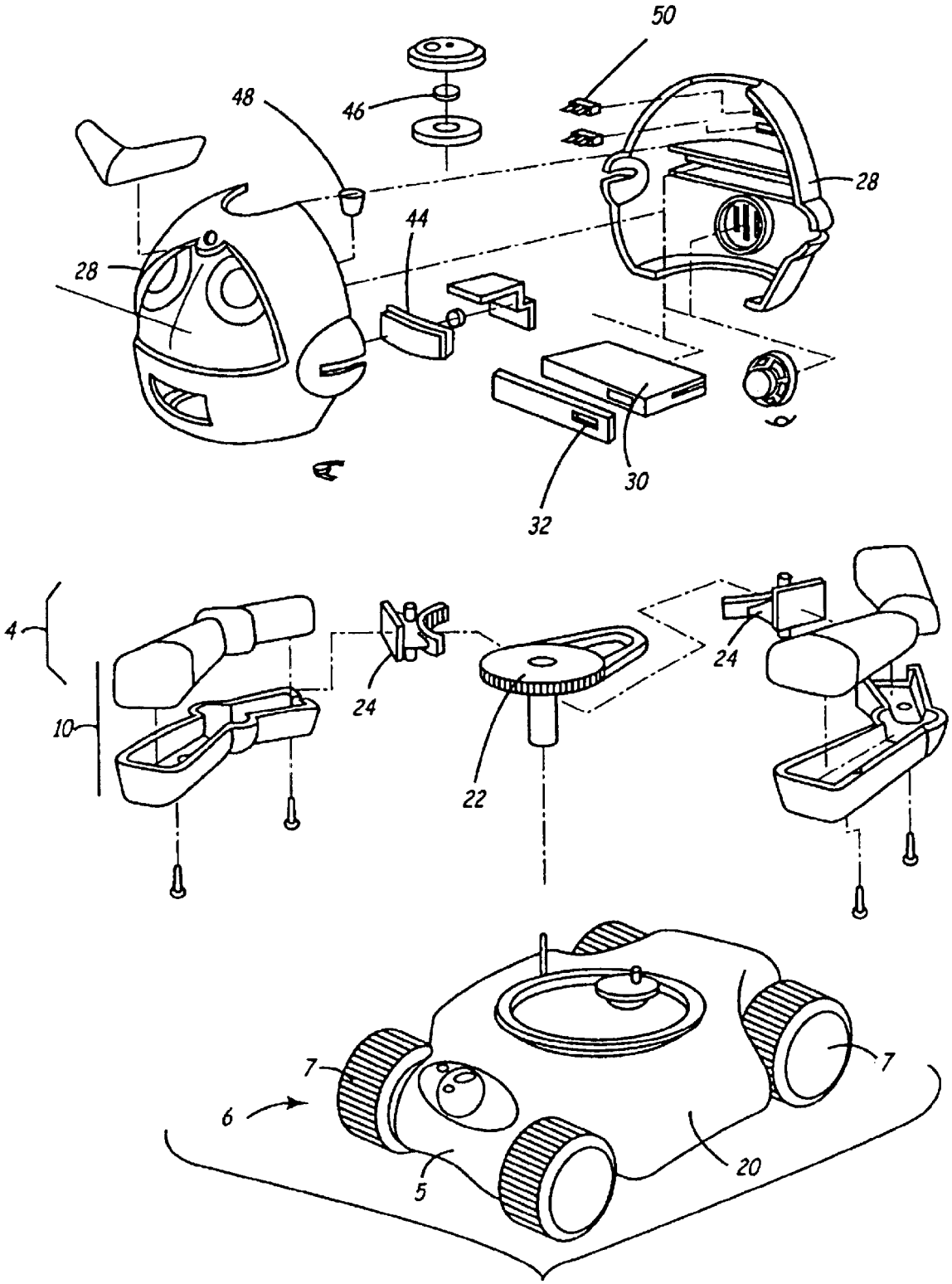
FIG. 2 is an exploded assembly view of the embodiment depicted in FIG. 1.

FIG. 2 provides an exploded assembly view of the embodiment depicted in FIG. 1, including the base 5, the body 4 and various of the features carried by the body 4. The base 5 houses a suitable motor 20 (depicted in phantom) and a suitable power source such as a plurality of batteries (not shown) operably coupled to the motor 20. Wheels 7 are part of the transport mechanism 6, as is the motor 20 and power source. The motor 20 is connected to a drive gear 22 extending generally upwardly into the body 4, in turn coupled to suitable gear racks 24 for operating features of the invention such as arms 10. With continued reference to FIG. 2, the body 4 is formed of two half shells 28 that are suitable joined to each other to create a substantially hollow cavity for housing operational components of the invention including various drive gears, springs, linkages and other operational assemblies, motors, lights, sensors, gear racks, and also for housing a card reader 30. The card reader 30 is operably coupled to a card receiving insert 32 whereby an information carrying card "C" (not shown in FIG. 2, but see, for example, FIG. 16) may be inserted and read by the card reader 30.

Figure 7:
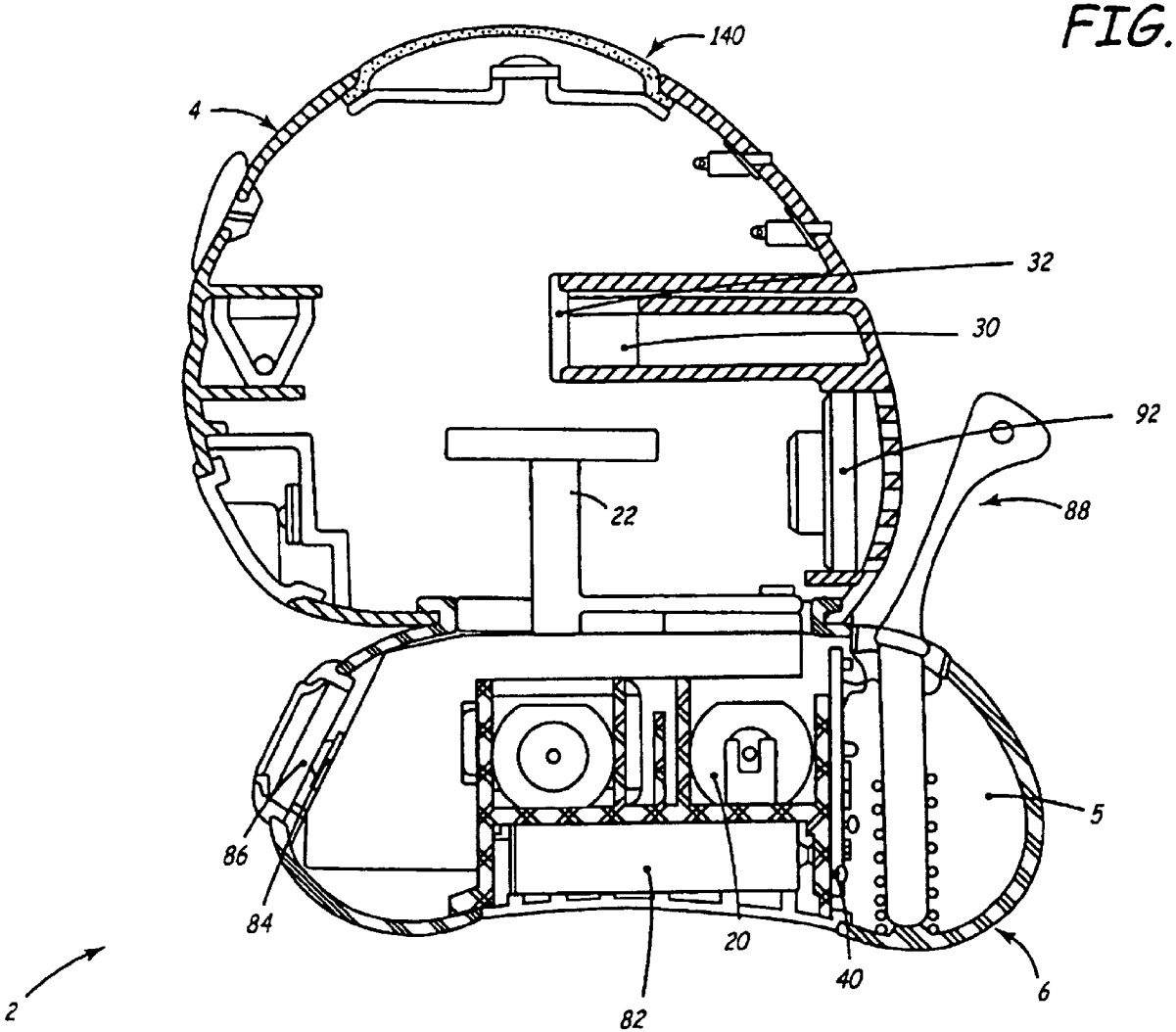
FIG. 7 is an elevational view of the embodiment depicted in FIG. 1 with portions in section and broken away.

Referring to FIG. 7, the card reader 30 is operably coupled or connected to an on-board, printed circuit board/integrated circuit microprocessor complex 40 which receives information from the card reader 30, and processes and sends it to the various motors, inputs, outputs and/or displays associated with the invention. In this embodiment, as in all embodiments, it should be appreciated that any number of inputs and programmed and/or programmable circuit boards and software may be incorporated as necessary or desired to accomplish desired outputs, functions or performance. Any embodiment of the amusement device of the present invention may include a suitable data and control operating or processing system or systems, typically in the form of a computer or one or more microprocessor boards or chips contained within the housing. These printed circuit boards or chips may be configured as desired and convenient for particular embodiments and functions, and may be constructed and located as suitable for particular embodiments. Future performance needs and features (e.g., LCD controller (s), audio enhancements, RAM, etc.) may involve the use of multi-chip sets. A variety of different configurations and types of memory devices can be connected to suitable pc's or boards as is well-known in the art. The invention may include a port or wireless capability to allow data to be programmed or downloaded. In some embodiments, performance requirements, user use, responses, performance, degree of interactivity and/or skill can be varied or manipulated, recorded and displayed, or downloaded.

The microprocessor 40, whatever form it takes, includes software or programming which is used in the operations use of the present invention. It should be understood that the particular software used may vary dependent upon, for example, the desired input and output options and/or interactivity. There may be modifications to the software and program routines to accomplish these changes, or such may be required in connection with the wide variety of functions, activities, displays and sounds available.

The selected microprocessor 40 will be suitable for performing a number of data processing function in connection with the selected and preferred performance. One function is receiving user input and translating it into a selected action. Other representative functions include, but are not limited to, producing and/or controlling an audio output, both or selectively in response to a perceived stimulus, a sensed ambient condition or in response to user input, producing and controlling mobility, producing and/or displaying audio and/or visual inquiries of the user or other devices, producing and controlling interactivity with the user and other devices, and sensing functions.

Referring back to FIG. 2, the invention is provided with inputs such as push buttons 44 and IR receiver 46 for receiving input from the user. Additionally, the invention 2 is provided with appropriate switches or inputs, such as gravometric switch 48 and off/on switch 50, and others, for controlling various operations or functions of the amusement device 2. For example, in a "battle" between two of the devices 2, one may tip the other over, thus "killing" it because the switch 48 turns off the tipped over device 2. IR signaling and/or communication is to be considered an exemplary form or signaling or communication; other forms of communication, including any suitable form of wireless communication, may be used with or to replace IR communication.

Figure 3:
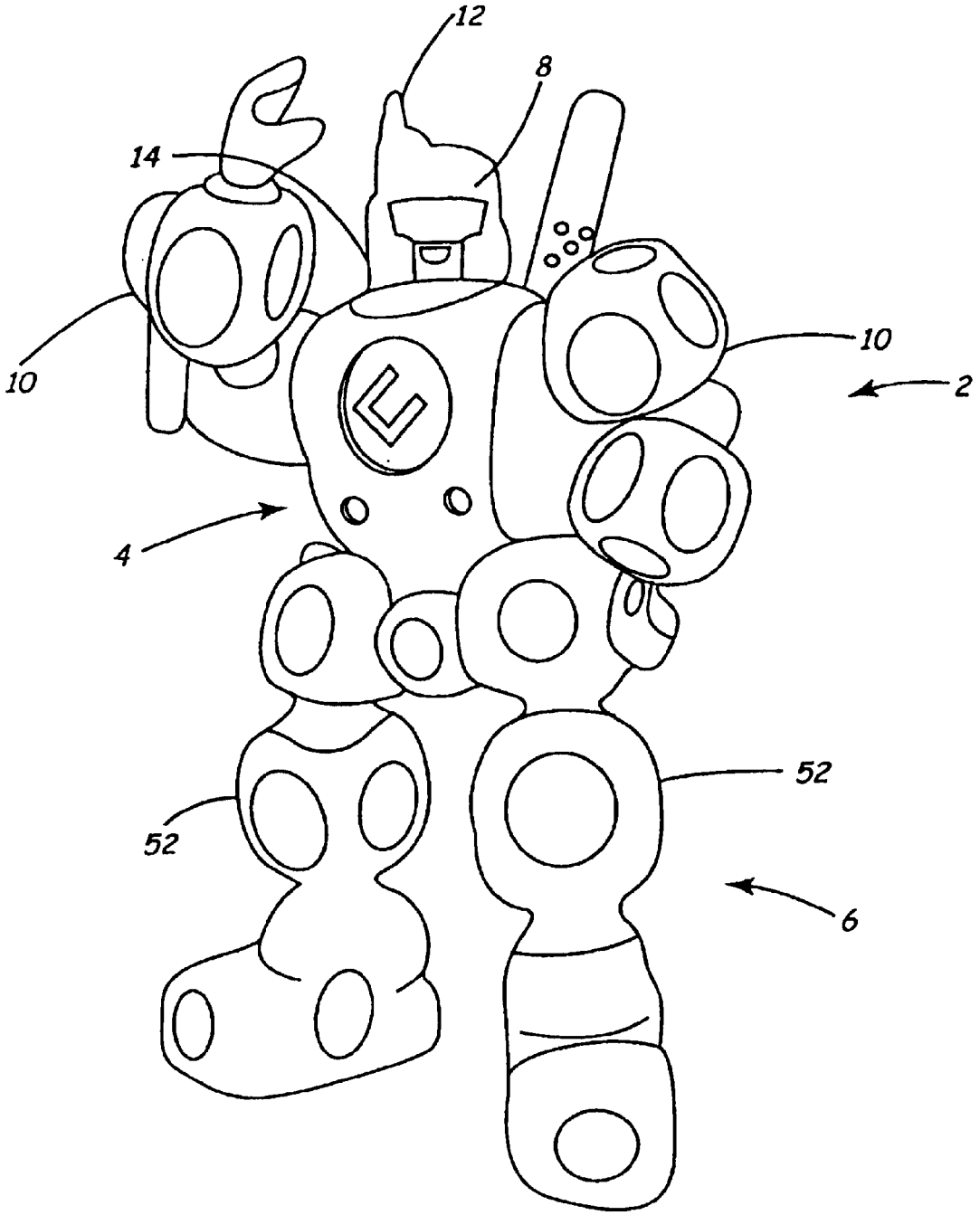
FIG. 3 is a perspective view of another embodiment of the amusement device of the present invention.
Figure 4:
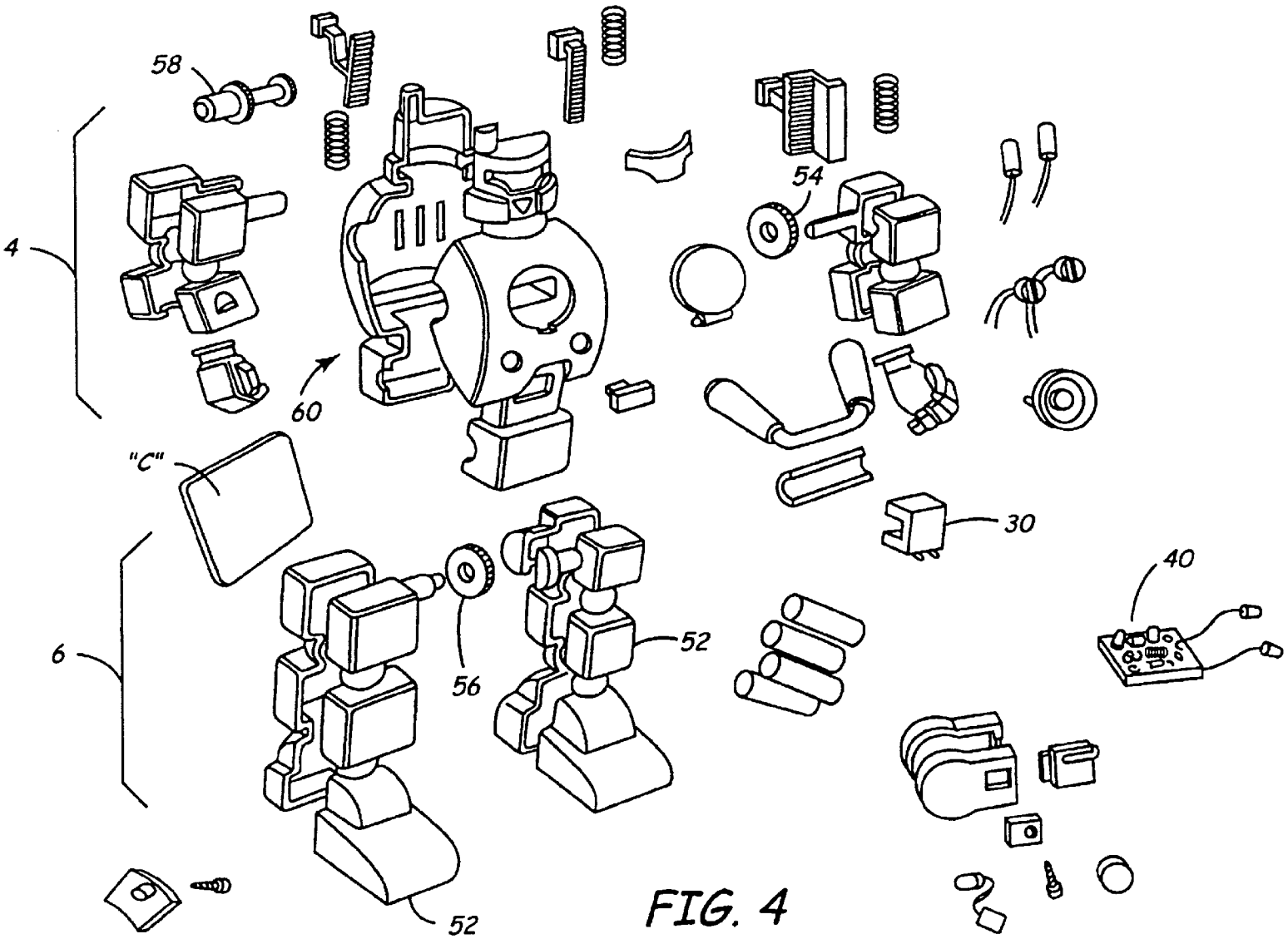
FIG. 4 is an exploded assembly view of the embodiment depicted in FIG. 3.

Referring to FIGS. 3 and 4, another embodiment of an amusement device in accord with the present invention is depicted. In this embodiment of the amusement device 2, the base 5 comprises legs 52 which carry the body 4 (note: elements or features generally common to embodiments of the present invention are referred to with common reference numbers). The body 4 carries a plurality of operable features and decorative features, including, for example, eyes 8, arms 10, an antenna 12 and a "face" 14. Additional features may be provided as well. At least some of the features are moveable, e.g., the arms 10, the body 4 is movably coupled relative to the base 5, and the body 4 and base 5 together are movable across a surface in selected directions by the transport mechanism, i.e., legs 52.

FIG. 4 provides an exploded assembly view of the embodiment depicted in FIG. 3, including the base 5, the body 4 and various of the features carried by the body 4. The body 4 houses a suitable motor (not shown) and a suitable power source (not shown) such as a plurality of batteries operably coupled to the motor. Legs 52 are part of the transport mechanism 6, as is the motor and power source. The motor 20 is connected to suitable gears, e.g., gears 54, 56 and clutches, e.g., clutch 58, for operating features of the invention such as arms 10 and legs 52. With continued reference to FIG. 4, the body 4 is formed of two half shells 60, that are suitably joined to each other to create a substantially hollow cavity for housing operational components of the invention including the various drive gears, power linkages and other operational assemblies, motors, lights, sensors, gear racks, and also for housing a card reader 30 whereby an information carrying card "C" may be inserted and read by the card reader 30. A microprocessor complex 40 may be suitably located and carried by the body 4. It should be appreciated that any of the "joints" or couplings between portions of the embodiments of the invention, e.g., between the arms 10 and the body 4, between the legs 52 and the body 4, or the joints of the body 4, etc., enable the embodiments to "transform" or change from one configuration to another. For example, the embodiment depicted in FIGS. 3 and 4 may transform from the depicted, generally human-like figure (FIG. 3) to a generally tank-like figure (FIG. 25), motorcycle-like figure (FIG. 26) or an aircraft-like figure (not shown). This is accomplished by providing suitable pivotal or rotational joints and couplings and/or by providing severable couplings and/or detachable appendages or segments which can be moved to various positions relative to the body 4. This feature not only provides for reconfiguration or transformation, it may be used to attach peripheral devices and/or equipment to the embodiments of the invention, to position them in selected positions or attitudes, and to stage battles between or among the various embodiments.

Figure 28C:
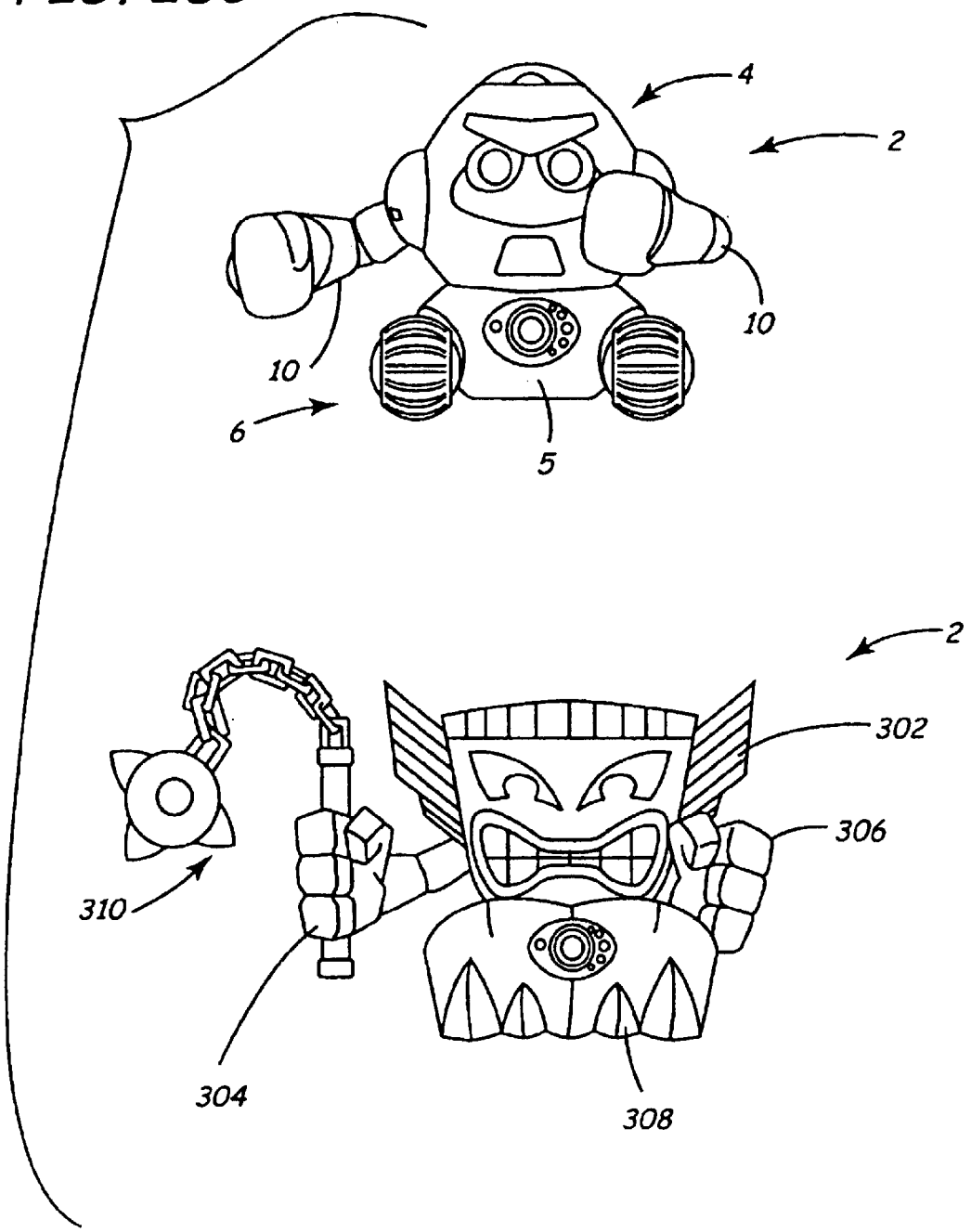

FIG. 27, including FIGS. 27*a–f*, and FIG. 28, including FIGS. 28*a–c*, depict that any of the various embodiments of the present invention may be used with suitable armor or shields. Several sets of armor are indicated generally at 300 in FIG. 27, each comprising a selected number of pieces of armor, of selected, suitable material, adapted to be coupled to and/or carried by any of the embodiments of the present invention. Although depicted as sets in FIG. 27, it should be understood that the sets can be broken up and individual pieces of armor may be used separately. Additionally, it should be understood that the cards "C" for use with the present invention and in games played with the cards may require that pieces of armor be selectively placed on or removed from embodiments of the invention. Referring to FIG. 28*b*, the armor 300 may include a face shield 302, arm coverings 304 and 306 and a chassis shield 308. FIG. 28*a* depicts one suitable method for attaching or coupling the armor to the embodiments of the present invention, namely, a snap-like, nipple-socket arrangement; other attachment arrangements are possible. The armor 300 may be used selectively to change the performance characteristics of embodiments, e.g., to render them less susceptible to attack, or to mask their capabilities. Some of the armor, as shown in FIG. 28*c*, may provide additional weapons, e.g., a mace-like swinging ball and chain 310 and may substantially change the appearance and performance characteristics of the amusement device with which it is used. As depicted in FIG. 27*a–f*, other pieces of armor may be provided.

Figure 5:
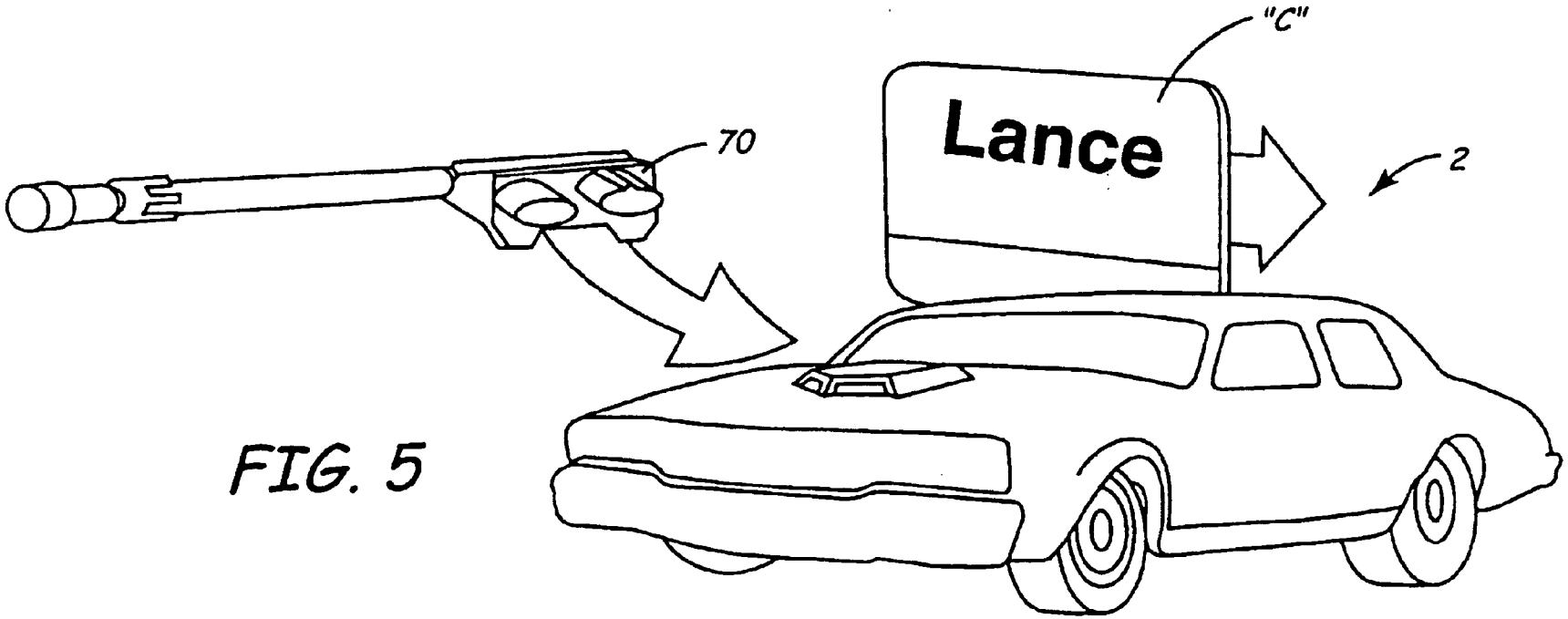
FIG. 5 depicts another embodiment of the amusement device of the present invention.
Figure 6:
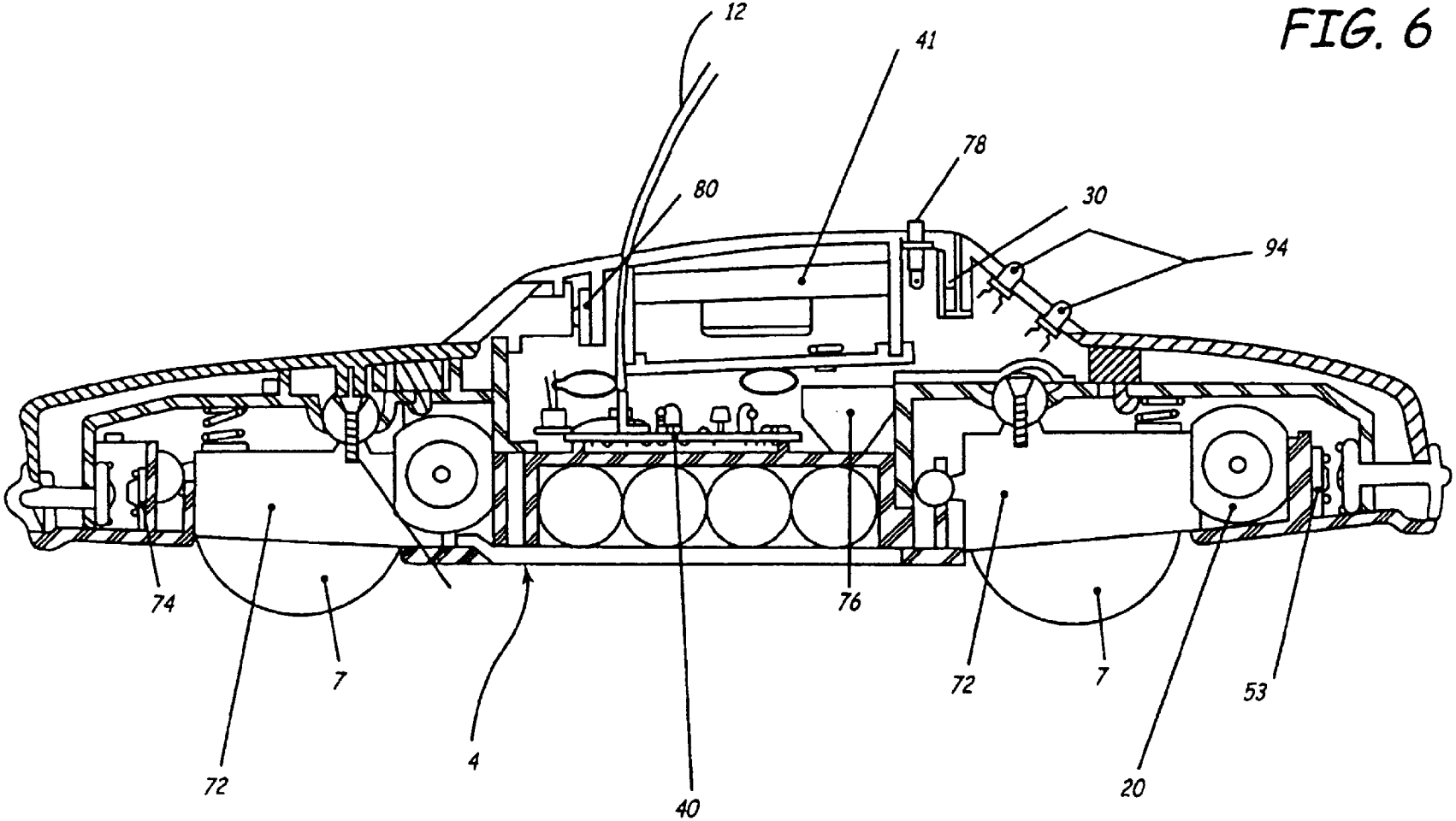
FIG. 6 is a elevational view of the embodiment depicted in FIG. 5 with portions in section and portions broken away for clarity.

FIGS. 5 and 6 depict another embodiment of the amusement device 2. In particular, this embodiment 2 takes the form of a car or other land vehicle which is adapted to receive a swipe card "C." Referring to FIG. 5, this embodiment 2 of the invention is adapted to carry a lance 70. FIG. 6 depicts the automobile embodiment 2 of the present invention partially in section and with portions broken away for clarity. As in each embodiment of the invention, a body 4 is provided and houses various of the operational features of the automobile robotic amusement device 2. Such features include a bar code reader 30, at least one motor 20 and associated gear boxes or gear arrangements, e.g., steering gearbox 72. Transport elements comprise wheels 7. Various suitable switches are provided to control functions or receive input and include switches such as contact switch 74, tilt switch 76, slide switch 78 and contact switch 80. The automobile or land vehicle embodiment 2 of the present invention carries an antenna 12 operably coupled to a printed circuit board integrated circuit microprocessor complex 40. Swiping a card "C" through the device 2 may change performance characteristics and/or battle accessories. Any style of car or land vehicle may be provided, and the car embodiments of the present invention may be provided with exploding damage displays, speed and armor changeability, pit and pit crew accessories, and the like.

FIG. 7, an elevational side view, with portions broken away and portions sections, is provided to depict additional details with respect to an embodiment of the present invention. The device 2 includes a body 4 and base 5. The base 5 houses the microprocessor (PCB/IC) complex 40 and suitable motors 20 and a power source, in this instance batteries 82. Additionally, base 5 houses an IR receiver 84 which is set behind an iris 86. Note that the base 5 also carries and/or houses a kill switch indicated generally at 88 which is operably coupled to the microprocessor complex 40. Another one of the interactive devices 2 may try to hit the kill switch 88 to "kill" a device 2, for example, during a "battle" between two or more of the devices 2. The switch 88 can be moved in any direction. The drive gear 22 extends from the base 5 into the body 4 for operating various other components or features (such as arms 10, not shown). The body 4 houses the card reader 30 and is provided with the card receiving insert slot 32 for receiving an information bearing card to be read by the card reader 30. Suitable electrical connections, including conventional wiring, electrical devices or wireless communication features, may be used to operable couple the reader 30, the microprocessor 40 and operational features.

Note that all embodiments of the invention may be provided with one or more speakers 92 and, referring back to FIG. 6, suitable clear or colored light sources such as red and green LED's 94.

Figure 8:
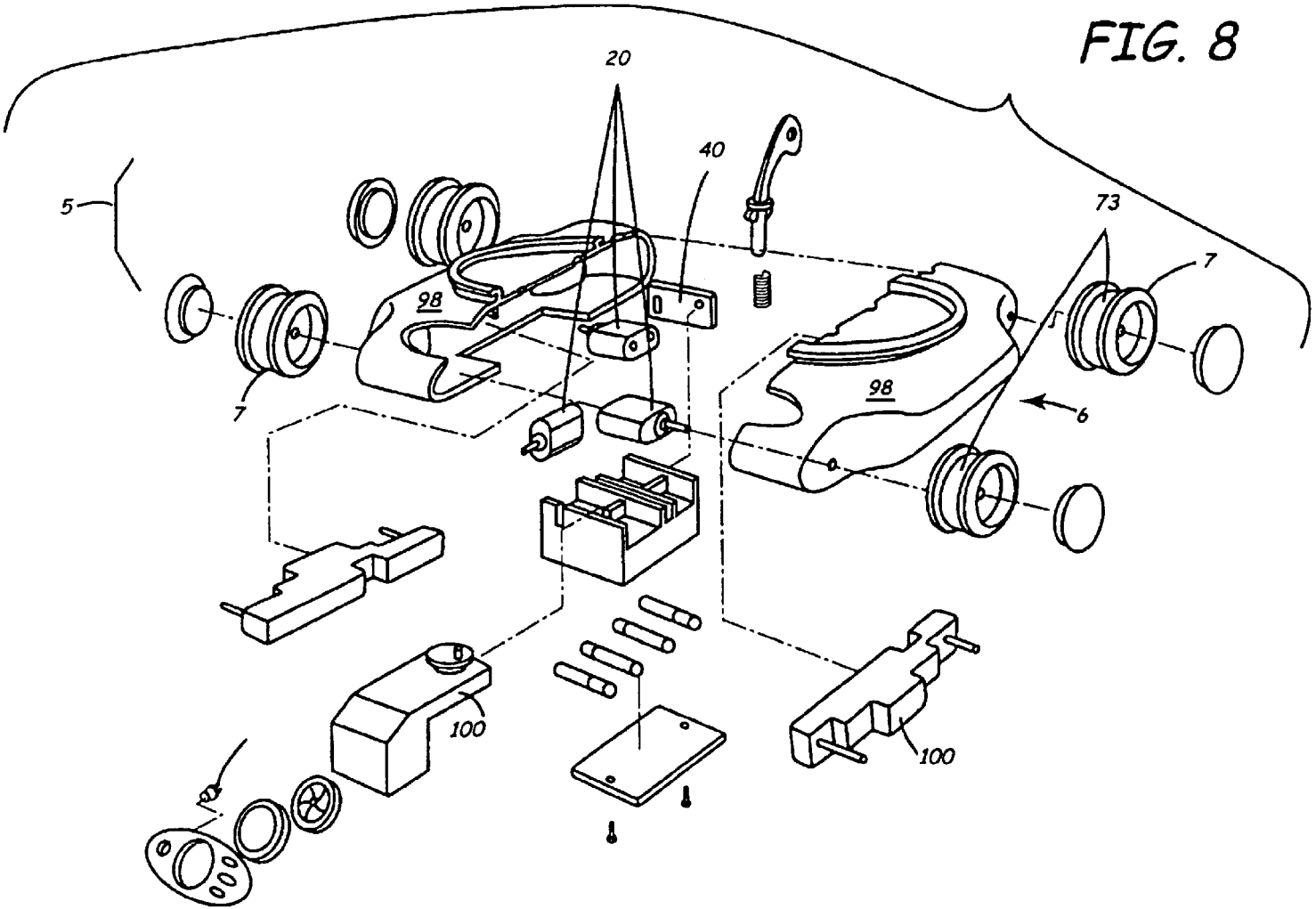
FIG. 8 is an exploded assembly view of one embodiment of a base for use with embodiments of the present invention.
Figure 10:
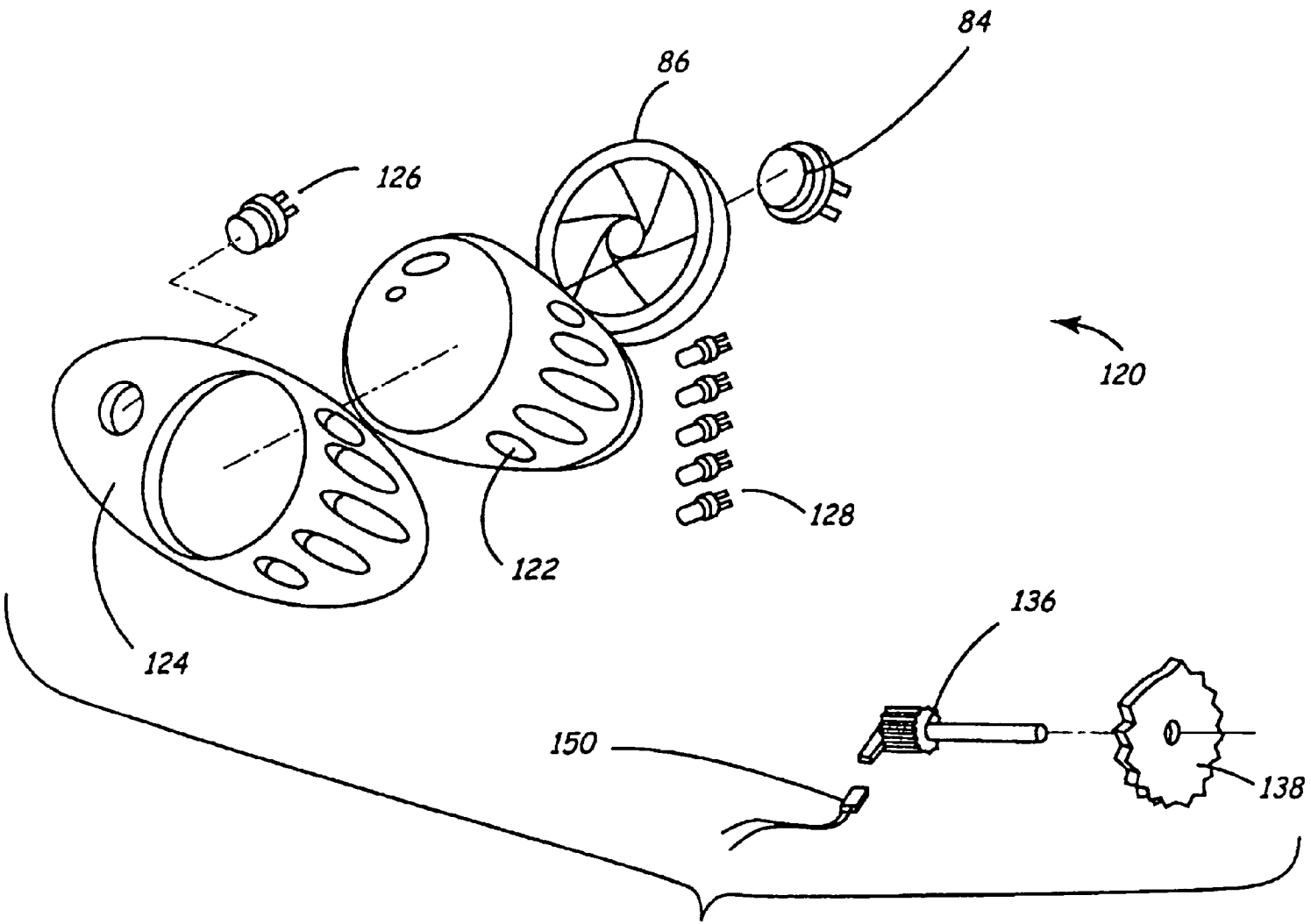
FIG. 10 depicts one embodiment of a lens assembly for use with the present invention.

FIG. 8 depicts a base 5 which is suitable for use with embodiments of the present invention. The base 5 is comprised of two shells indicated at 98 which may be joined to form a housing for suitable motors 20 and power sources such as batteries. Additionally the base 5 houses suitable gear boxes 100 for operably being coupled to the features such as the wheels 7. Note that in some embodiments the base 5 may house a microprocessor complex 40, either instead of locating it in the body, or in conjunction with another complex located in the body.

Referring to FIG. 9, including FIGS. 9A, 9B and 9C, one embodiment of an arm operating mechanism for embodiments of the present invention is depicted. The drive gear 22 housed in the body 4 is operably coupled to the universal cam wheel 110. At the internal end the arms 10 a gear face 112 is provided for being operably coupled to the drive gear 22. The arms 10 are pivotally mounted, e.g., on a post 114, and a torsion spring 116 is provided for each arm 10. The universal cam wheel 110 spins turning the drive gear 22 left and right. As the cam 110 turns, the drive gear 22 drives the left arm 10 inward and the right arm 10 out. As the cam wheel 110 pushes past its center, the torsion springs 116 on the arms 10 forces them quickly back to their original position. The torsion springs 116 make a fast swing happen. The universal cam wheel 110 forces the torsion springs 116 into position and allows them to force the drive mechanism back into position. This arrangement or a similar arrangement may be used to operate other operational features as well.

Figure 11:
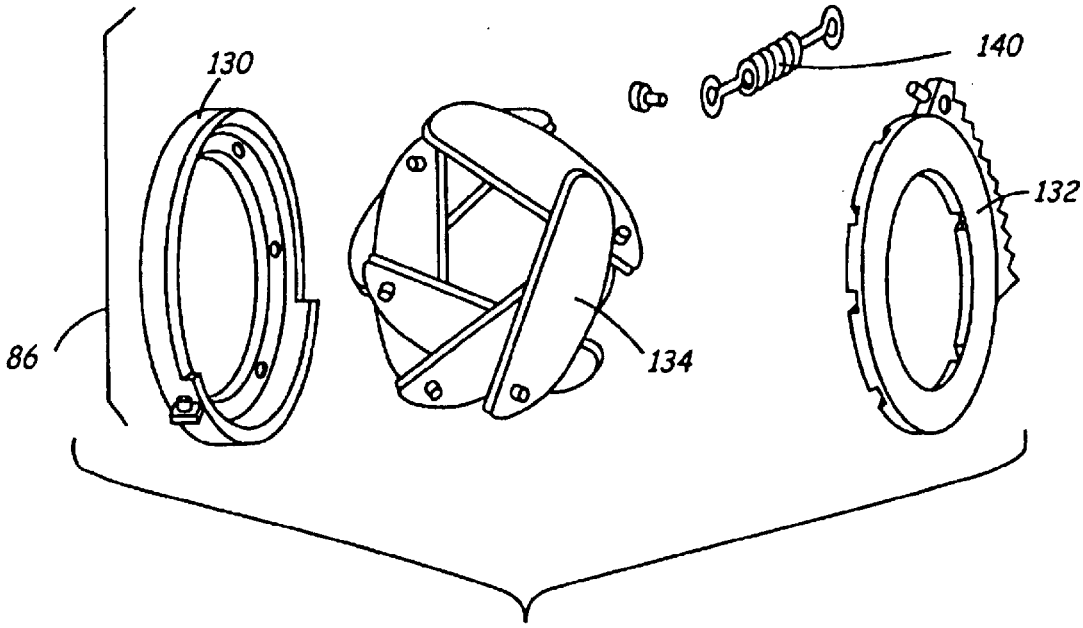
FIG. 11 depicts the assembly of one embodiment of an iris or shield for use in the lens assembly depicted in FIG. 10.
Figure 12:
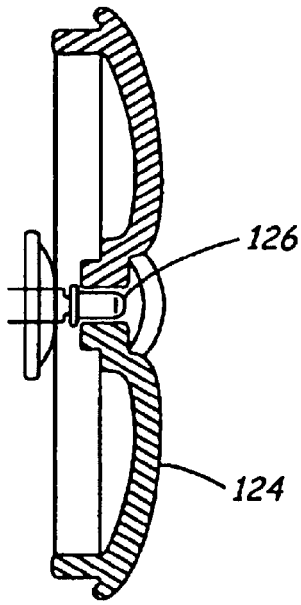
FIG. 12 is a side elevational view of a portion of the present invention.
Figure 13:
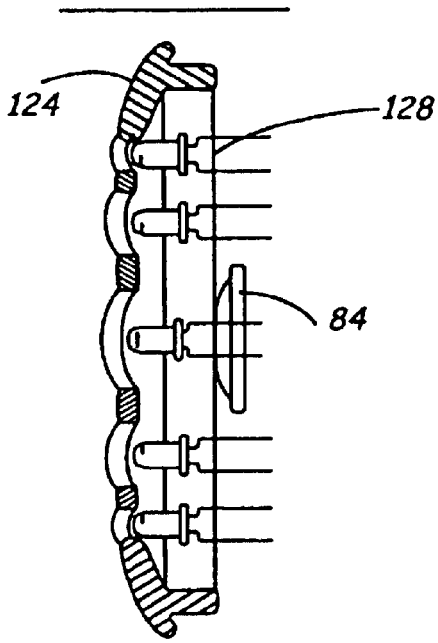
FIG. 13 is a side elevational view of a portion of the present invention.

Referring to FIGS. 10–13, a lens assembly 120, including iris 86, is provided for embodiments of the present invention. The lens assembly 120 includes the iris 86, a clear insert 122 and a face plate 124. It also includes an IR receiver 84 and an IR transmitter 126. Suitable light sources such as LED's 128 may be integrated as well. FIG. 11 is an exploded assembly of the iris 86 which includes a front ring 130, a back plate 132, a plurality of movably coupled iris veins 134. The veins linked to each other and are moved by a gear assembly, including a drive gear 136, locking gear 138, and are spring tensioned by extension spring 140. FIGS. 12 and 13 depict portions of the IR transmitter and receiver and LED locations. FIG. 12 depicts a right hand side view of the IR transmitter 126 and how it may be lodged behind the face plate 124 associated with the base 5 of the invention, and FIG. 13 depicts a left hand view depicting the IR receiver 84 and LED's 128 and how they may be mounted behind the face plate 124. This arrangement may be adapted as necessary to configure to various embodiments of the amusement devices 2 of the invention, and more than one such assembly may be provided, e.g., a second wireless data communication assembly such as that depicted in FIG. 7 at 140. The iris 86 may be opened and closed in response to a particular card "C" being swiped through the card reader 30.

Figure 14A:
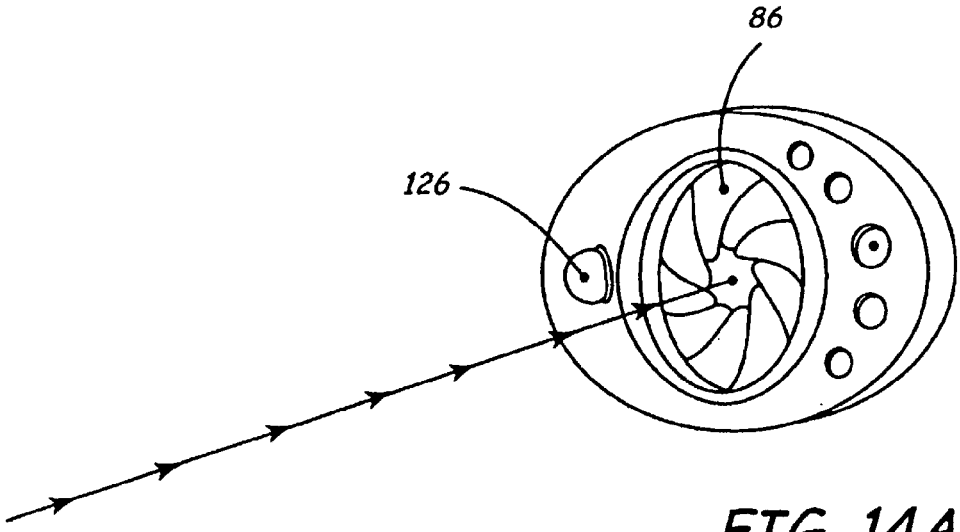
FIGS. 14A and 14B, depicts one embodiment of the interactivity of the amusement devices of the present invention.
Figure 14B:
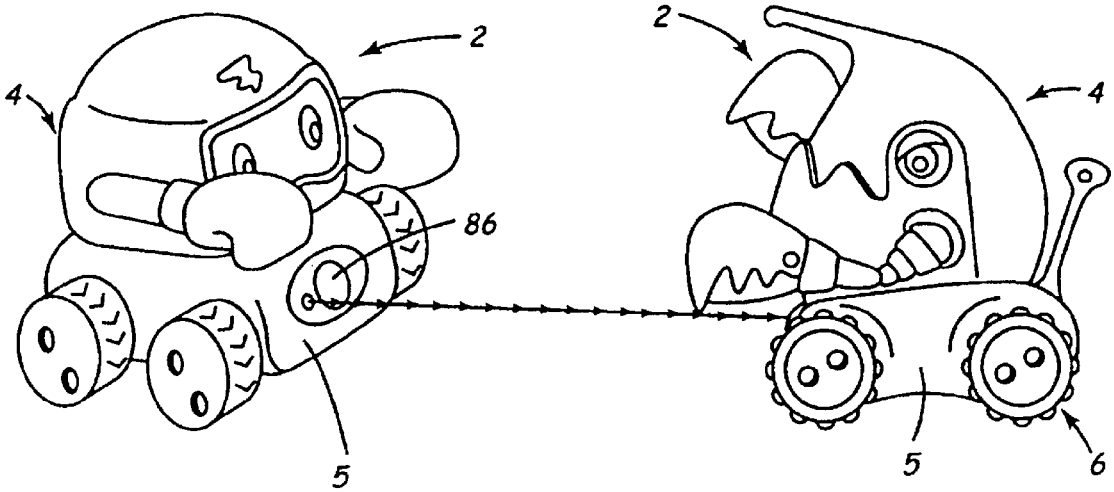
Figure 15:
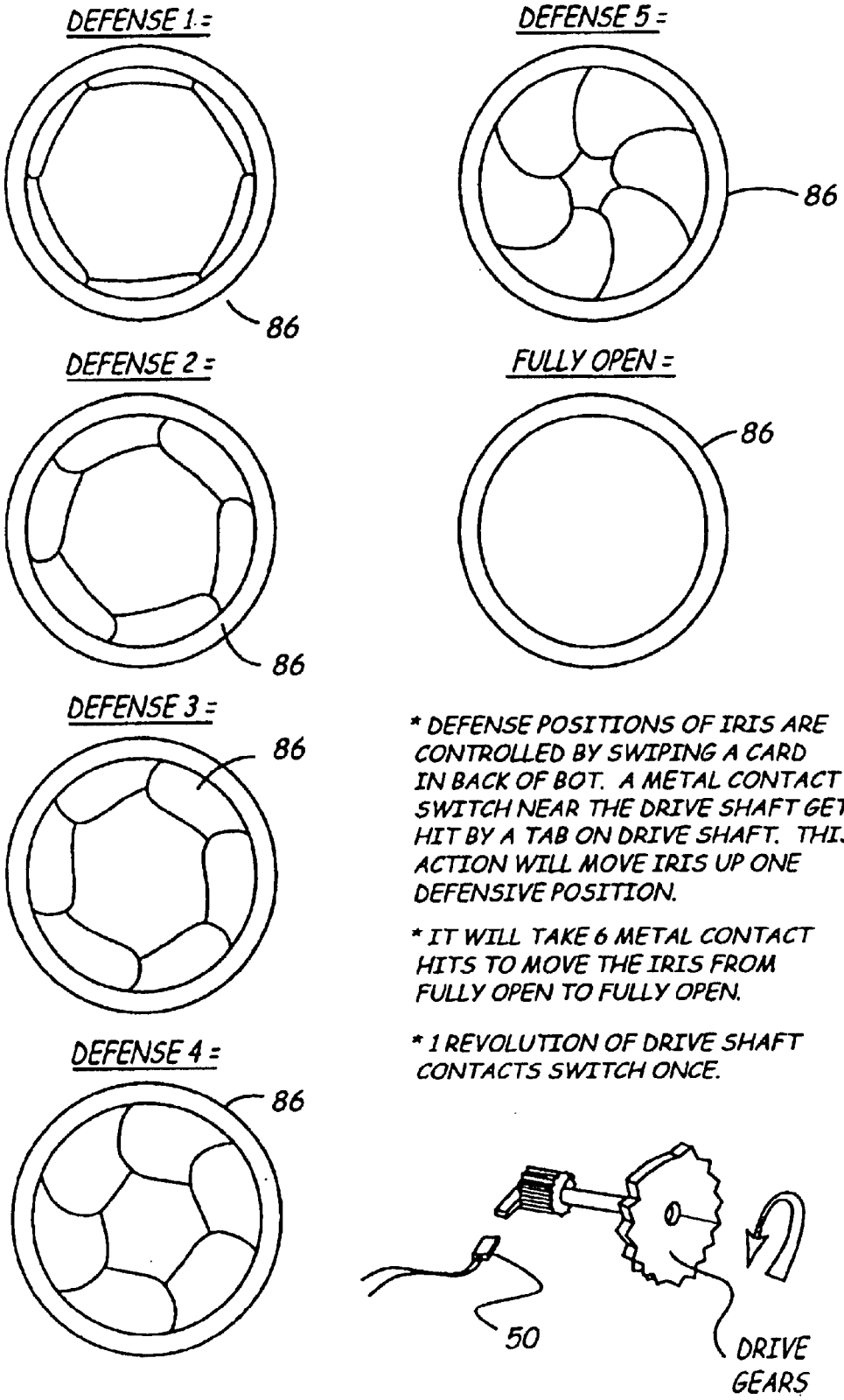
FIG. 15 depicts the operation of the iris defense mechanism associated with embodiments of the present invention.

Referring to FIG. 14, including FIGS. 14A and B, the inter-amusement device interactivity involving, in some embodiments, the infra red ("IR") wireless transmitter and receiver arrangements of the present invention 2 is depicted. In particular, the iris 86 acts as a defensive device. As shown in FIG. 7, an IR receiver 84 sits behind the iris 86 at the front of the base 5. The iris 86 can open and close at various levels depending on the level of operation commanded by the microprocessor 40 and by a selected card "C" which has been swiped through the card reader 30. The user may try to "shoot" an opponent with the IR beam as depicted in FIG. 14B. If the iris 86 is closed the beam will have no effect, but if the iris 86 is open it will "kill" the amusement device 2 receiving the beam. FIG. 15 also depicts the operation of the iris 86 and, in particular, selected open and closed positions which may be controlled or affected by swiping a selected card "C" through the card reader 30. In operation, a suitable metal contact switch 150 near the drive shaft of the iris assembly gets hit by a tab on the drive shaft. This action moves the iris 86 to a defensive position. In some embodiments, it may take six hits to move the iris from a fully opened to a fully closed position. In some embodiments, the microprocessor 40 is programmed to return the iris 86 to a fully opened position when the off-on switch of the amusement device 2 is turned off and when the kill switch 63 is contacted.

Figure 16A:
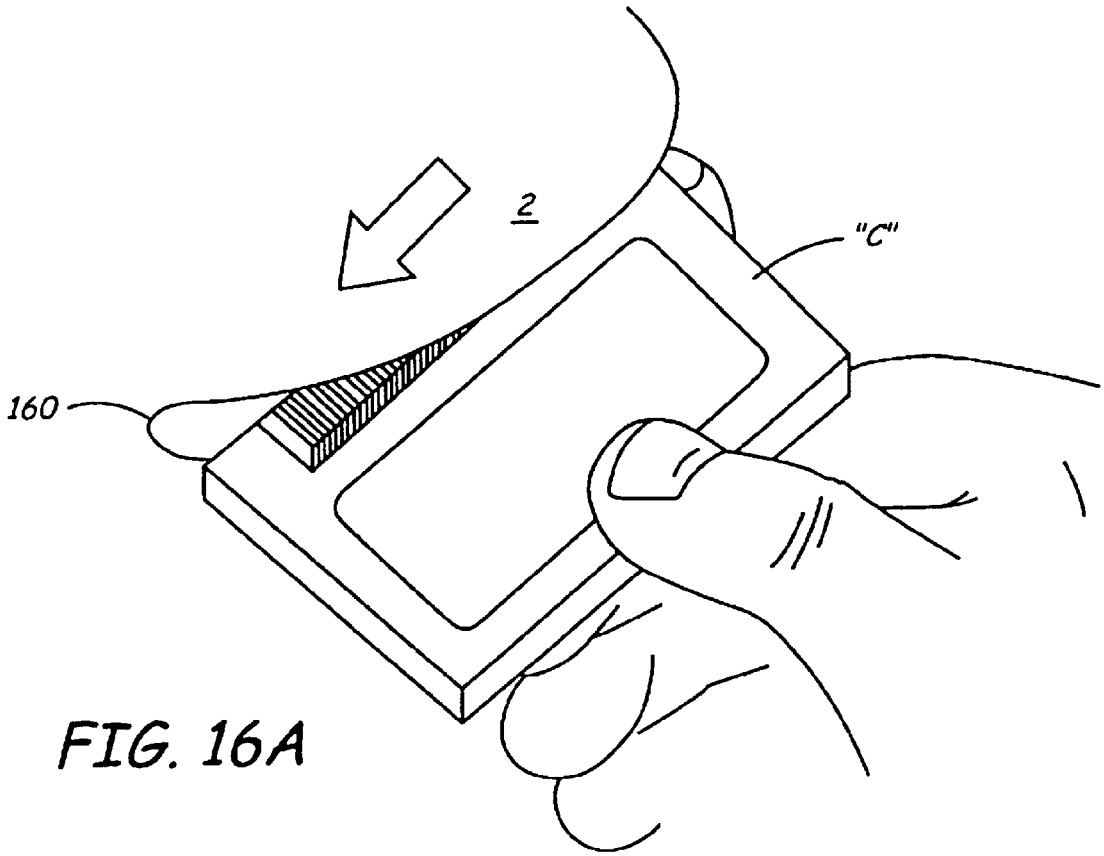
FIGS. 16A and 16B, depict the information carrying swipe card of the present invention and its use.
Figure 16B:
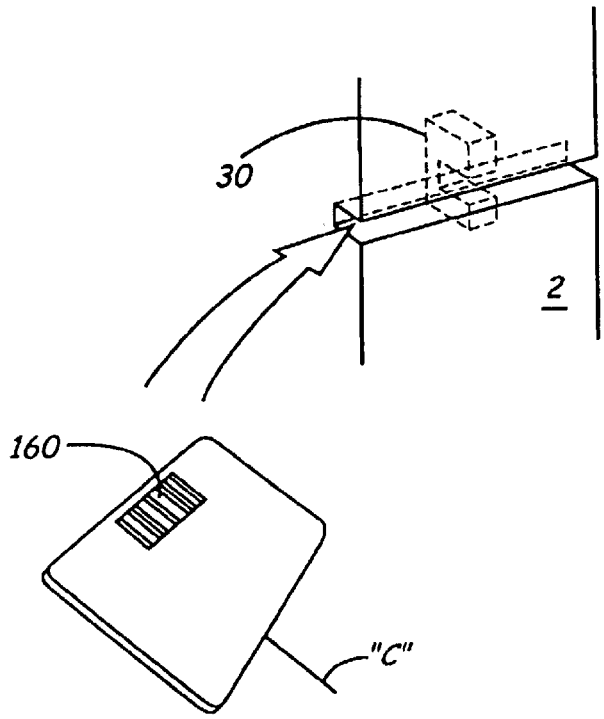

FIG. 16, including FIGS. 16A and 16B, is provided to show an embodiment of the card "C" for use with the present invention and how it may be "swiped" or moved through an amusement device 2 of the present invention. In one embodiment, the cards "C" carry a bar code or bar codes 160, and will be swiped through the amusement devices 2 in a generally horizontal motion. The bar codes 160 may be printed on either side of the cards "C."

Figure 17:
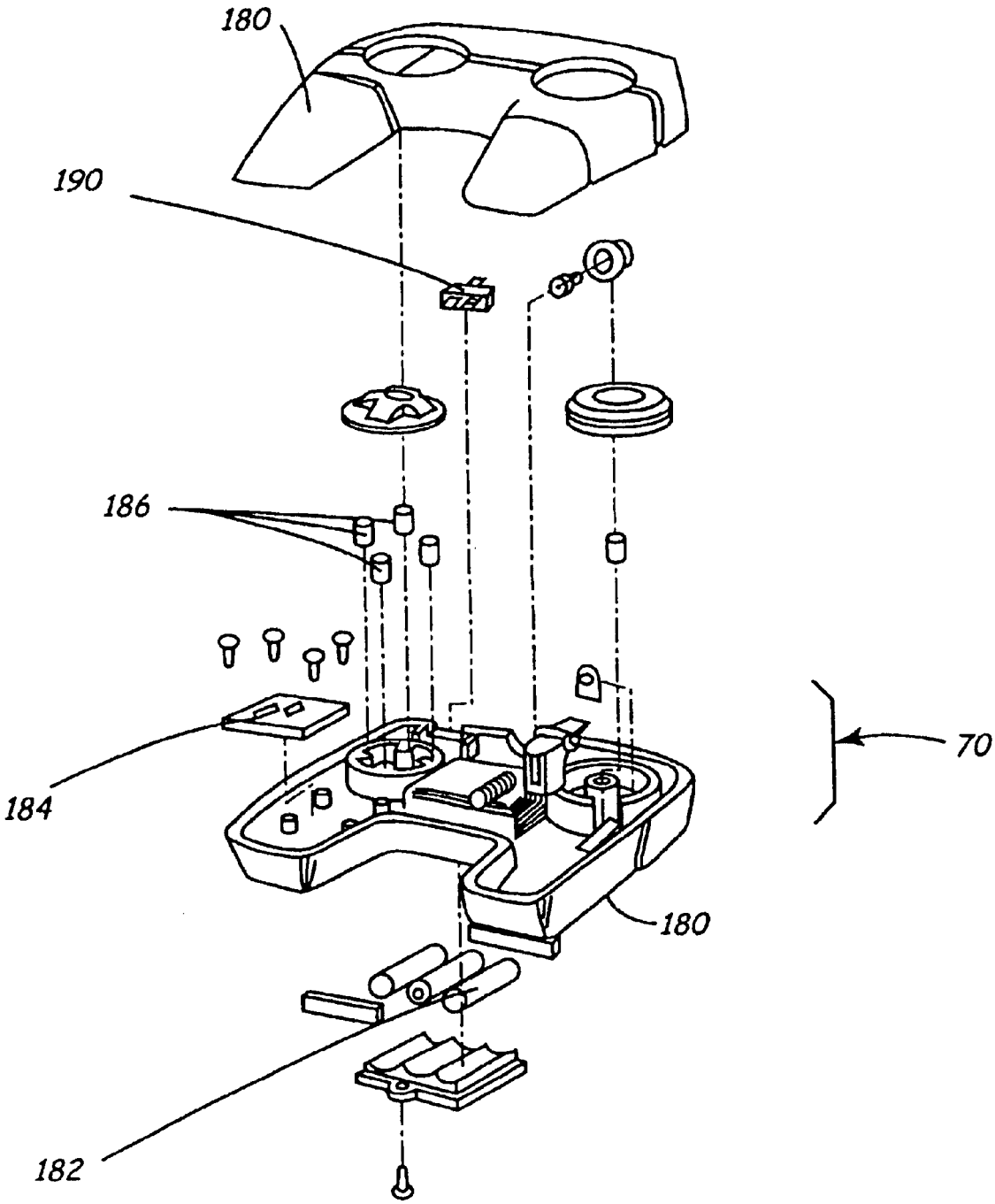
FIG. 17 is an exploded assembly view of one embodiment of a wireless remote control and communication device for use with the present invention.
Figure 18:
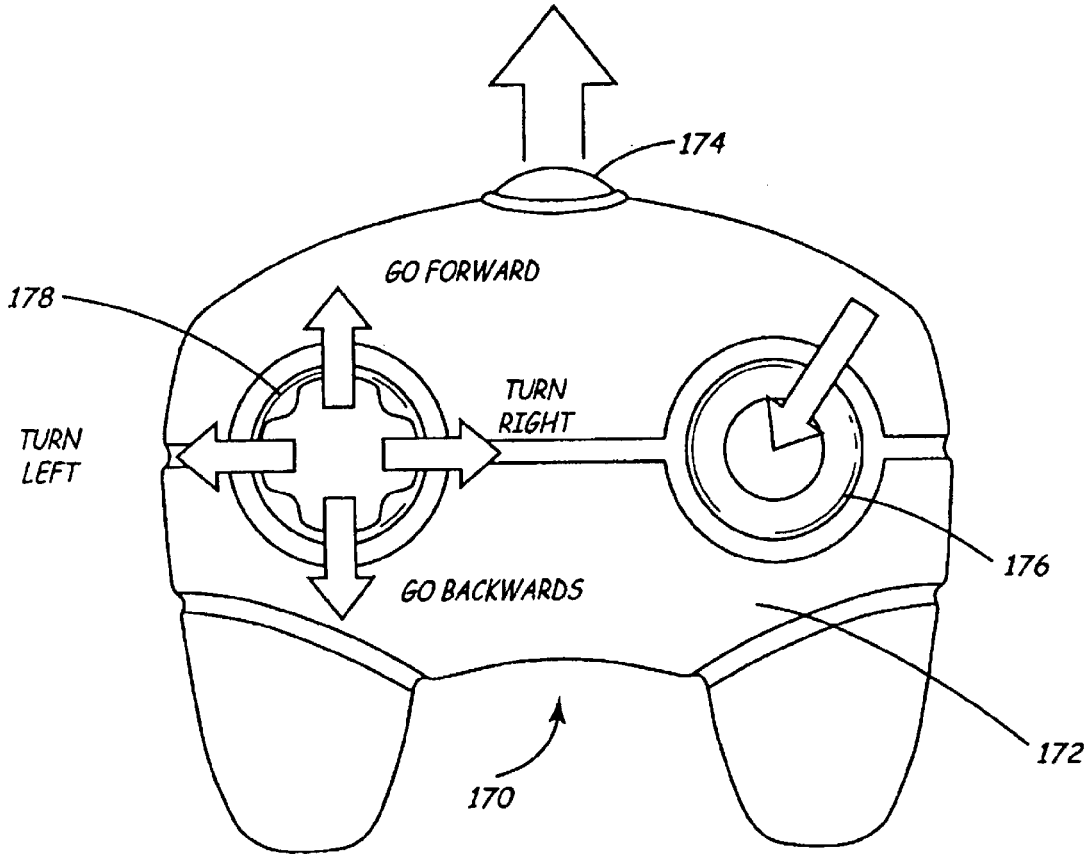
FIG. 18 depicts at least some of the functions of the remote control device depicted in FIG. 17.

FIGS. 17 and 18 depict an embodiment of a suitable wireless remote control communication device 170 for use with any of the embodiments of the present invention. Referring first to FIG. 18, the remote has a body 172, an IR transmitter 174 housed behind a clear dome and two control buttons, a hand-to-hand action button 176 and a joy-stick type movement button 178. Referring to FIG. 17, the remote is formed of two housing shells 180 and contains a suitable power source such as batteries 182. The housings also contain a PCB/IC microprocessor complex 184 and a suitable number of switches 186 associated with the control buttons 176, 178 for controlling or directing amusement device functions. Additional control buttons and/or switches may be provided as necessary or desired for example, a communication mode, channel or frequency switch may be provided. Also, see Appendix A for exemplary remote 170 operational flows, functions, etc.

Figure 19A:
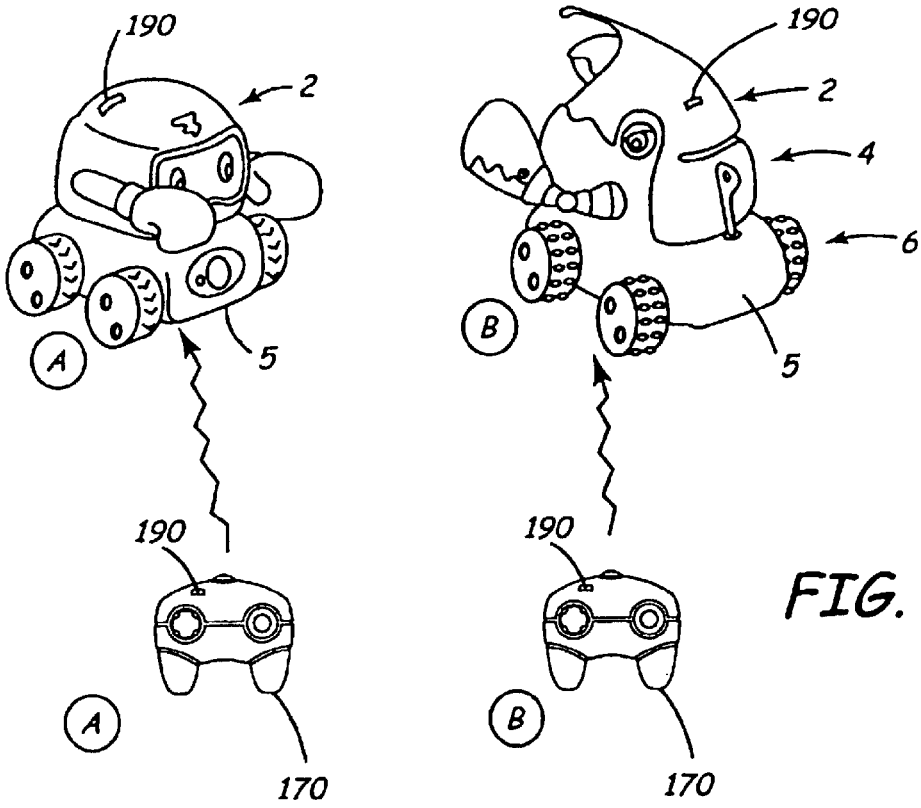
FIG. 19, including FIGS. 19A and 19B, disclose the use and/or interactivity of the remote control device and the amusement devices of the present invention.
Figure 19B:
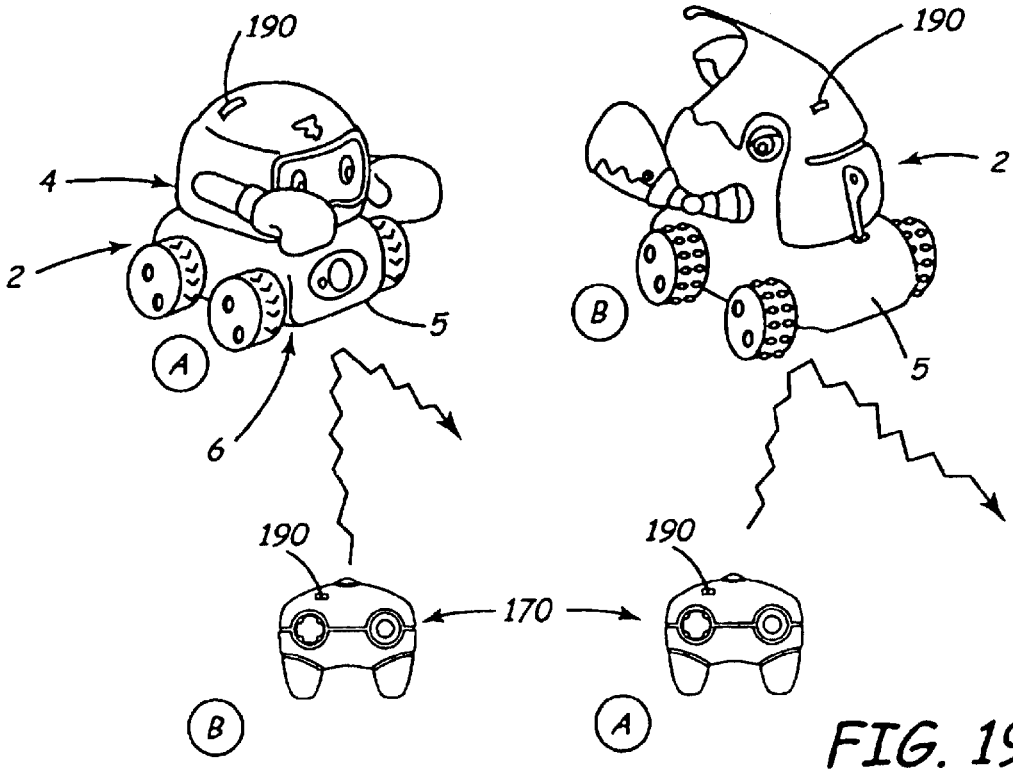

FIGS. 19A and B depict the robotic amusement device 2/wireless transmitter/receiver 170 interaction of the present invention. This interaction is in conjunction with a frequency setting switch 190 carried by each amusement device 2 and the controller 120. In use, an individual user's controller 120 and robot 2 are set on the same frequency so that both robots 2 are not controlled by a single remote 120. If the opposite frequencies are set, then the robots 2 may ignore the settings.

Figure 20:
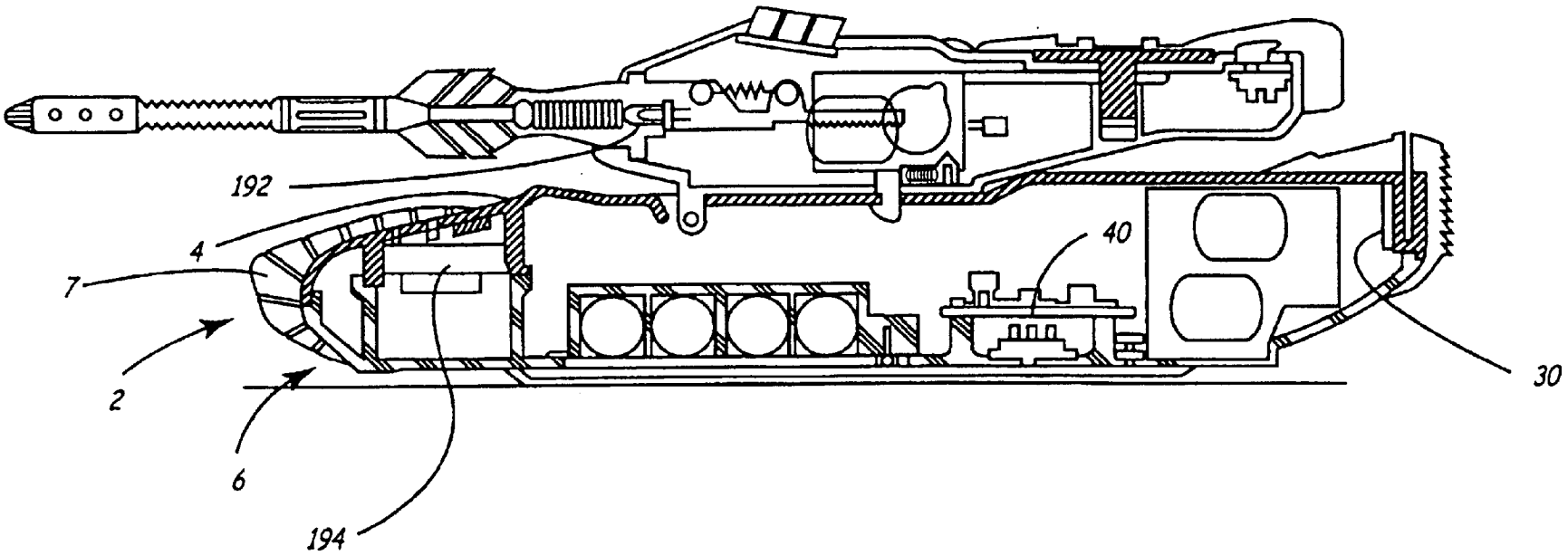
FIG. 20 depicts another embodiment of the amusement device of the present invention with portions in section and portions broken away for clarity.

FIG. 20 depicts another land vehicle embodiment of the amusement device 2 of the present invention. In particular, the embodiment depicted in FIG. 20 comprises a tank 2. As in all the embodiments, the tank 2 includes a body 4 and a base 5 with a transport element 7 (tracks). This embodiment carries a PCB/IC microprocessor complex 40 and an optical swipe card reader 30. Suitable gear boxes, motors, switches may be provided, along with display features such as LED 192 and speaker 194. As with any of the embodiments of the present invention, suitably shaped armor and/or shields may be used with the embodiment depicted in FIG. 20.

Figure 21:
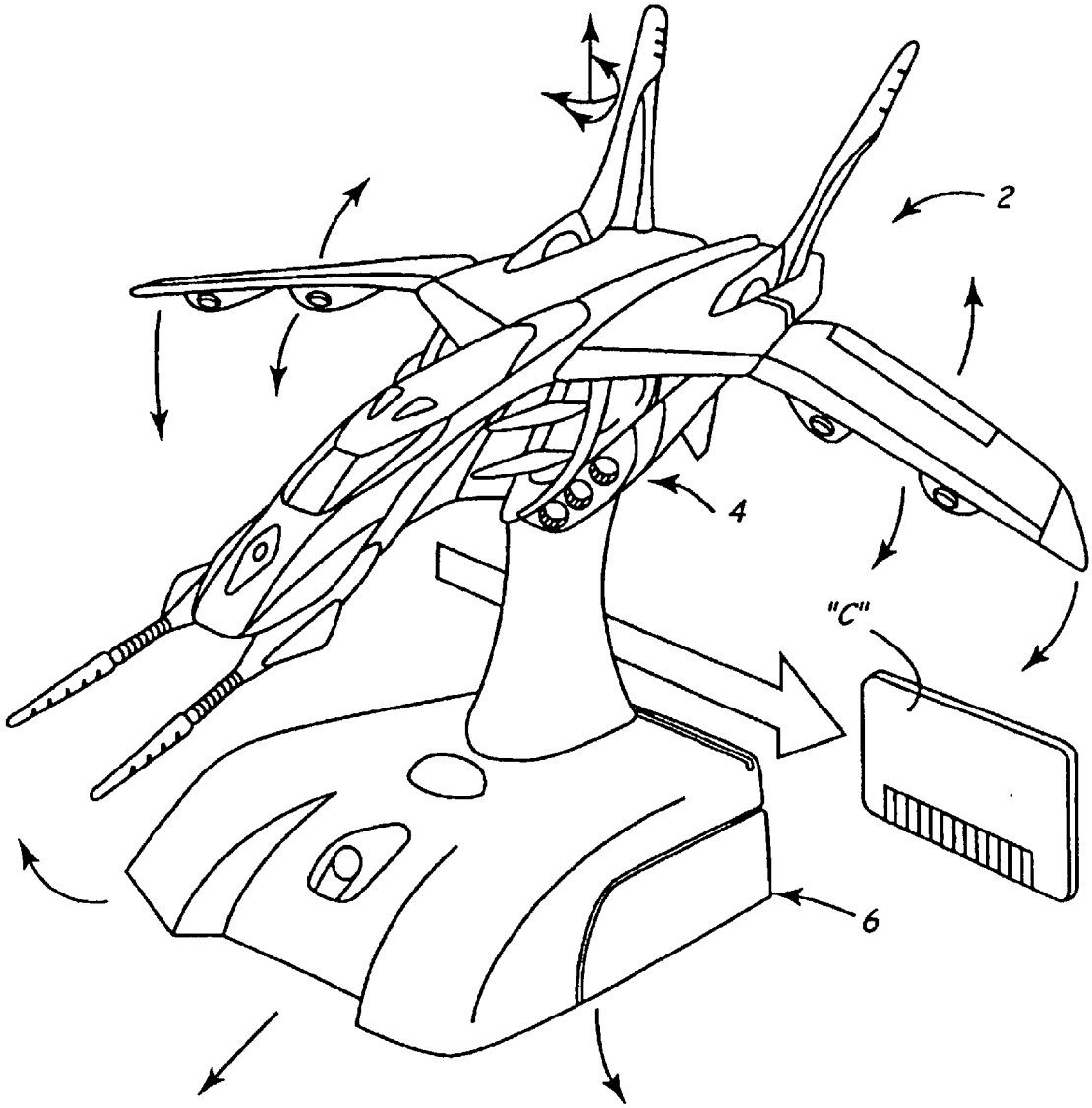
FIG. 21 depicts another embodiment of the amusement device of the present invention.
Figure 22:
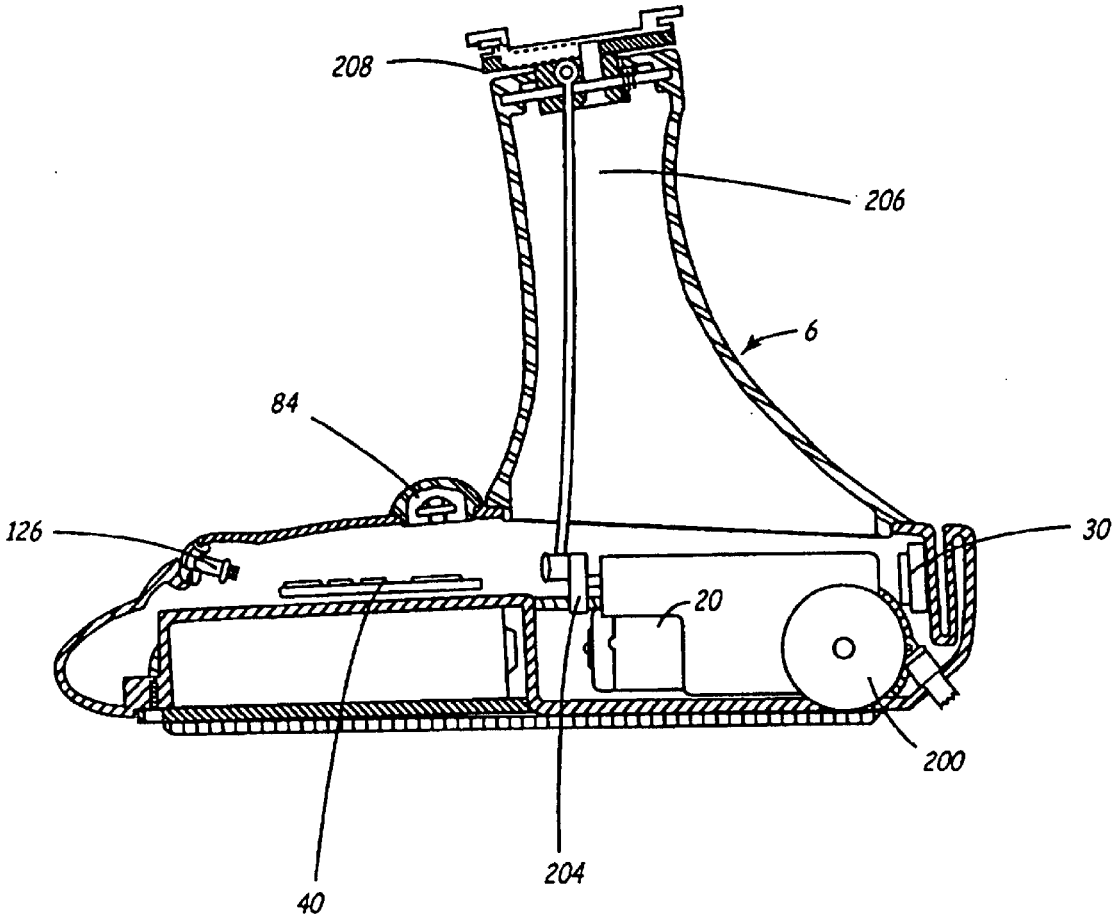
FIG. 22 depicts the base for use with the embodiment of the invention depicted in FIG. 21, with portions in section and broken away.

FIGS. 21 and 22 depict an air vehicle or aircraft embodiment 2 of the present invention. Again the amusement device 2 comprises a base 5 and a body 4. In this instance the body 4 takes the shape of an aircraft. The base 5 is provided with drive wheels 200 and a power source such as motor 20. Additionally, the base is provided with pivot gears 204 for creating movement of the aircraft 4 when it is mounted on the base 5 as depicted in FIG. 21. The base 5 includes the scanner 30 for reading cards "C." The base 5 also includes the microprocessor complex 40 and suitable infrared wireless transmitters and receivers such as IR receiver 84 and IR emitter 126. Upon command, the base 5 may move to the right and left, and forward and backward by virtue of its drive wheels 200, and the pivot gear 204 and cables 206 allow the amusement device body 4 to bank and/or change its attitude or angle relative to the base 5. This is accomplished, in part, by providing a pivot connector 208 at the top of the base 5.

Figure 23:
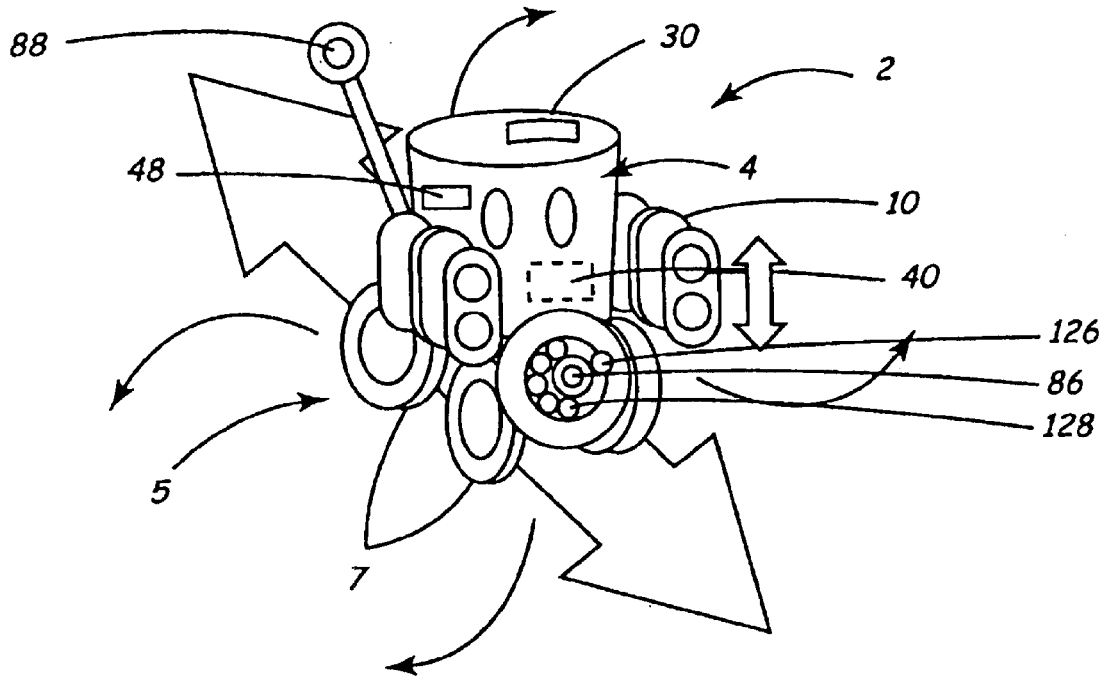
FIG. 23 is a representation of embodiments of the amusement devices of the present invention including arrows depicting the mobility of the embodiments.

FIG. 23 is a representation of the embodiments of the amusement devices 2 in accordance with the present invention, and is provided to represent the movements enabled by the invention. The device 2 has a body 4 and a base 5 with transport capability, e.g., wheels 7. Arms 10 may be provided for making physical action, e.g., a punch. An IR emitter 126 is provided for making an "attack" or other signal, an iris 86 is provided for "defense" (to cover or partially expose an IR receiver 84, and LED's 128 provide a "live or dead" indicator. A "kill" switch 88 may be provided as a target for other devices 2, and a tip-over, gravometric switch 48 may be provided. The device(s) 2 are provided with a card reader 30, and an on-board microprocessor complex 40 (depicted in phantom). As shown by the arrows, movement across a surface, apparently of its own volition, may occur in indicated directions. Also, see Appendices B and C for further exemplary device 2 operational flows, functions, behavior modifications, etc.

Figure 29:
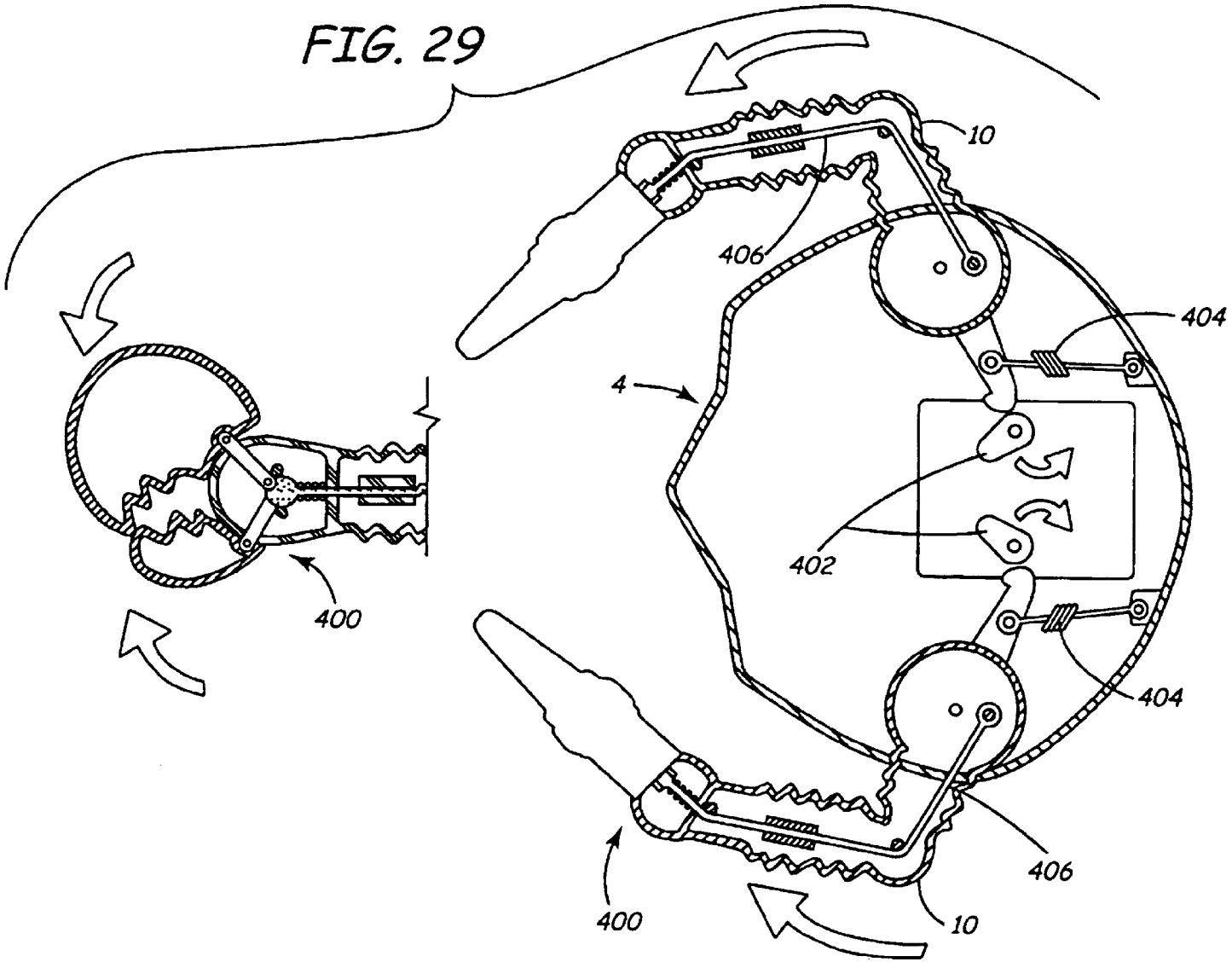
FIG. 29 is a plan section depicting the functional aspects of one embodiment of the present invention.
Figure 30:
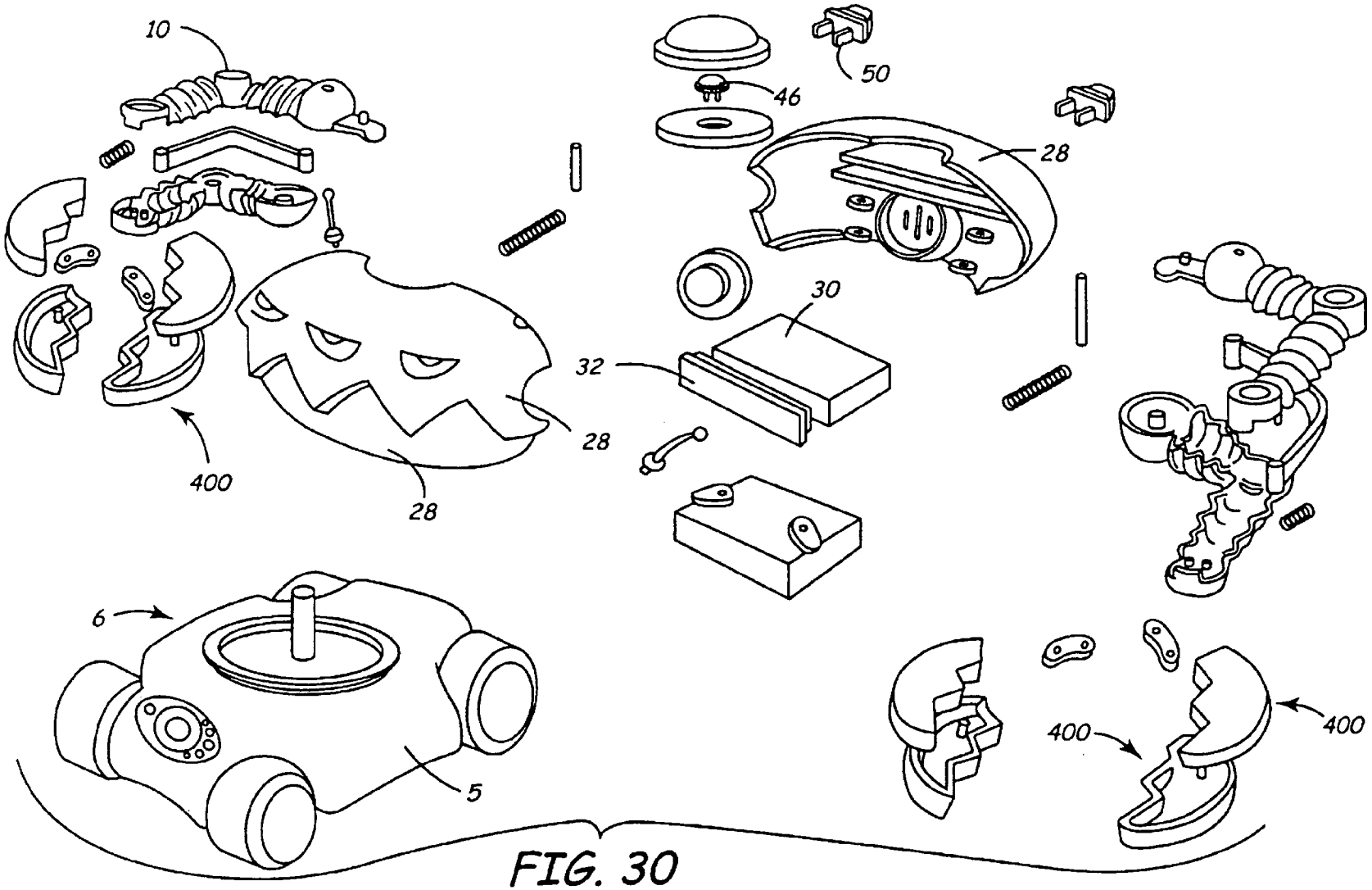
FIG. 30 is an exploded assembly view of another embodiment of the present invention.

FIGS. 29 and 30 depict another embodiment of the present invention, one which includes another exemplary arm and weapon variation, i.e., claws 400. FIG. 30 depicts that this embodiments has a number of features in common with other embodiments, e.g., base, body, IR system, switches and card reader 30; such are commonly numbered. FIG. 29 depicts the operation of the claws 400. They are spring-loaded so that as the cams 402 turn, the arms slip off, the springs 404 making the arms move forward. As they do, the pull arm 406 becomes taut, pulling the claws 400 closed. The claws open as the arms move back.

Figure 31:
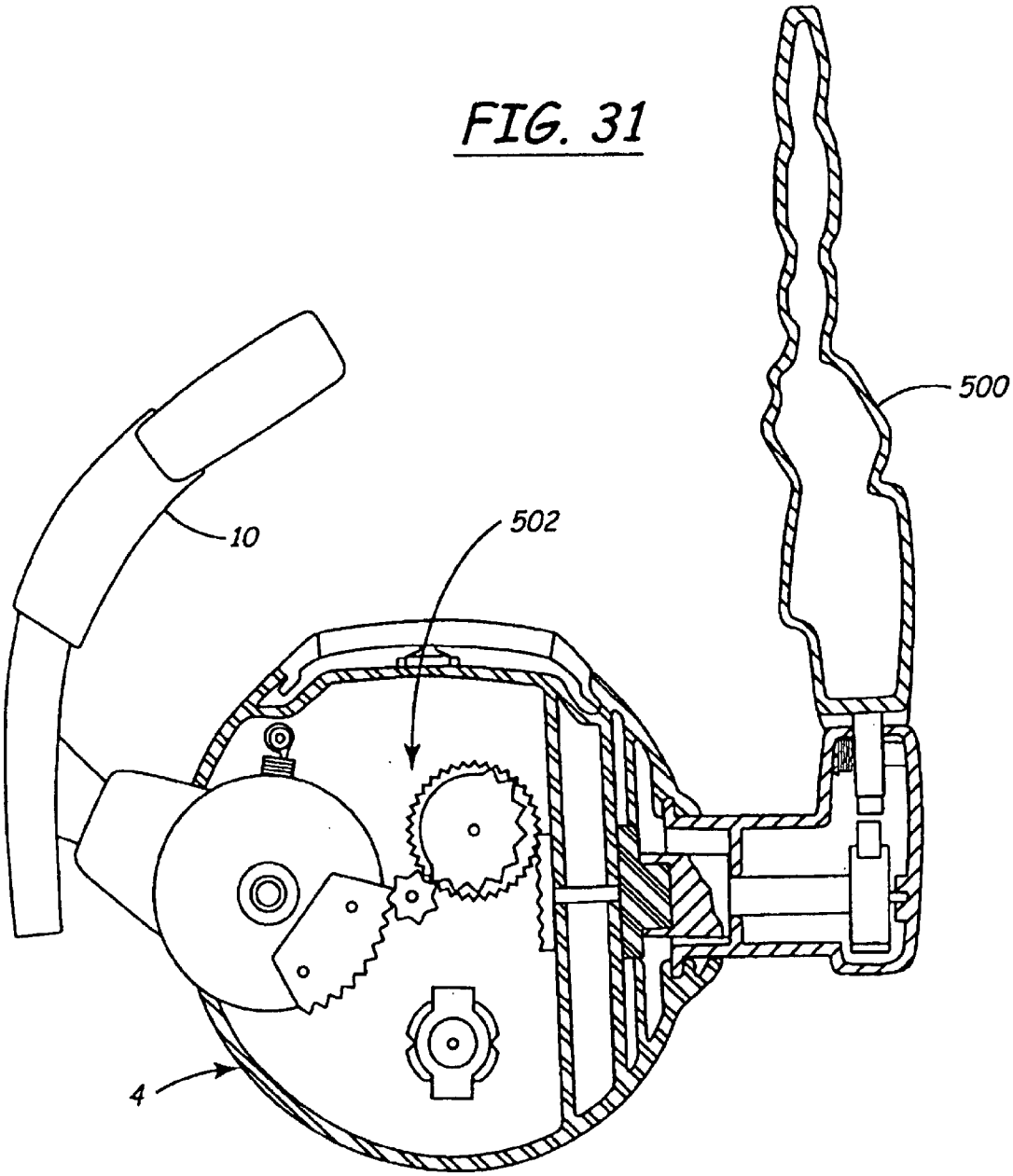
FIG. 31 is a plan view, partially in section, depicting another embodiment of the present invention.
Figure 32:
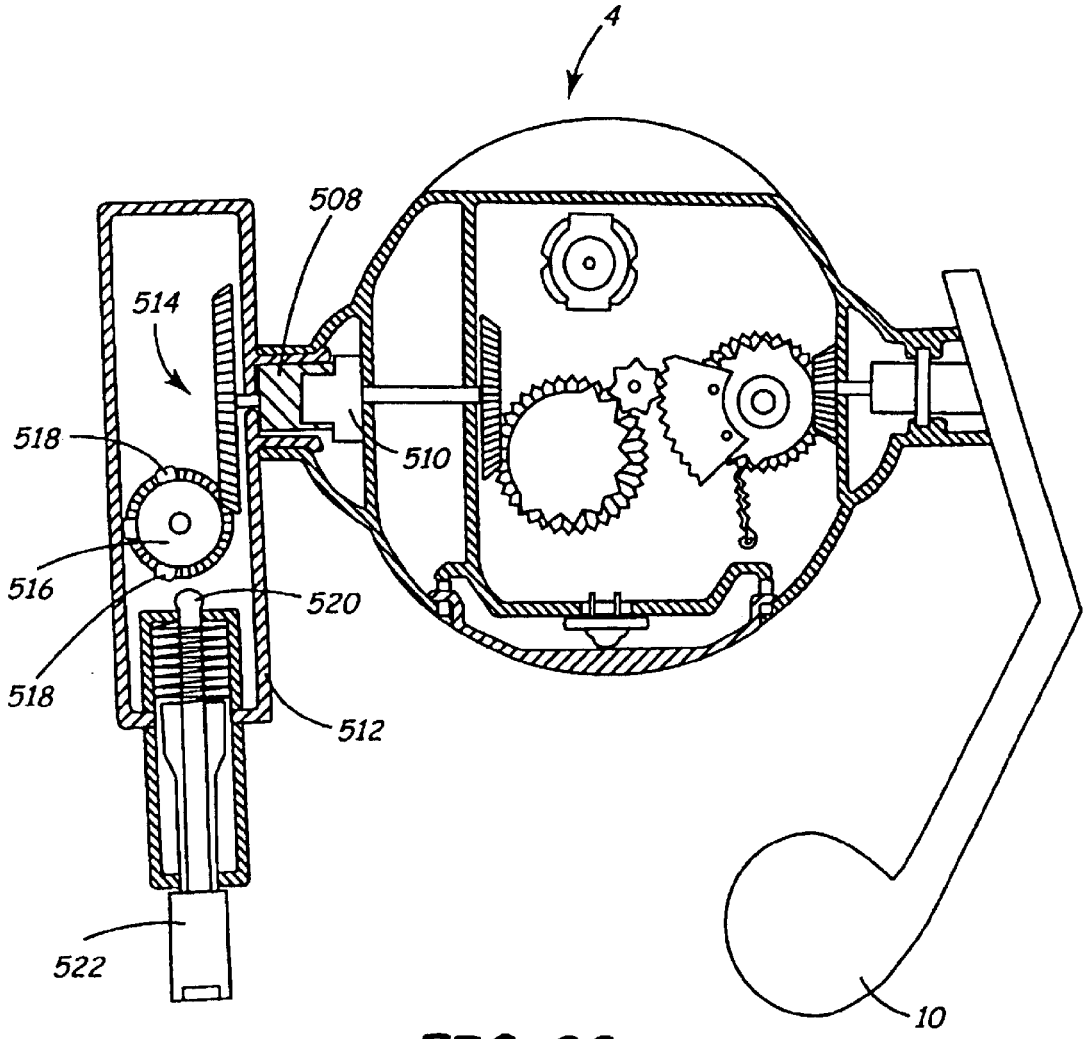
FIG. 32 is a plan view, partially in section, depicting another embodiment of the present invention.
Figure 33:
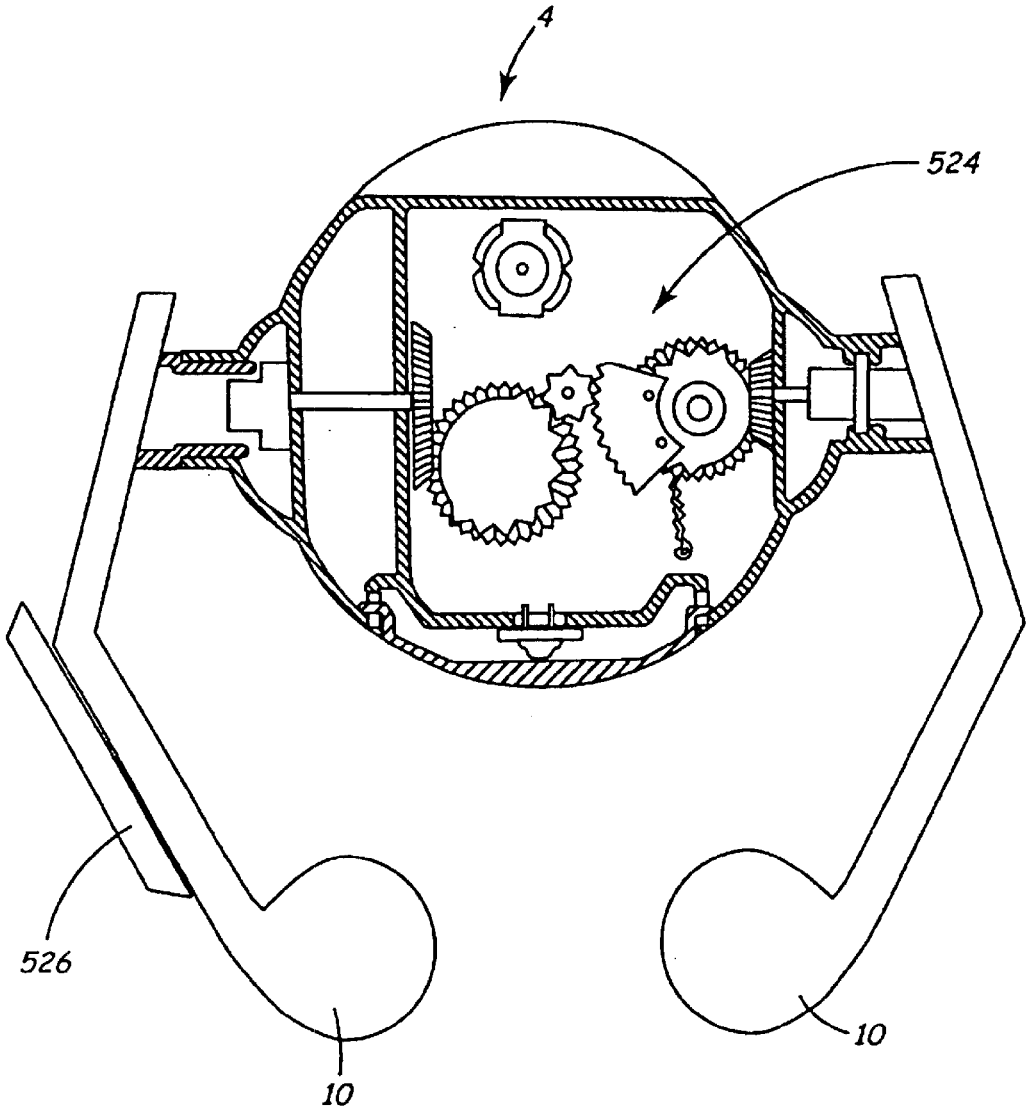
FIG. 33 is a plan view, partially in section, depicting another embodiment of the present invention.
Figure 34:
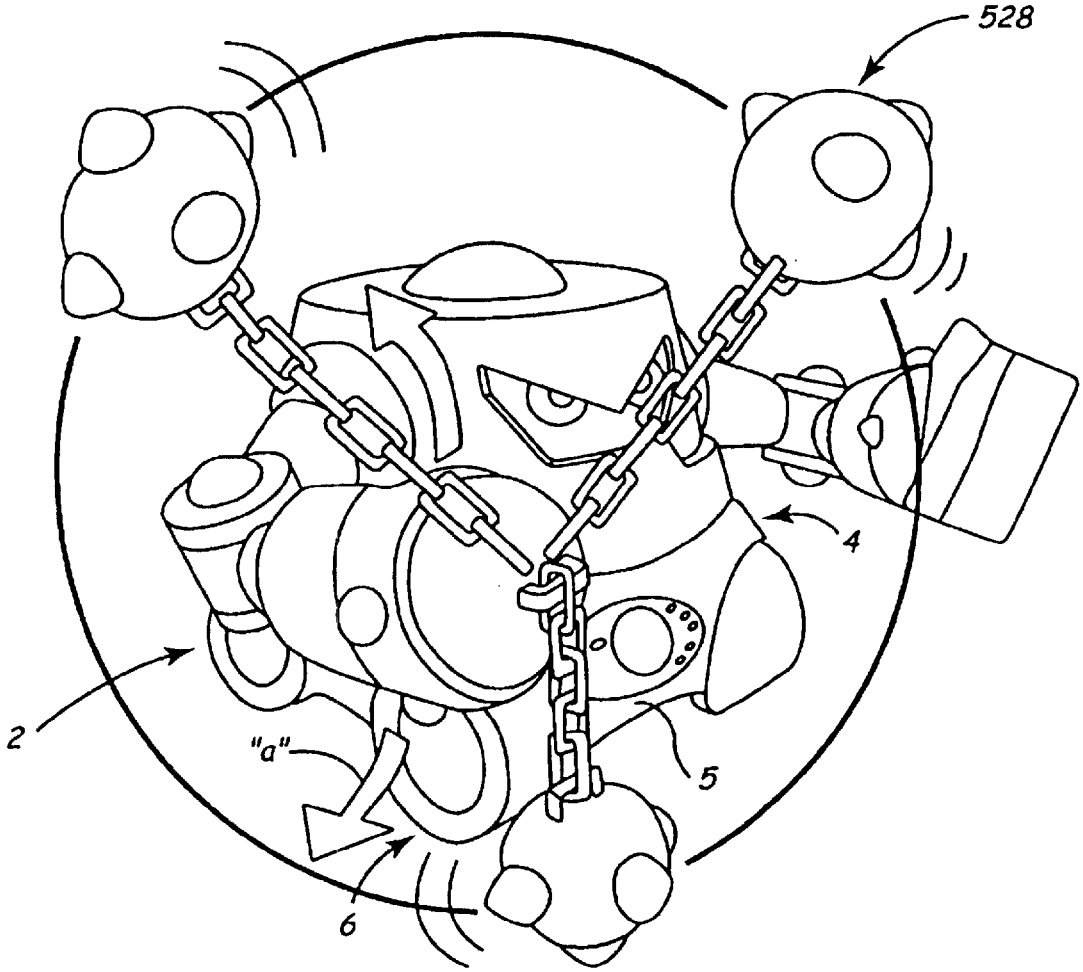
FIG. 34 is a perspective depicting one operation of an embodiment of the present invention.

FIGS. 31–34 depict further exemplary variations and embodiments of the present invention. FIG. 31 depicts a removable weapon arm 500 and how it (and other such arms or weapons) is operably coupled to the body and an arm drive mechanism 502. The arm 500 is spring loaded by a spring 504 for returning it to a rest position, and is linked to the drive 502 by a steel axle 506 and a keyed hub gear 508 which receives a bushing 510 operably carried in the body. In FIG. 32 a similar arrangement is used to power a launcher 512. The launcher 512 is functionally joined to the body by a hub gear 508 and bushing 510. A pair of face gears 514 operably connect to a trigger drum 516 carrying a number of triggers 518 designed to hit a spring-loaded trigger 520 to release or launch a missile or other object 522. FIG. 33 depicts another example wherein the left and right arms are driven by suitable gears and cams (indicated generally at 524) carried in the body, and wherein the right arm is removable and carries a shield 526. FIG. 34 depicts an arm carrying a mace-like weapon 528 adapted for being coupled to some of the embodiments of the present invention. As depicted by arrow "a", an up and down movement of the arm generates a generally circular swinging or flailing motion of the mace 528.

In use, when cards "C" have been "swiped" in, the amusement devices 2 will indicate they are ready for a "battle." Once this stage is reached, i.e., programming is "finished," a battle may begin: each person sets a device 2 down and one person switches to one mode on the remote and a device 2, while the other person sets their remote and device to another mode. The devices 2 may be placed about 4 feet apart and will begin their interaction, which may be selectively modified or controlled by the persons at any time.

Figure 24:
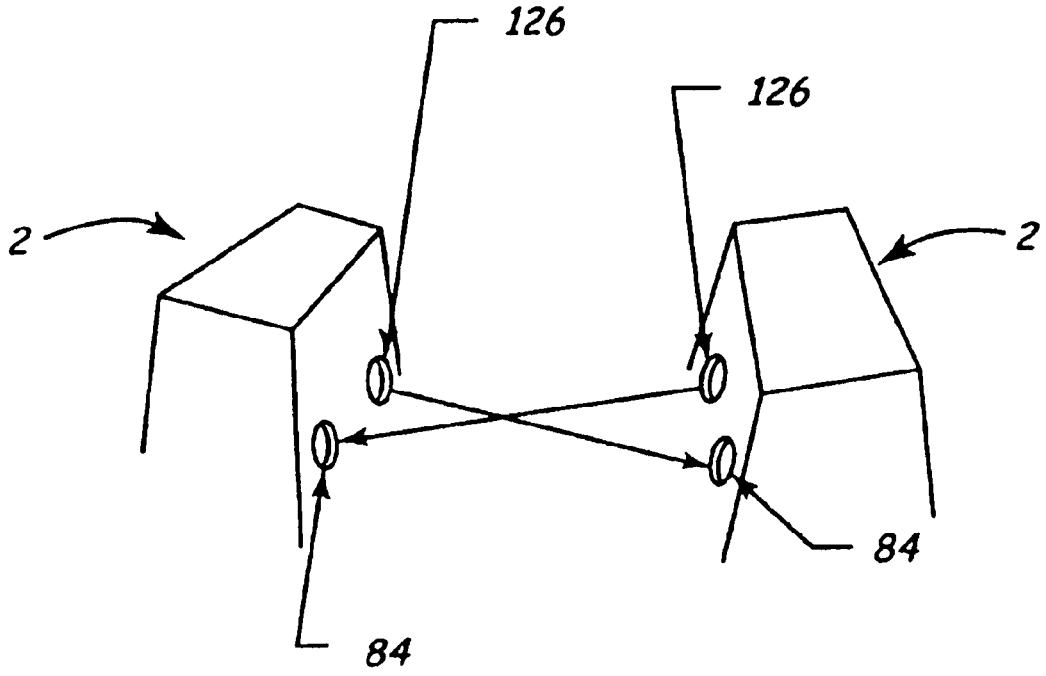
FIG. 24 is a representation of the interactivity of amusement devices in accordance with the present invention.
Figure 27A:
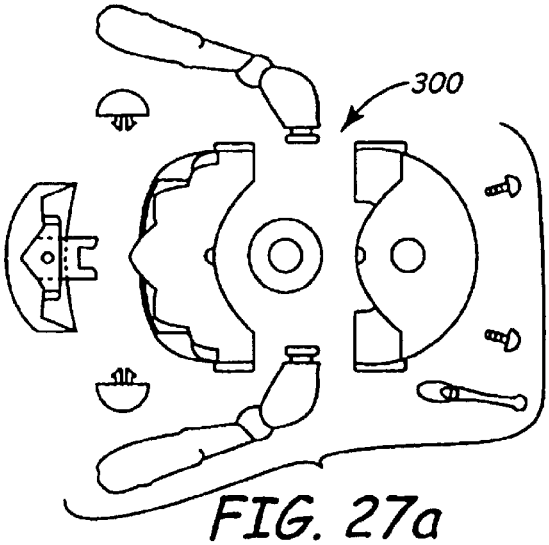
FIGS. 27*a–f*, is a plan view of six exemplary sets of armor for use with embodiments of the present invention.
Figure 27B:
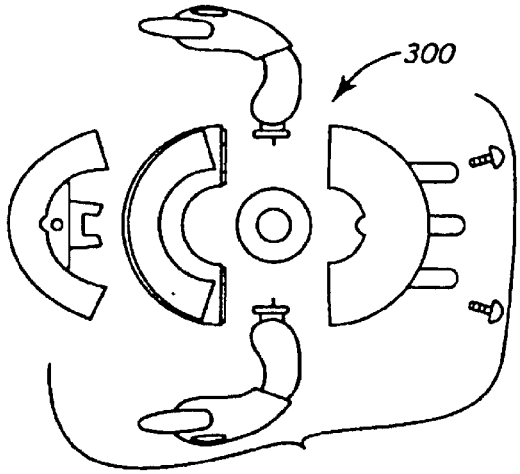
Figure 27C:
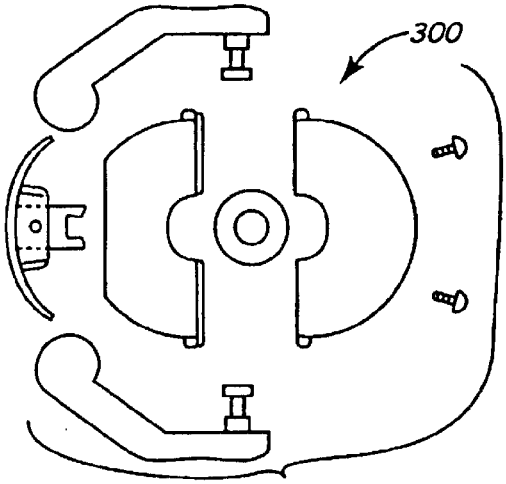
Figure 27D:
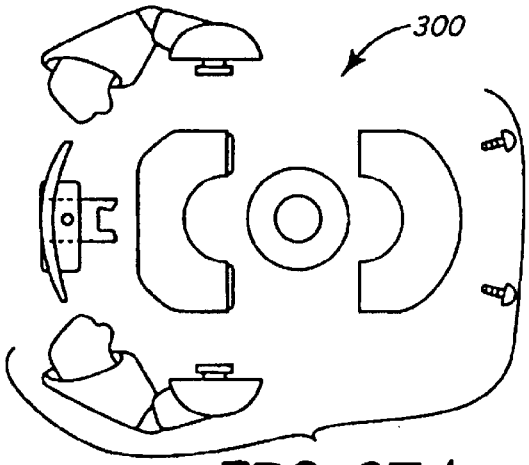
Figure 27E:
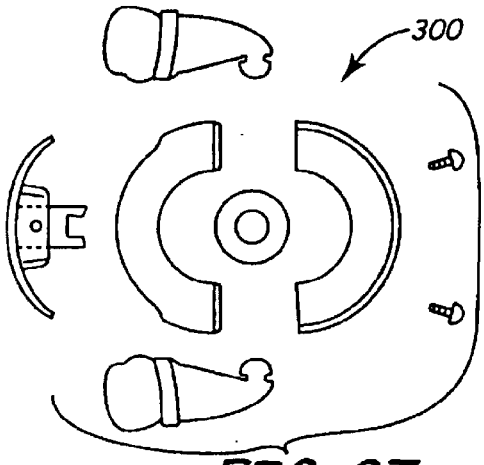
Figure 27F:
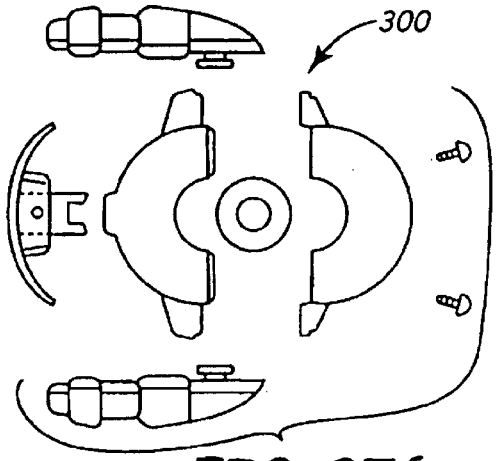

FIG. 24 is provided to represent device 2-to-device 2 interactivity which may be accomplished by suitable wireless communication such as IR communication.

Figure 36:
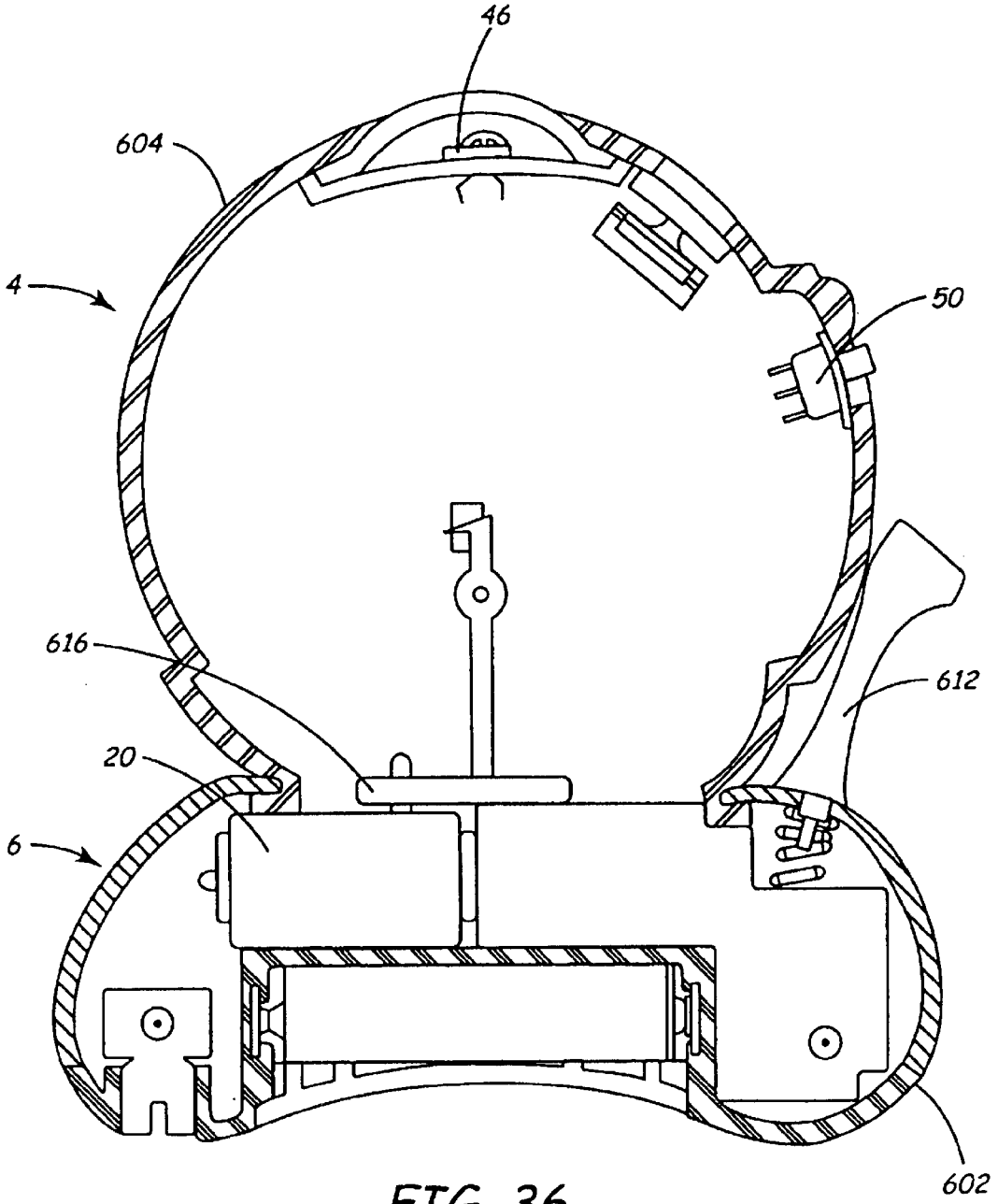
FIG. 36 is an elevation, partially in section, of an embodiment of the present invention.
Figure 37:
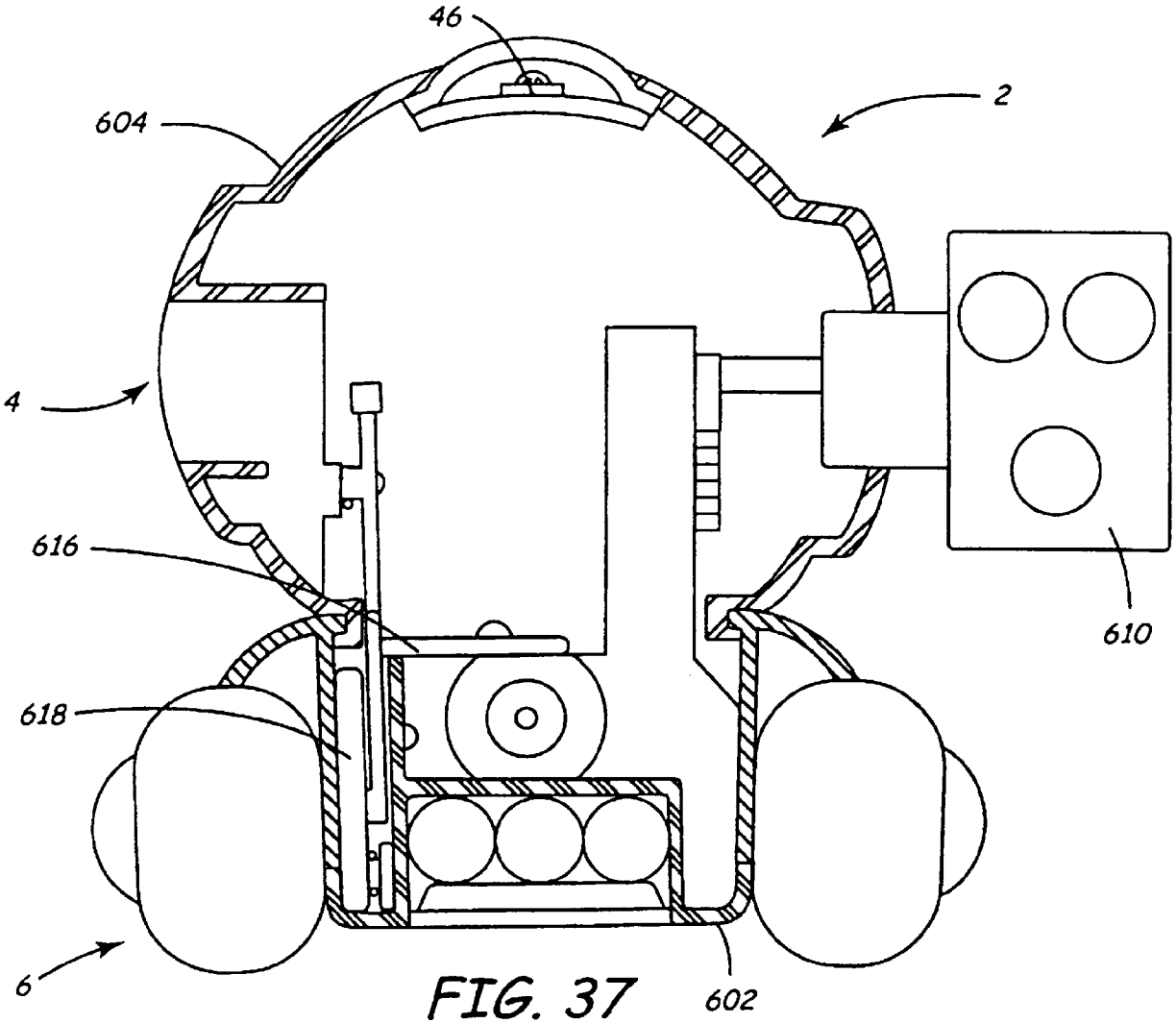
FIG. 37 is an elevation, partially in section, of the embodiment depicted in FIG. 36.

One embodiment of a drone for use with embodiments of the invention is depicted in FIGS. 35*a–c*, 36 and 37. The drone or drones may take any selected form; the depicted appearance is exemplary only. They may be somewhat or generally similar to some of the embodiments of the invention as suggested in FIGS. 35–37 or they may take other forms. They may have some or all of the performance capabilities of other embodiments of the present invention, or they may be relatively limited in the performance, acting in a "soldier," minion or support role. FIG. 35, including FIGS. 35*a–c*, depict a drone 600 with a base 602, a body 604 and arms 606. One of the arms carries a shield 608 and the other may be in the form of a launcher 610 which may be generally similar to the launcher depicted in FIG. 32. FIGS. 35*a–c* depict the "destruction" or "killing" of a drone 600. The drone may be provided with a kill switch 612. With reference to FIGS. 36 and 37, if contacted, the switch 612 actuates the motor 614 and, thus, the reverse cam 616 which first releases the arm, shooting it away from the body, then actuates the kickout 618 which causes the drone to tip over. Note that FIGS. 35–37 suggest that the drones may have some or all of the same or similar features as other embodiments of the present invention, e.g., switches, power source, IR receiver/transmitter, etc.

Figure 38:
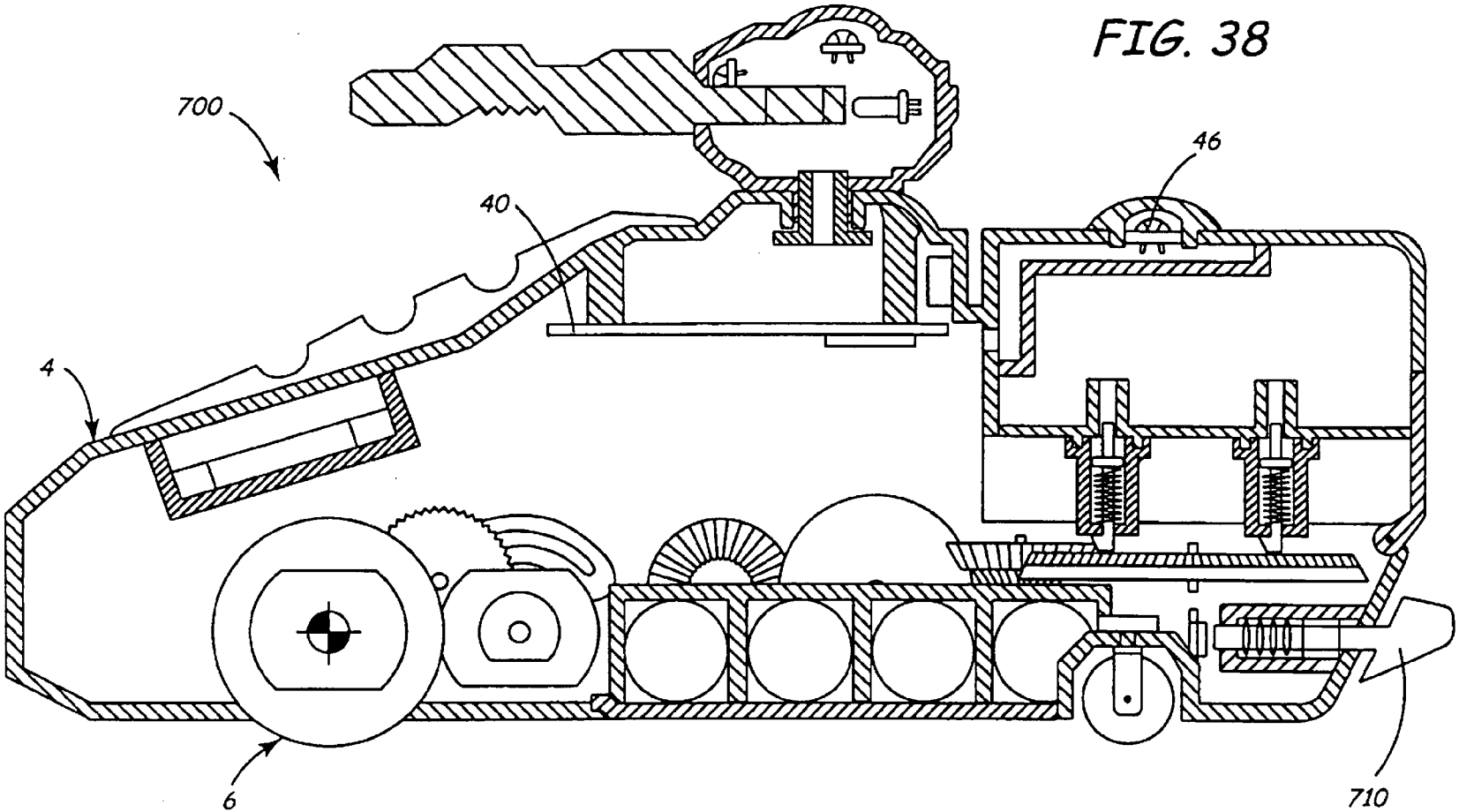
FIG. 38 depicts another embodiment of the robotic amusement devices of the present invention.
Figure 39:
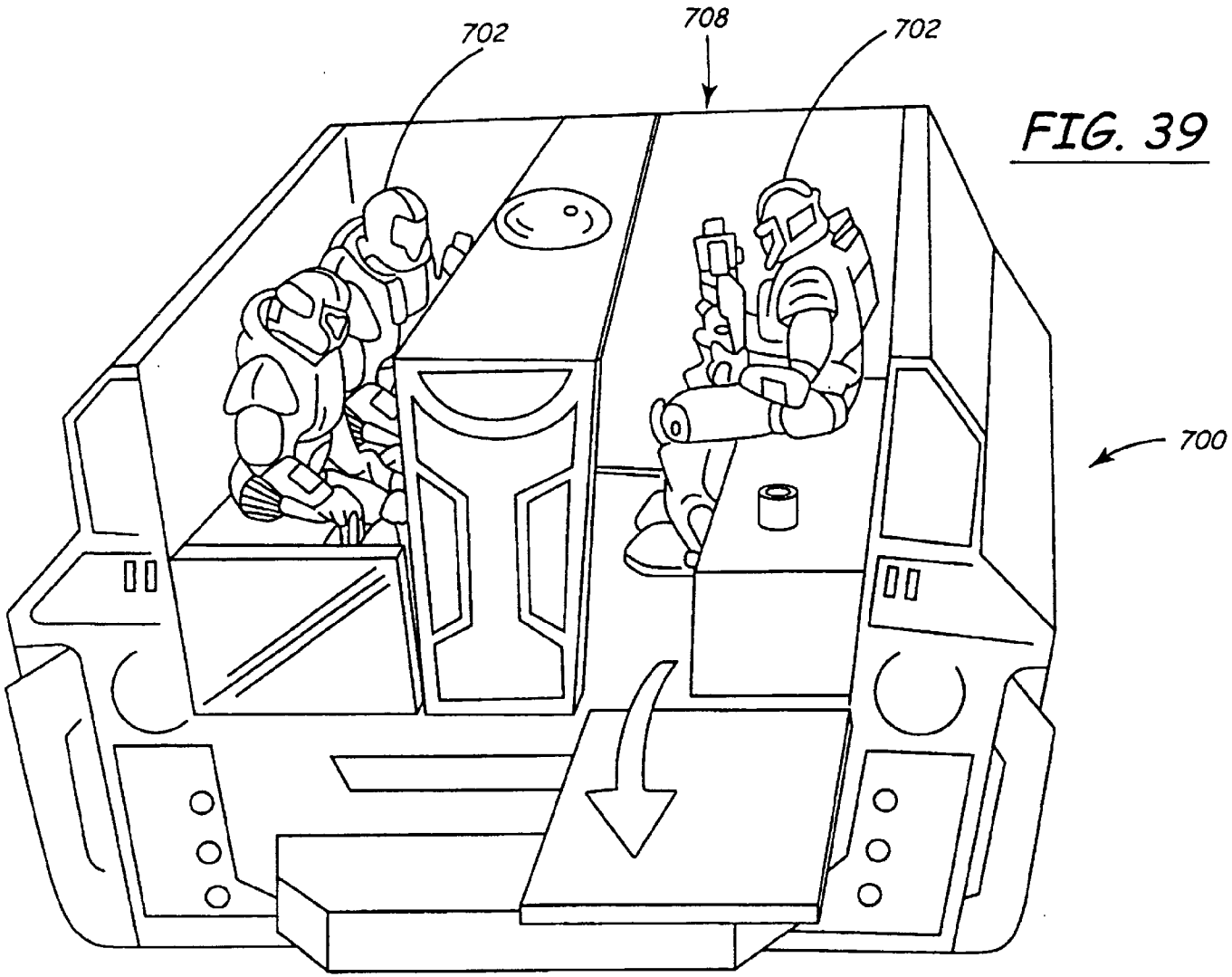
FIG. 39 is a perspective view of the part of the embodiment depicted in FIG. 38.
Figure 40:
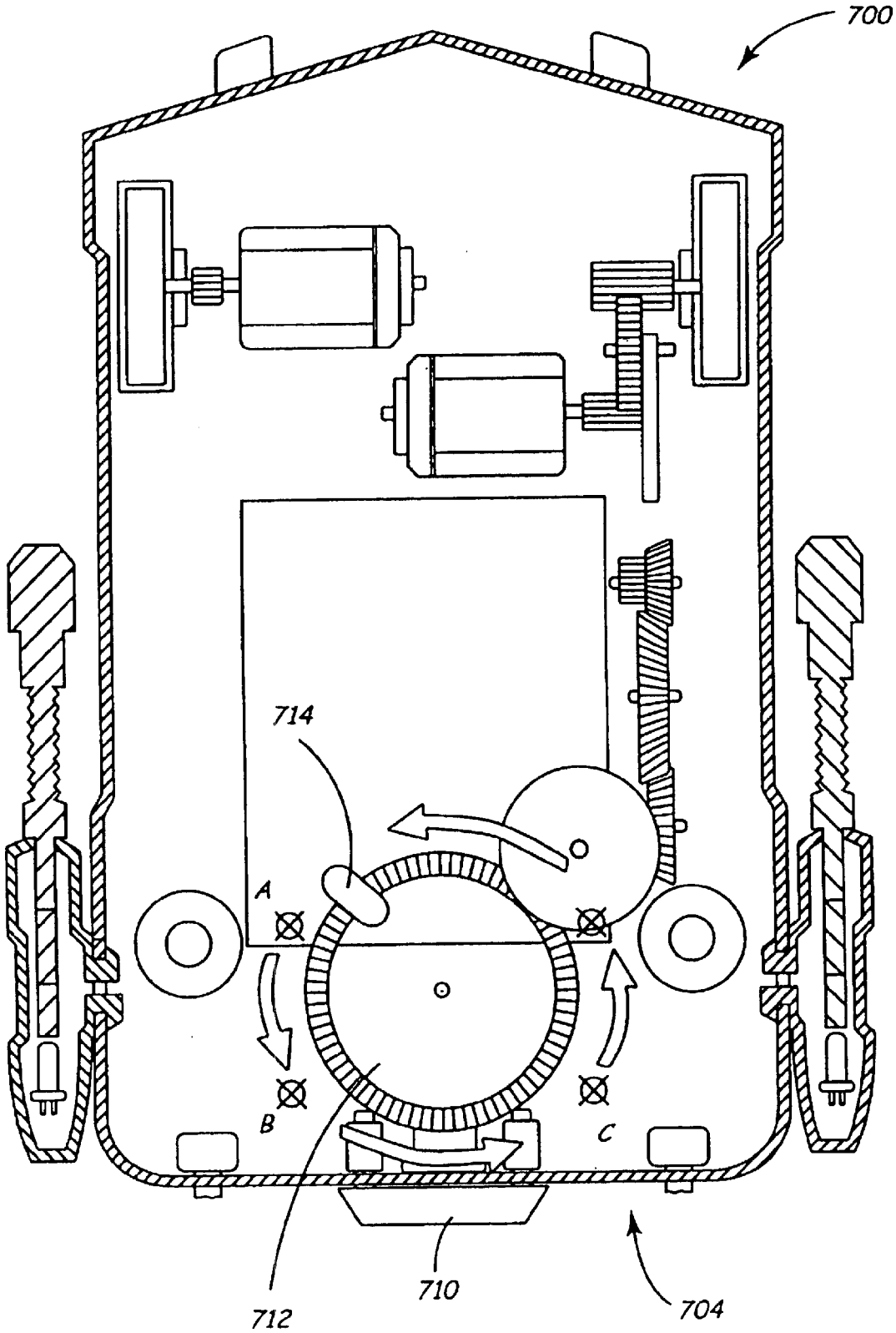
FIG. 40 is a plan view, partially in section, of the embodiment depicted in FIG. 38.

FIGS. 38–41 depict another embodiment of the amusement device of the present invention, in this instance a robotic armored personnel carrier or "ATV" 700. Features in common with other embodiments, e.g., the IR receiver/transmitter arrangement, body, etc are commonly numbered. This embodiment includes a launch system comprising a number of launchers 700, objects 702 to be launched and a mechanism 704 (see FIG. 40) for actuating or powering a launch or launches. Referring to FIG. 39, in one embodiment, the objects 702 to be launched comprise a number of soldiers or troopers 702 which may be positioned in the transport bay 708 of the ATV 700. FIG. 40 depicts the mechanism 704 for launching objects 702. The launch mechanism might be thought of as a damage assessment measure or scorer, i.e., the soldiers 702 will be thrown or launched when the ATV is "damaged" by a "shot" (e.g., an IR signal) from another amusement device or the user or by contact with another amusement device contacting the damage plate 710 (FIG. 38). Referring to FIGS. 40 and 41*a*, the mechanism 704 comprises a gear-driven cam 712 carrying a tab 714. Referring to FIGS. 41*b–d*, the objects (troopers) 702 to be launched are seated onto spring-loaded launchers 716 whereby a pin 718 in the trooper pushes the launcher trigger 720 out the bottom of the launcher 716 to lock it (FIG. 41*c*). As the cam 712 rotates, the tab 714 pushes the trigger 720 free, releasing the spring 72 to strongly urge the trooper 702 from the ATV 700.

Figure 42:
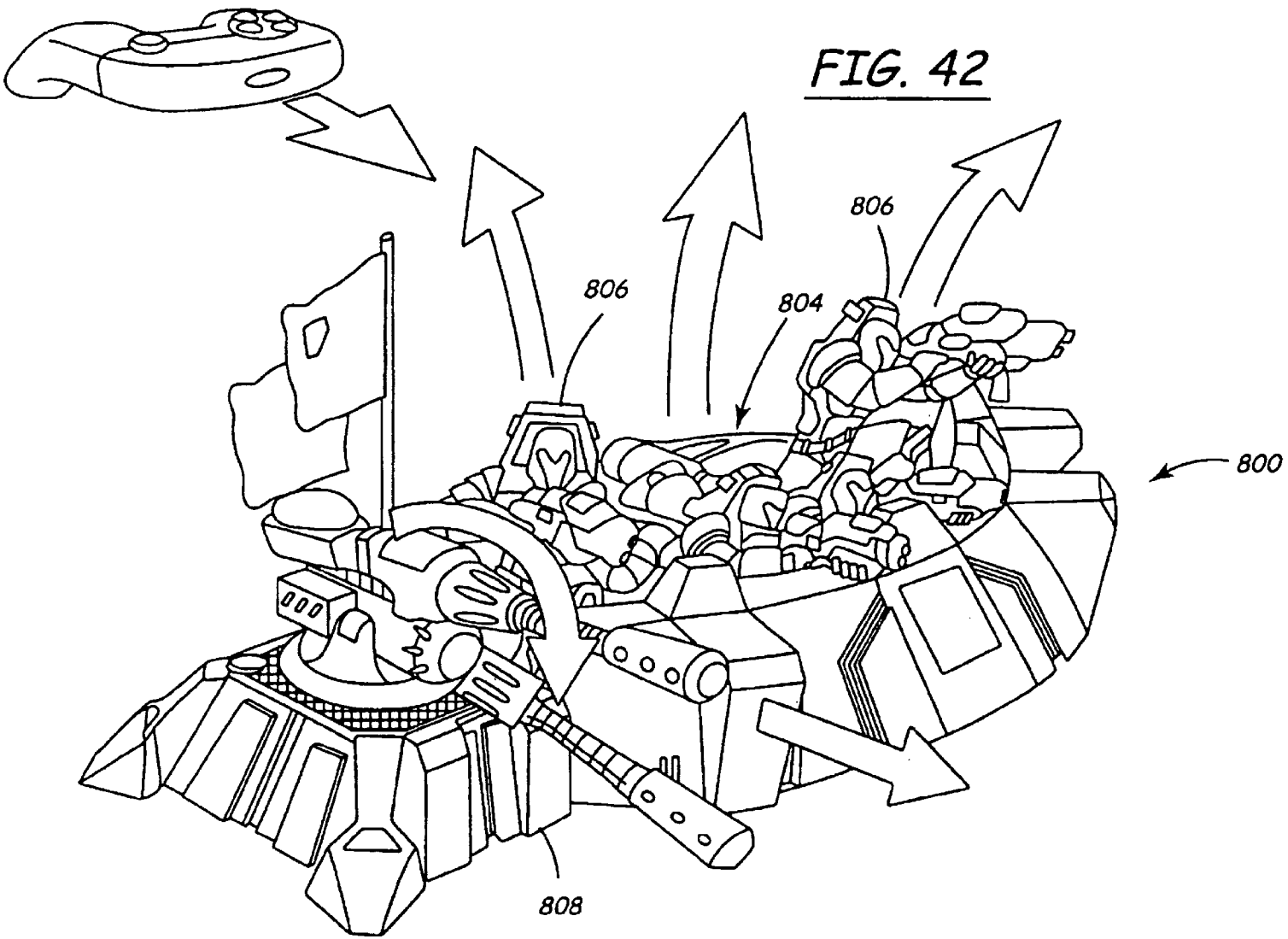
FIG. 42 depicts another embodiment of the robotic amusement devices of the present invention.
Figure 43:
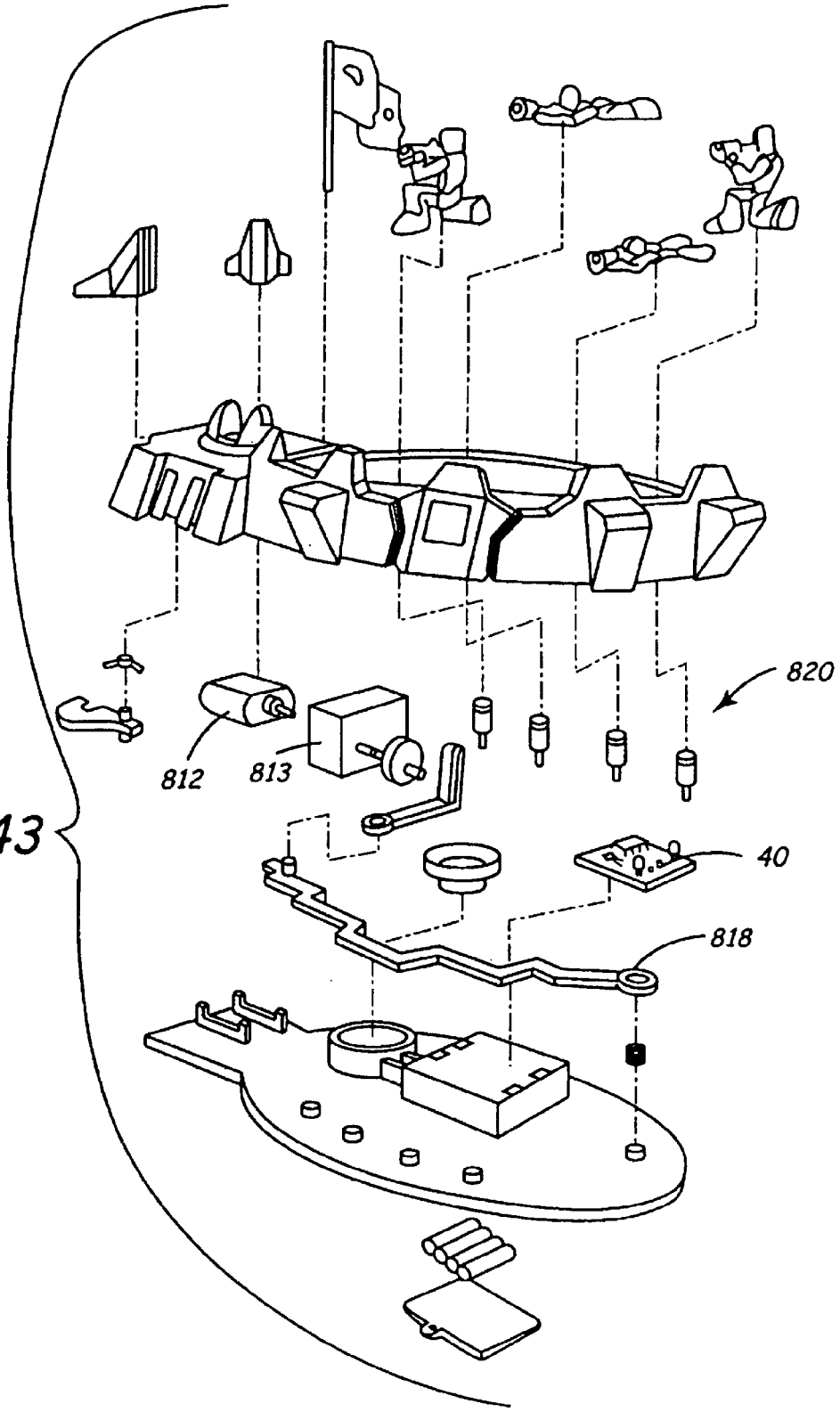
FIG. 43 is an exploded assembly view of the embodiment depicted in FIG. 42.
Figure 44A:
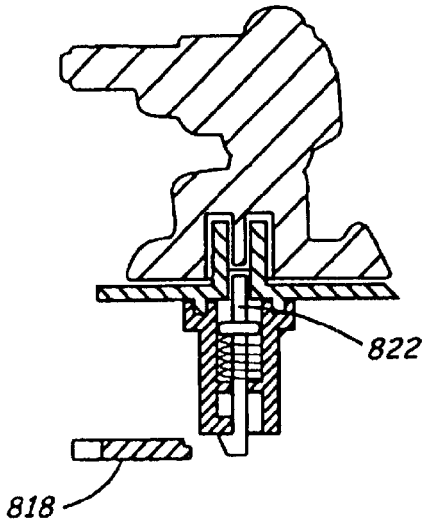
FIGS. 44*a–c*, depicts details of the embodiment depicted in FIG. 42, including one operation thereof.
Figure 44B:
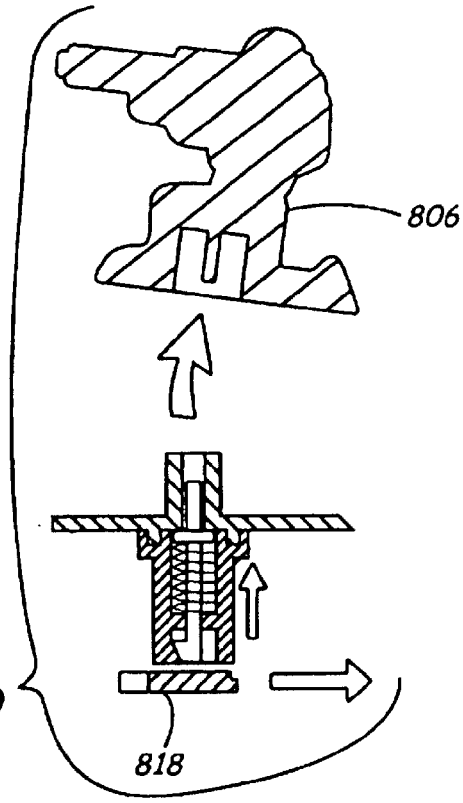
Figure 44C:
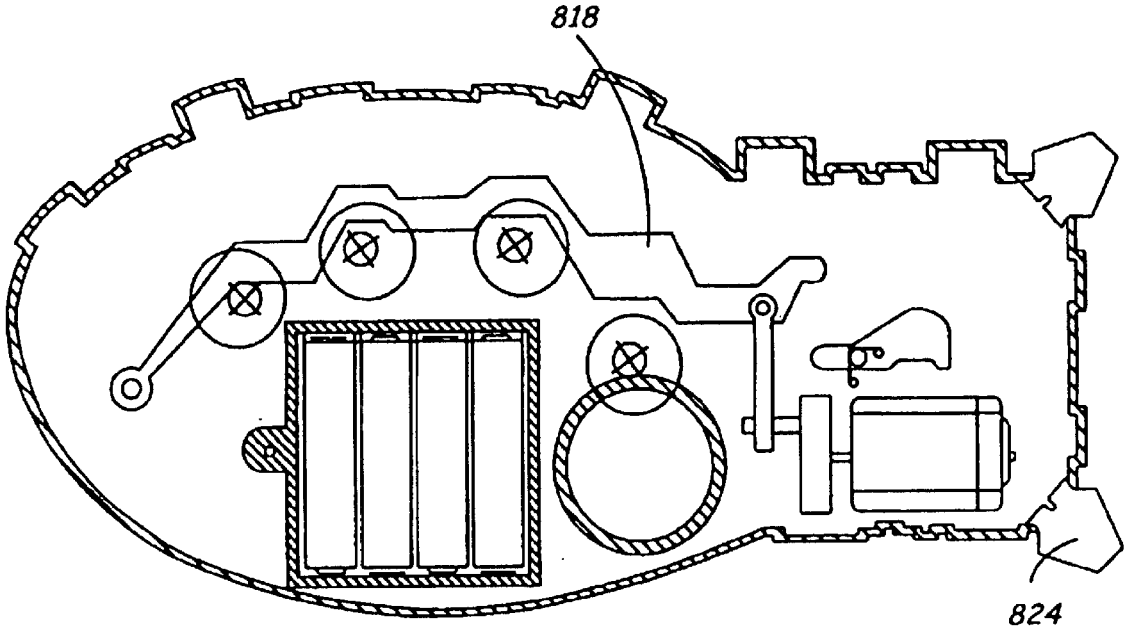
Figure 45:
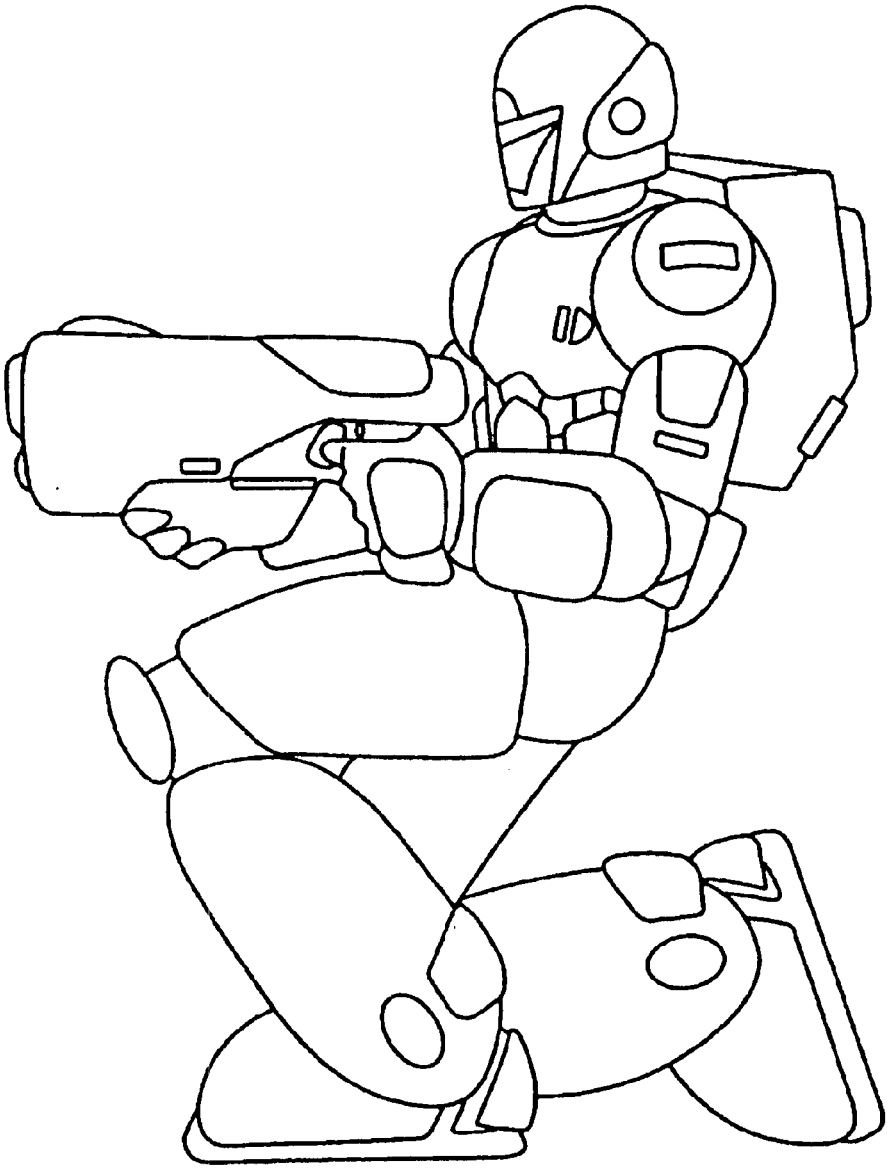
FIG. 45 depicts one embodiment of an object (a "trooper" figure) for use with the embodiment depicted in FIG. 42.

As depicted in FIGS. 42–44 another embodiment of the present invention may comprise a "foxhole" 800. The foxhole 800 may include a body 802 designed to represent terrain, and having a generally central relieved area 804 for accommodating objects or troopers 806 to be "launched" or blown out of the foxhole 800. The foxhole 800 may carry one or more guns, such as gun or cannon 808, and it may be provided, on the gun 808, on the body or on both, with a suitable IR receiver/emitter or other device for sending and receiving "shots" or IR or other signals to and from other embodiments of the amusement devices of the present invention. In this manner, a "battle" can be fought with other embodiments. FIG. 43 is an exploded assembly depicting some of the components of the foxhole 800. It includes a suitable motor 812, gearbox 813, a microprocessor 40 (e.g., comprising a pcb, ic and the like), and IR system 813 (FIG. 42) coupled to the microprocessor 40, and a launch mechanism 814, also coupled to the microprocessor 40. As also depicted in FIGS. 44*a–c*, the mechanism includes a release arm 818 and a selected number of launchers 820. As depicted in FIGS. 44*a* and 44*b*, the launchers 820 are generally similar to those depicted in FIGS. 41*a–d*. That is, they comprises a spring-loaded trigger 822 which is contacted by the release arm to "blow" the trooper(s) 806 from the foxhole 800. The discharge or launch of the trooper(s) 806 from the foxhole may be used to signify damage or scoring. The launch may be triggered by an IR signal or by contacting a damage plate 824. FIG. 45 depicts an exemplary "trooper" 806 suitable for launch from the foxhole 800 or ATV 700, but other objects or troopers with a different appearance may be designed for launch and/or other battle purposes as well.

Figure 46:
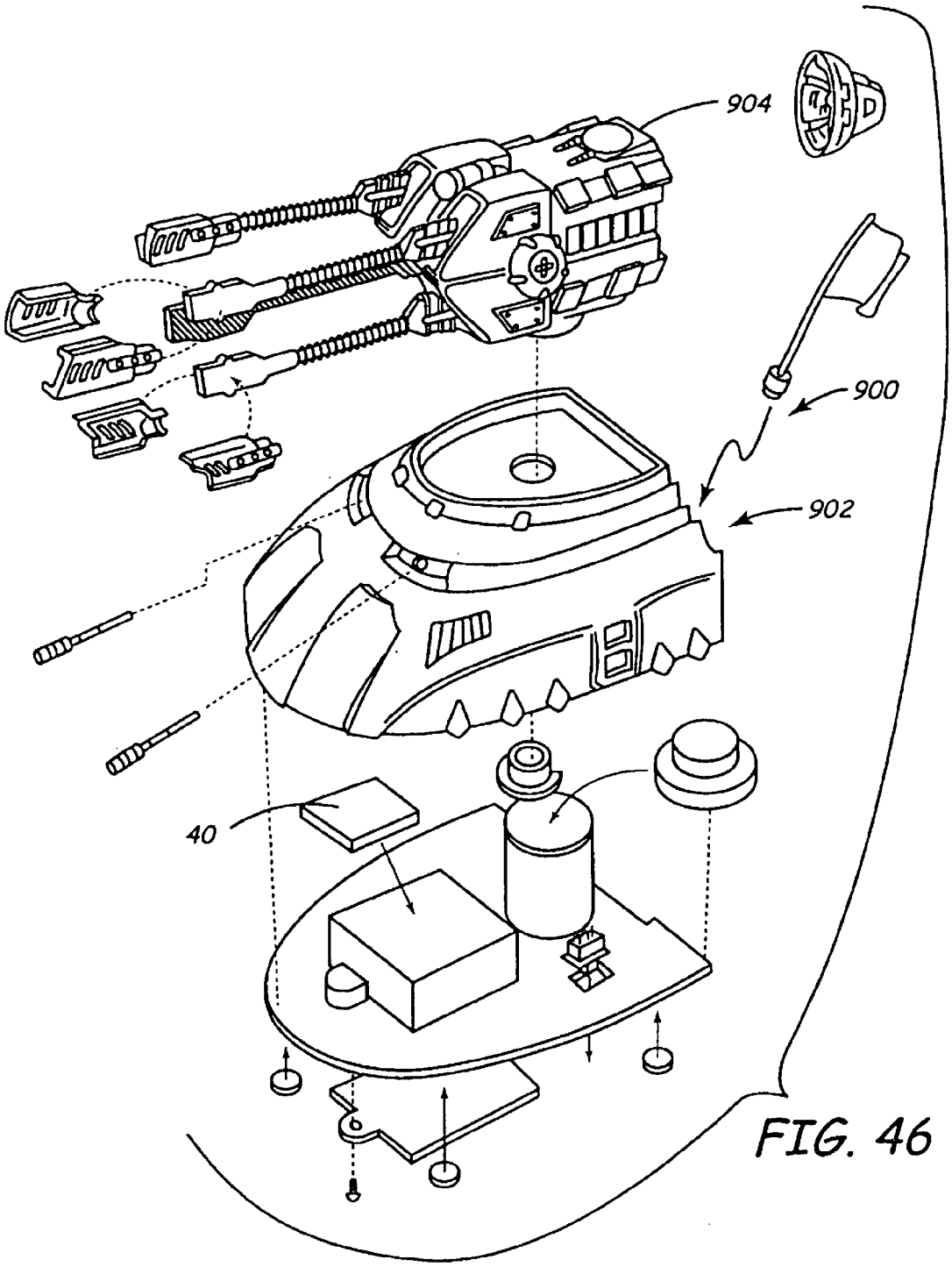
FIG. 46 depicts another embodiment of the robotic amusement devices of the present invention.

FIG. 46 depicts an embodiment of another adjunct or peripheral device for use with the present invention, namely, a pillbox 900. It comprises a pillbox body 902 housing some or the same components common to most embodiments, e.g., a microprocessor 40, switches, a speaker, and supporting a gun 904. The gun 904 may be adapted to send and receive "shots," e.g., IR signals or other appropriate signals, to other embodiments of the amusement devices of the present invention. Any of the embodiments of the invention, including the gun 904, may be lighted with appropriate light sources to create a display, to represent "firing" and/or to communicate information.

Figure 47:
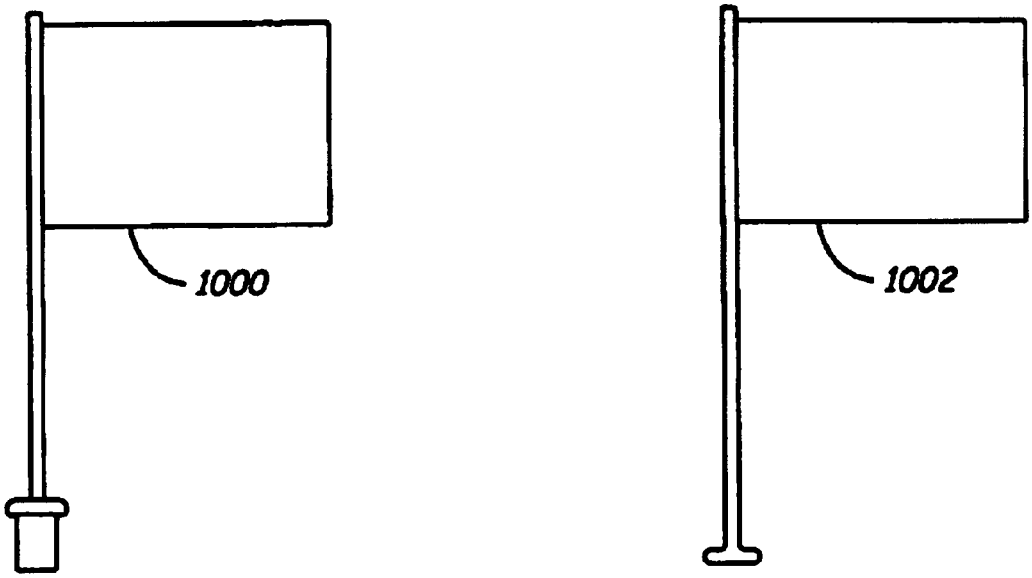
FIG. 47 is a side elevational view of a pair of decorative flags.

FIG. 47 illustrates an attachable decorative flag 1000 and a hand held flag 1002. Attachable decorative flag 1000 can optionally be coupled with any of the embodiments described herein by inserting the base of the flag into an appropriate receptacle, for decorative purposes. Likewise, hand held flag 1002 can be carried by any of the embodiments including a robot, soldier, character, action figure or the like. In both case, flags 1000, 1002 are merely decorative and can adorned as desired.

In general, the present invention includes an amusement device 2 in any number of forms, such as but not limited to: a car, a robot, an action figure, a vehicle, a plane, a flying device, a soldier, a tank, a fox hole or a pillbox, among other things. An information carrying or enabling device, such as card C, is brought into proximity with amusement device 2 causing amusement device 2 to change, function or act in a specific manner. For example, card C could include various armor configurations for a toy tank, thus making it stronger or weaker in a simulated battle. Card C could be purchased, traded, borrowed or otherwise acquired and utilized.

While card C and an appropriate card reader are one possibility for causing amusement device 2 to change functions or act in a specific manner it is certainly not the only way. As mentioned above, various other information carrying objects, items and devices, including keying devices, can be utilized. For example, information carrying devices may include a bar code, magnetic strip or other information. Keying devices can be mechanical in nature, enabling a given function or action, for example, a keying device may press a switch, complete a circuit, and/or trigger a given function or action. For example, a key may be inserted or a component having a specific shape can be inserted into a receptacle to engage a mechanical or electro mechanical actuator such as a switch to achieve the desired result. Such keying devices can be used in conjunction with or instead of the information carrying devices, such as card C and the associated reader. Furthermore, the keying devices can take any form including components designed to be integrated with the aesthetics of amusement device 2, and the keying device may or may not carry information, such as a bar code.

Figure 48:
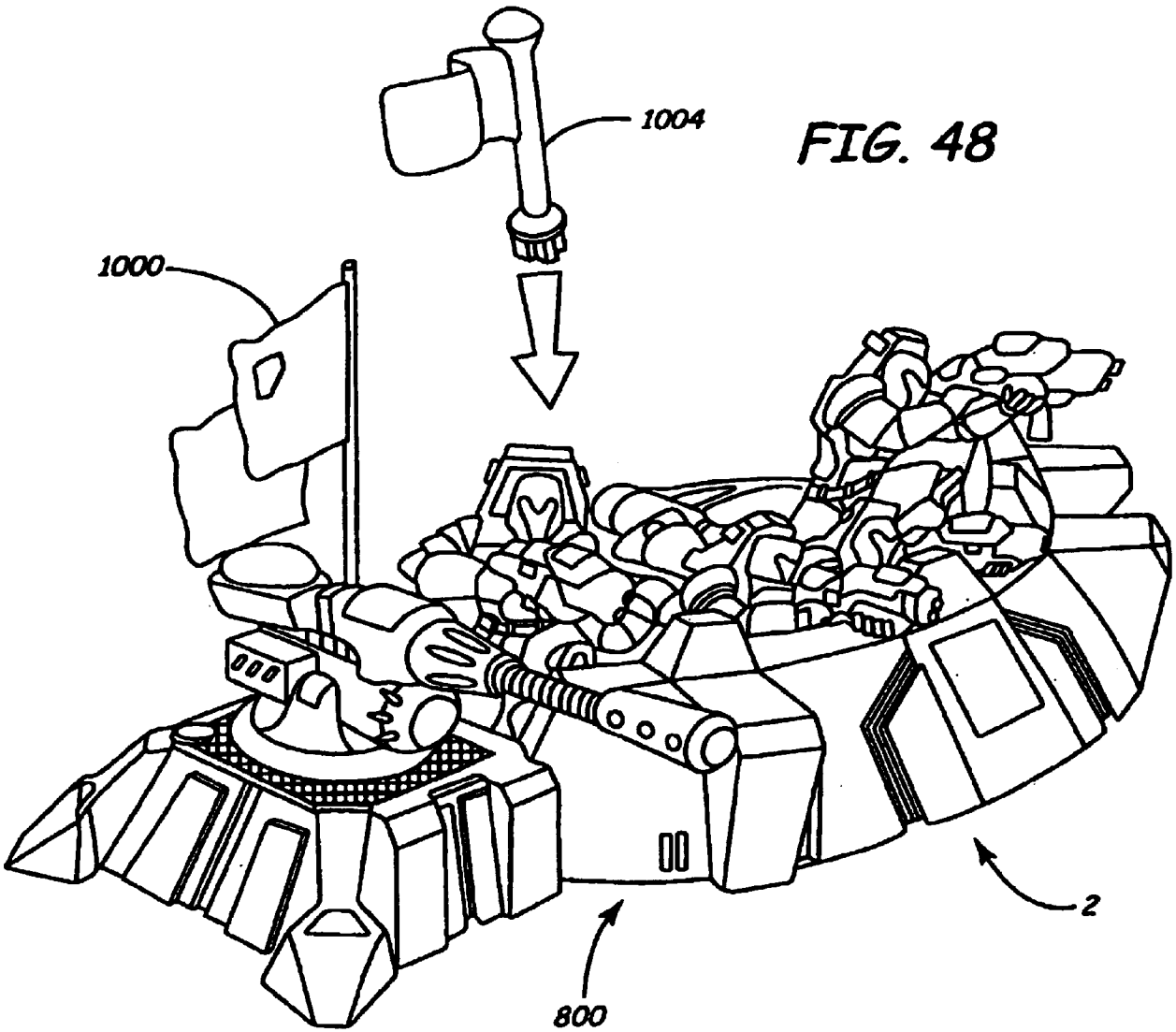
FIG. 48 is a perspective view of an amusement device consistent with the principles of the present invention, in the form of a toy fox hole.
Figure 49:
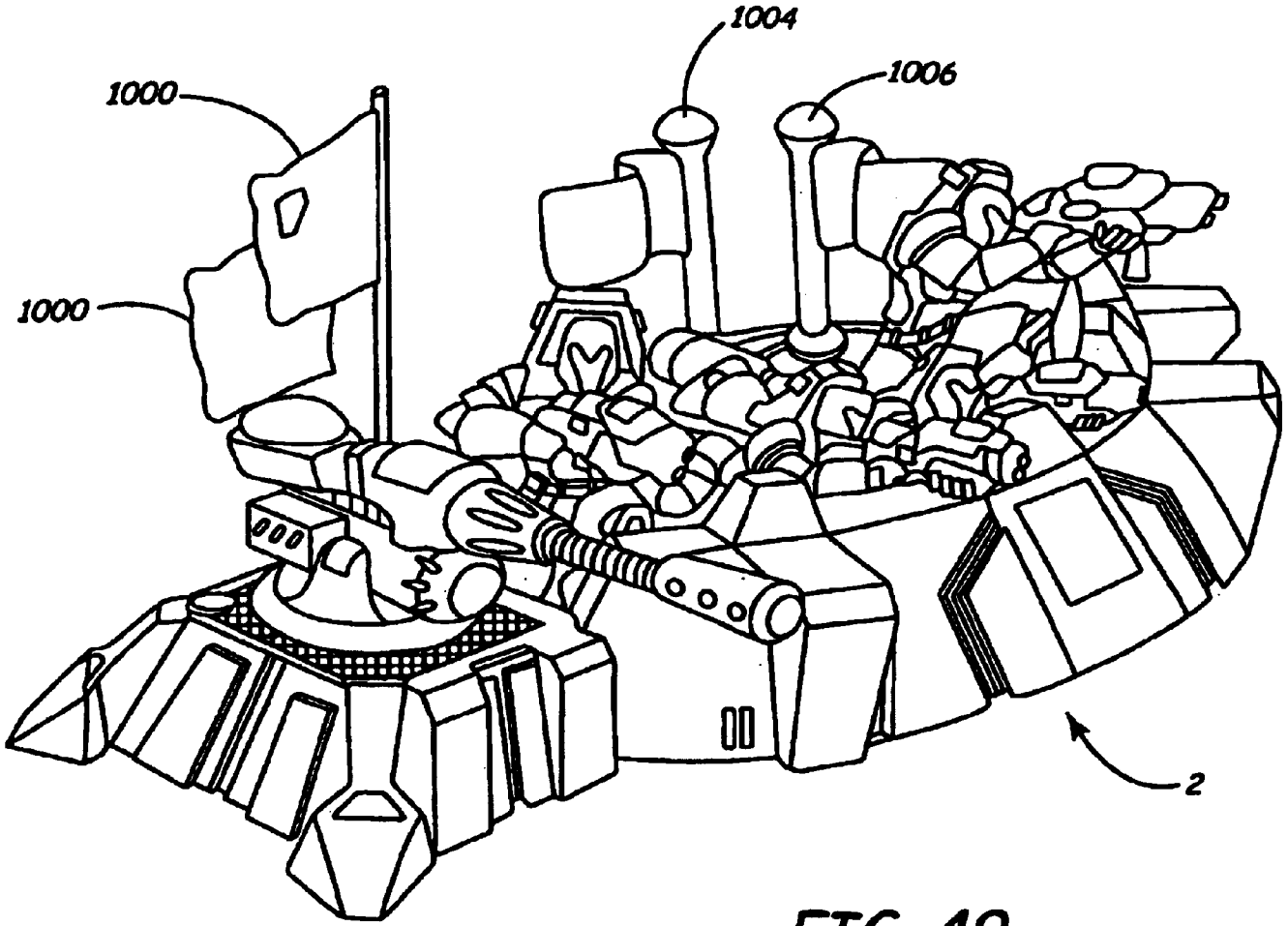
FIG. 49 is a perspective view of an amusement device consistent with the principles of the present invention, in the form of a toy fox hole including two action flags.

Referring to FIG. 48, amusement device 2 is in the form of a fox hole or pill box having a number of soldier and weapons. Amusement device 2 may or may not include a card reader or other such data input device. Amusement device is configured to receive one or more decorative flags 1000. Amusement device 2 is also configured to receive one or more action flags 1004. Action flag 1004 is a keying device, as discussed above. That is, when inserted into amusement device 2, action flag 1004 will change or modify one or more parameters or amusement device 2. FIG. 49 illustrates amusement device having received two actions flags 1004, 1006. In one embodiment, action flag 1004 can modify the "firepower" of the weapon of amusement device 2. For example, that weapon could fire at a faster rate or with more intensity. Action flag 1006 could modify the "armor" of the amusement device 2, thus requiring more "hits" from an enemy to cause damage. Of course, other actions or modifications could be implemented with other action flags and any number of flags may be utilized.

Figure 50:
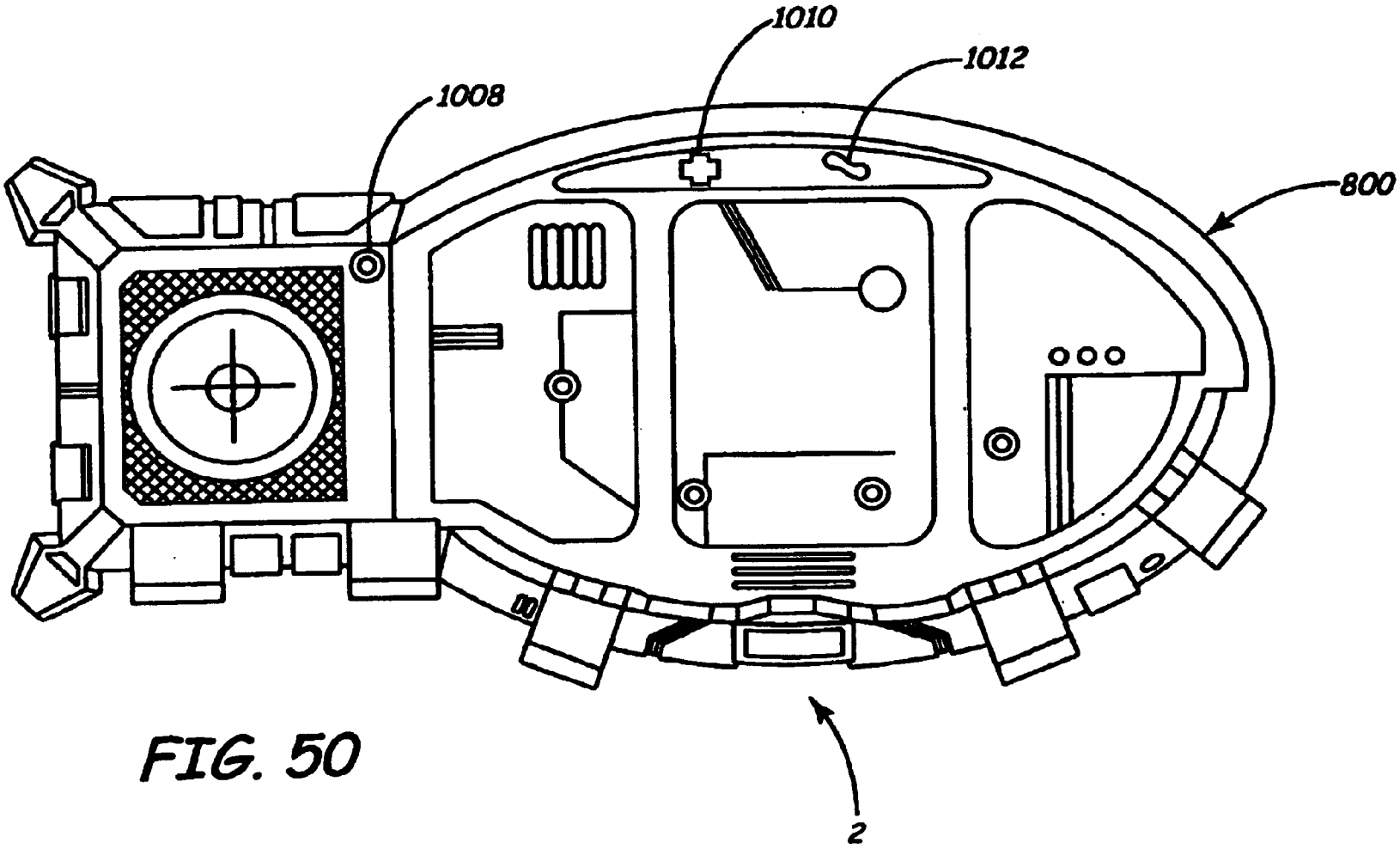
FIG. 50 is a top planar view of the toy fox hole.

Referring to FIGS. 48 and 50, action flag slots 1010, 1012 are illustrated. Action flag slot 1010, 1012 are shaped so that only the appropriate action flag can be inserted. For example, action flag slot 1010 has a cross-shape for receiving a cross shaped base of action flag 1004. Once so inserted, various mechanisms can be employed to alter the appropriate configuration of amusement device 2. For example, a contact switch can be provided within action flag slot 1010 that can be closed when action flag 1004 is inserted. Action flag slots 1010 and 1012 can have different shapes so that only the appropriate action flag is inserted. However, a common shape could be utilized so that the user could use a given action flag for any number of different actions. That is, a given action flag has a post that can be received by different action flag slots. Decorative flags 1000 may be received by engagement slot 1008.

Figure 51:
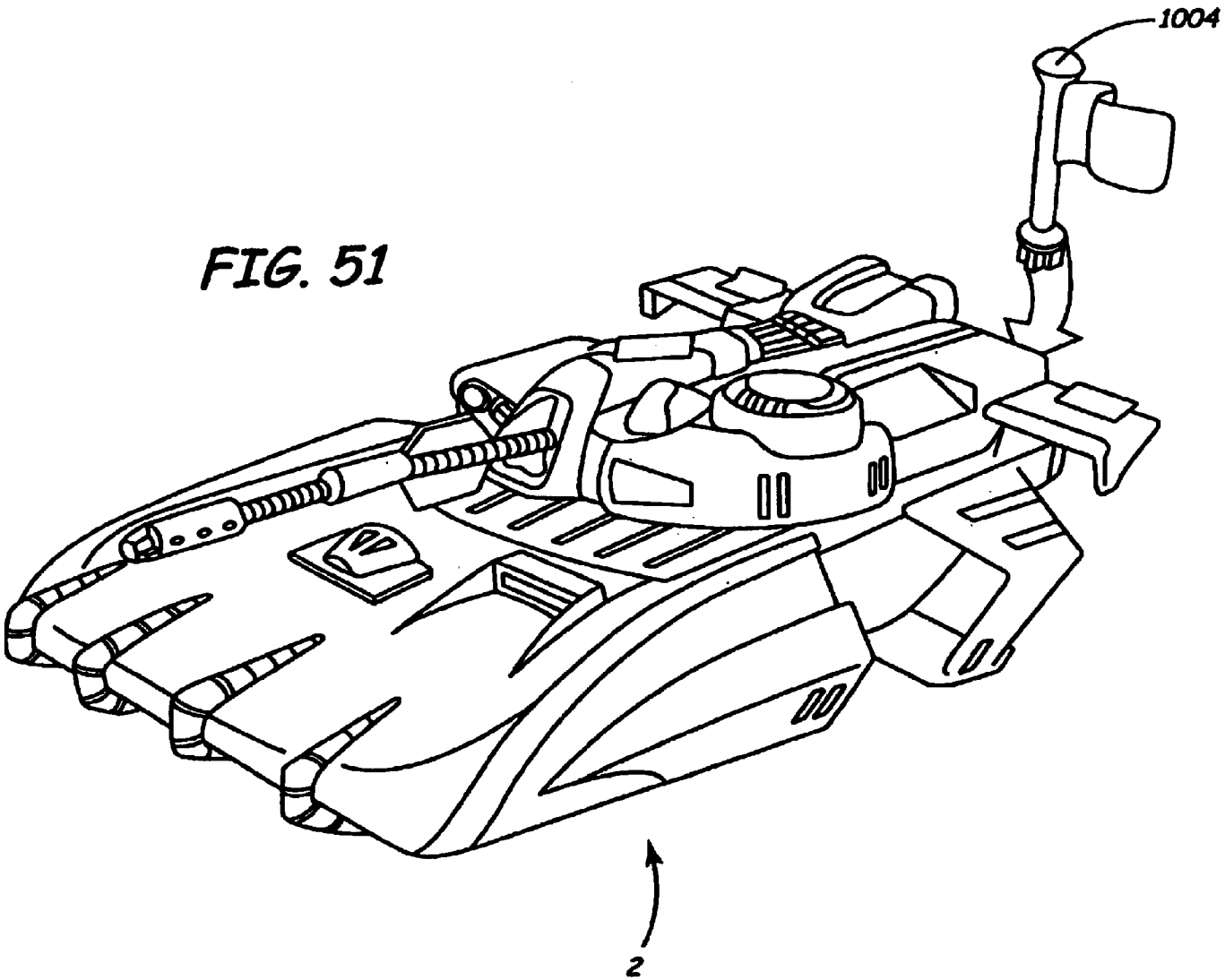
FIG. 51 is a perspective view of an amusement device consistent with the principles of the present invention, in the form of a toy tank having an action flag.
Figure 52:
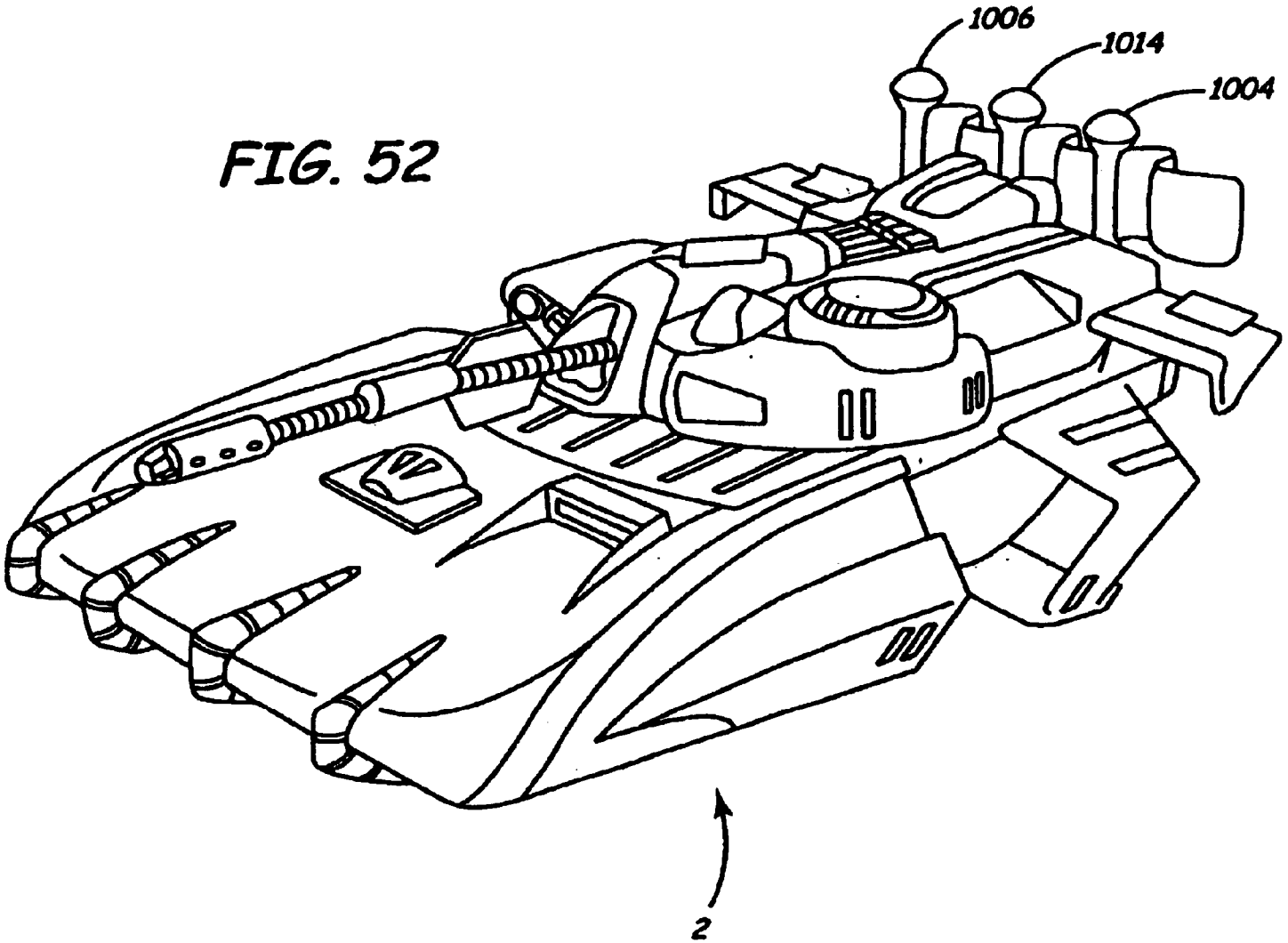
FIG. 52 is a perspective view of an amusement device consistent with the principles of the present invention, in the form of a toy tank having three action flags.
Figure 53:
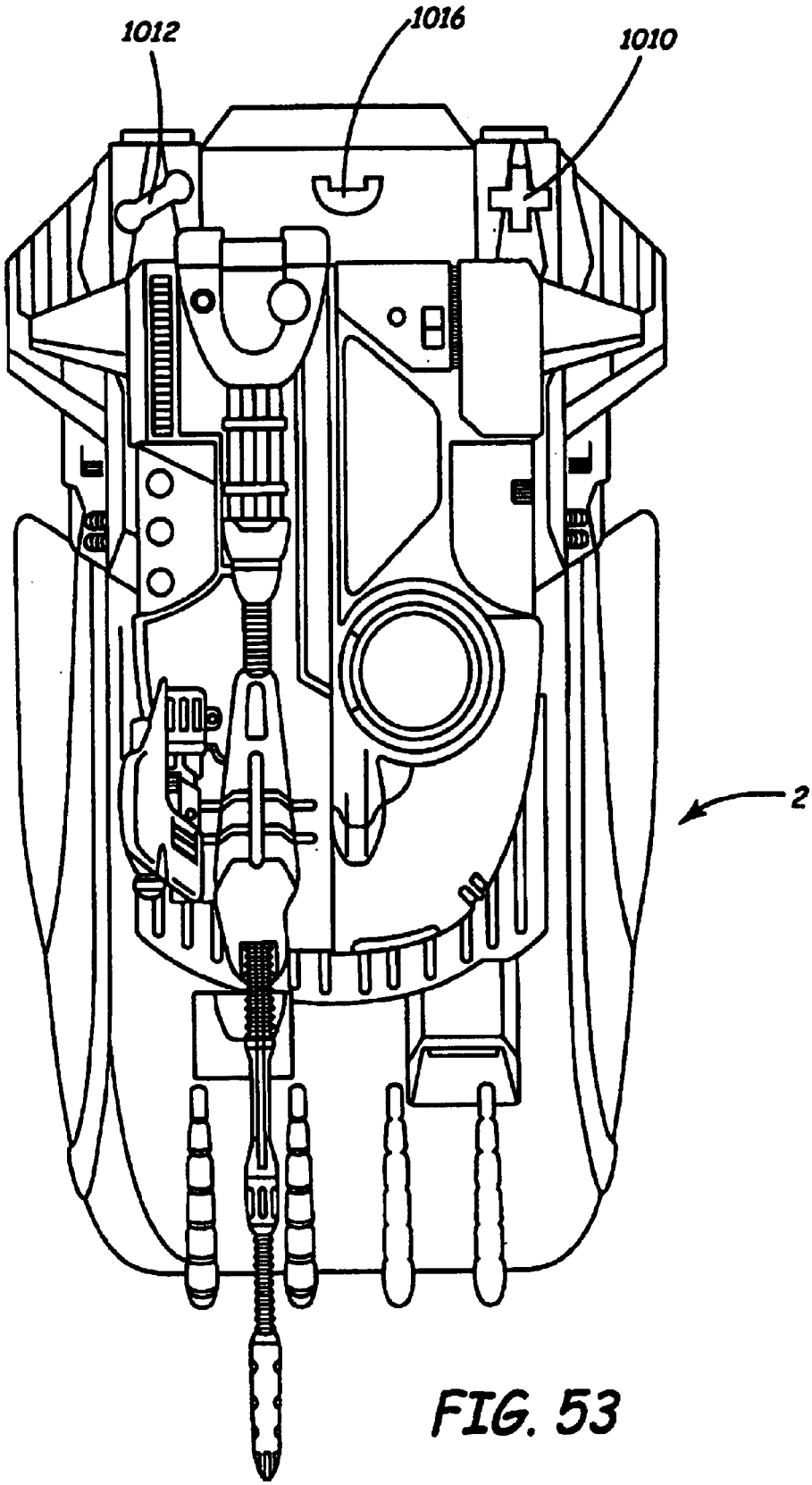
FIG. 53 is a top planar view of the toy tank.

FIGS. 51–53 illustrate an embodiment wherein amusement device 2 is tank. The tank can receive a plurality of action flags 1004, 1006, 1014 which may in one embodiment represent increased armor, increased speed, and increased firepower respectively. To increase the speed, action flag 1014 will toggle the appropriate IC or microprocessor to allow the tank to move at greater speeds. In other words, the speed of the tank can be restricted until action flag 1014 is inserted. Action flag slots 1010, 1012, and 1016 represent some of the different shapes that can be employed so that only the appropriate action flag is inserted. However, the shapes could be modified so that one action flag could be received by more than one or all of the action flag slots, making the action flags more universal.

Figure 54:
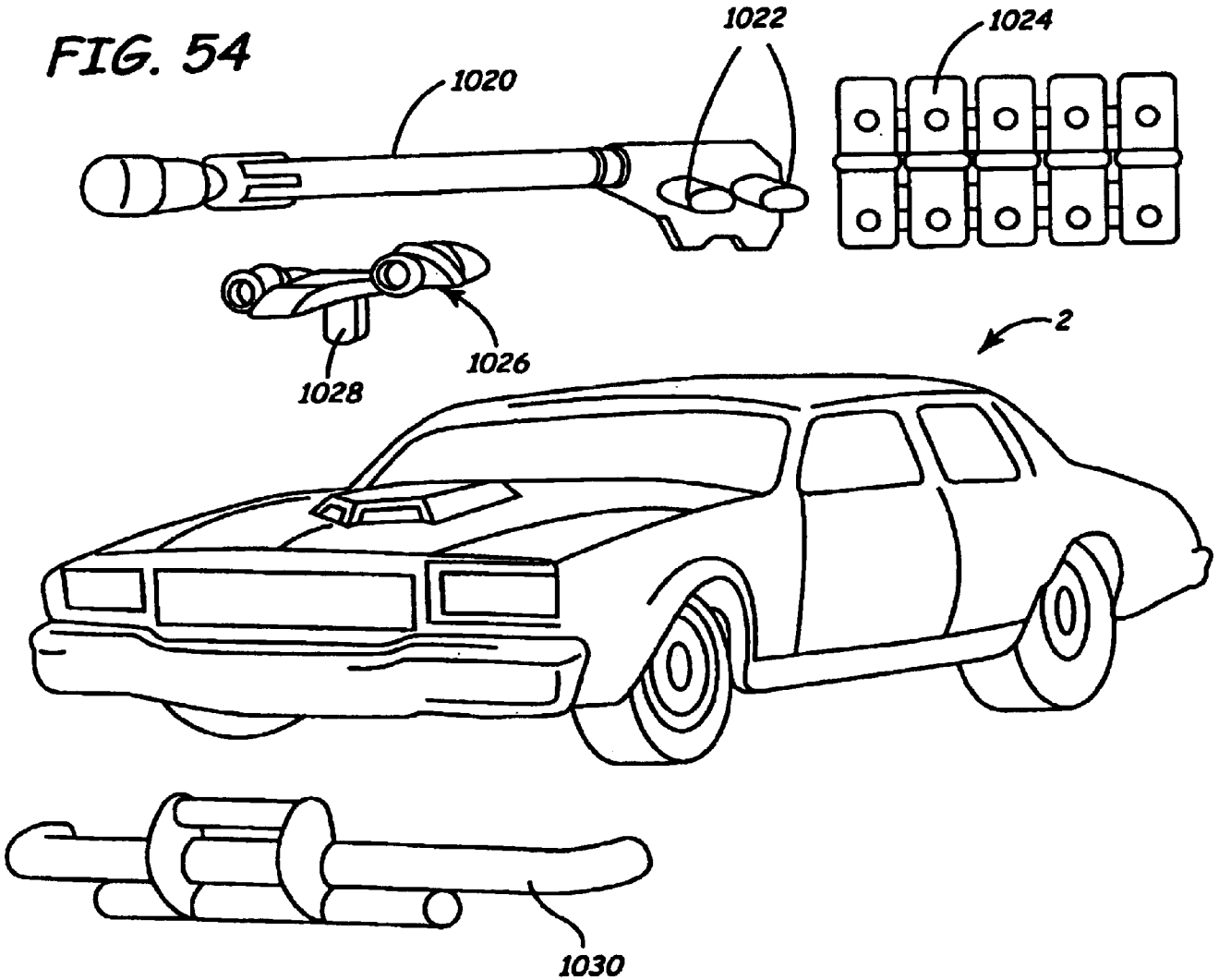
FIG. 54 is an exploded view of an amusement device consistent with the principles of the present invention in the form of a toy car having a plurality of add-on items.
Figure 55A:
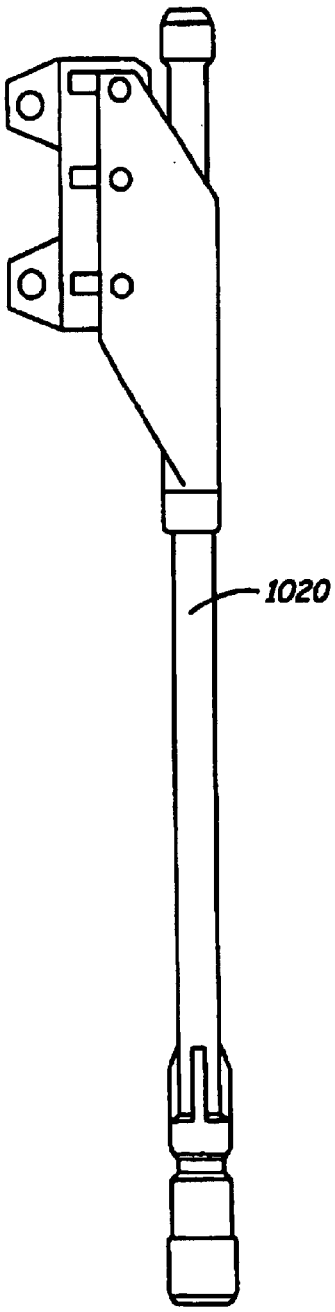
FIGS. 55A–55C are view of a lance attachable to the toy car of FIG. 54.
Figure 55B:
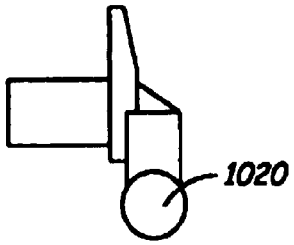

Referring to FIGS. 54 and 55 A–C, amusement device 2 is in the form of a toy car. Various options or accessories are provided for the car. For example, a lance 1020 has engagement pins 1022 that are received within matching slots (not illustrated) located on the car. The lance could act as a weapon and when attached and activated, could increase the firepower of the car. Trunk shield 1024 and bumper 1030 could likewise be added to increase the armor of the car. Finally, engine enhancement 1026 has an appropriate engagement pin 1028 for attaching to the car and when attached and activated, may increase the speed of the car.

In one embodiment, the car includes a card reader. The user must swipe the card or use another information transfer device to activate the attachment before use. Using the attachment without so activating the car could either result in a penalty (i.e., a decrease in armor) or the attachment simply remains inactive.

Figure 55C:
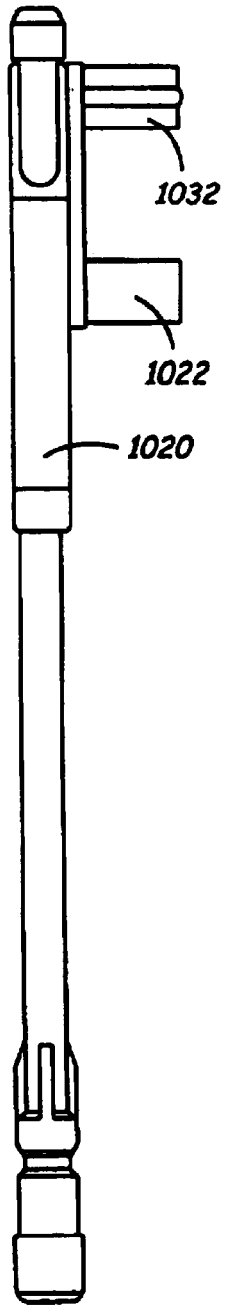
Figure 56:
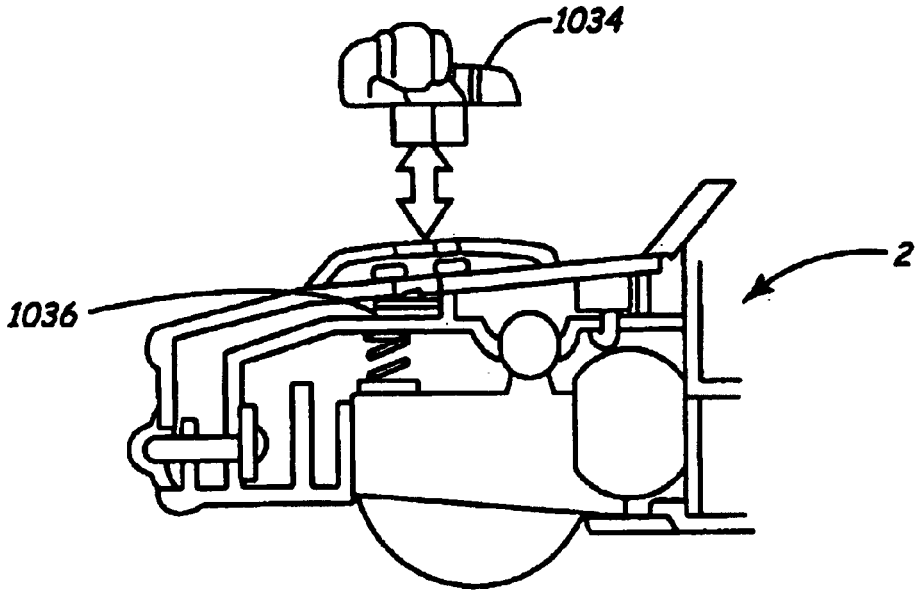
FIG. 56 is a partially sectional view of the toy car illustrating the removal of the engine.
Figure 57:
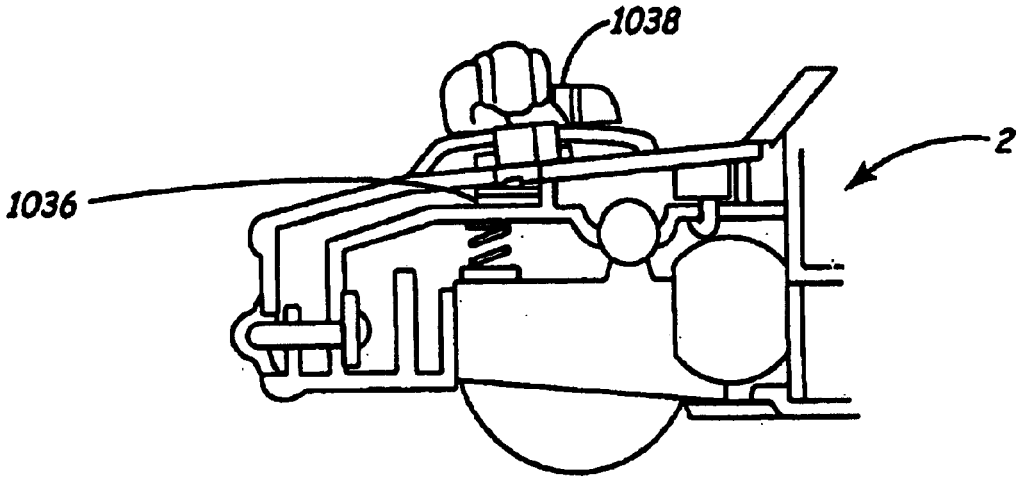
FIG. 57 is a partially sectional view of the toy car illustrating the attachment of an optional engine.
Figure 58:
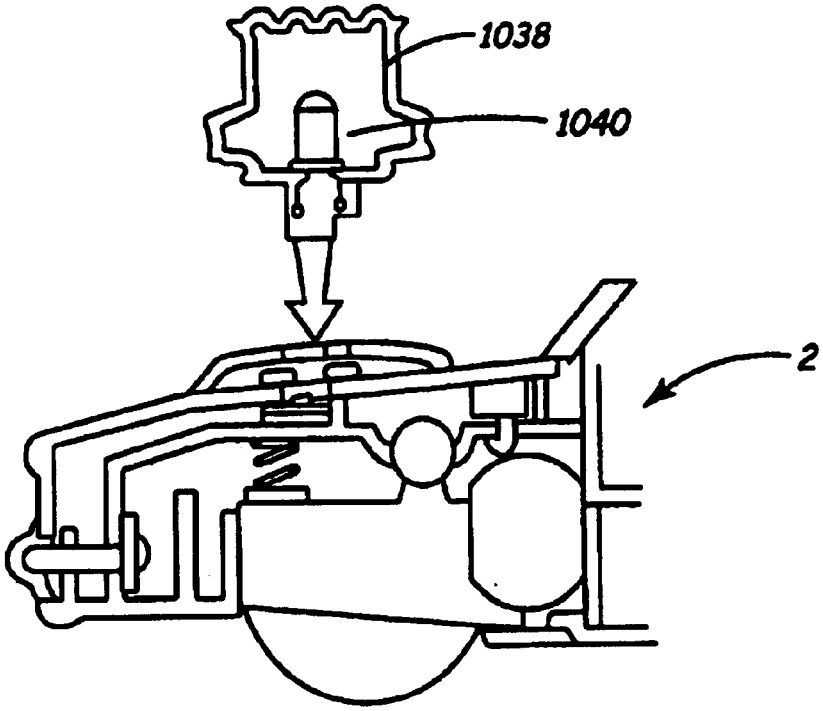
FIG. 58 is a partially sectional view of the toy car illustrating the attachment of a second optional engine.
Figure 59:
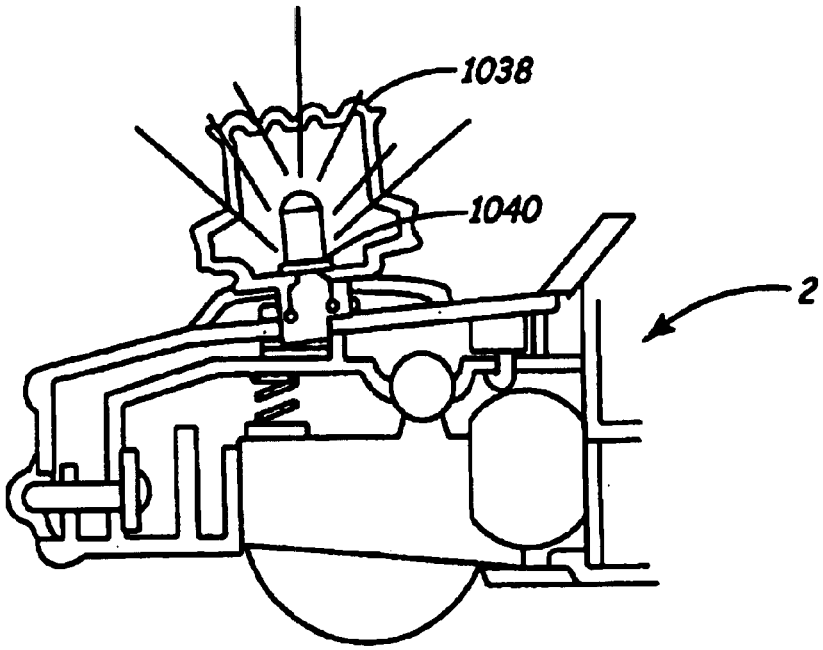
FIG. 59 is a partially sectional view of the toy car illustrating the second optional engine attached to the toy car.

The same functions can be obtained with or without the card reader by allowing the engagement of the attachment to the car activate the attachment. This can be done with a contact switch or other appropriate device located within the engagement slot (not shown) on the car. To further limit the modification of amusement device 2, the engagement slots can be appropriately shaped to only receive the appropriate attachment. For example, as illustrated in FIG. 55C, lance

1020 includes a cross-shaped engagement pin 1032 that could only be received in a similarly shaped engagement slot. When so received, the attachment is appropriately activated.

Referring to FIGS. 56–59, a stock engine 1034 can be removed and replaced with an upgrade engine 1038. In this embodiment, stock engine 1034 closed contact switch 1036 when seated on the car, while upgrade engine 1038 does not close contact switch 1036. Thus, the appropriate processor or IC is caused to increase the allowable speed of the vehicle. In a further modification, upgrade engine 1038 can include an LED 1040 or other lighting element that lights up when engaged with the car.

Thus, various attachments, upgrades and modifications can be provided for use with amusement device 2 to trigger or enable the device 2 to operate in a selected way, and/or to cause amusement device 2 to become modified in some manner, including appearance and/or function. These attachments can include the information carrying device, such as card C, when used with an appropriate reader and/or may include various keying devices that when attached to amusement device 2, toggle the appropriate effect. The keying devices can take any shape or configuration such as a key, a flag, or an attachment and may have a generically shaped engagement member or the engagement member may be specifically shaped so that it is only receivable in a particular receptacle member.

One embodiment of the game methods of the present invention, involving embodiments of the cards "C," may be summarized as follows:

"Robotmen" or "RumbleRobots" Game

The game is played in a series of turns with cards which may be collected by potential game players by purchasing, trading or otherwise accumulating them. There are three kinds of cards: Treasure cards, Battle cards and Advantage cards. Any or all of the cards may carry information in the form of a bar code, magnetic strip, hologram, an embedded microprocessor or chip, or other suitable information storing and communicating devices or methods. More than one information storing and communicating device or method may be used on a single card. Battle cards have color-coded Battle Symbols (dots) on them. To play a game, each player requires a deck of cards, which are then separated into the three types. The Treasure cards of the players are shuffled together and placed face down. The Battle cards of each player are shuffled by that player and placed face down to form a Play deck for that player. Advantage cards are set aside. To begin play, the top Treasure card is turned over; its color determines a color for a "battle." A "battle" begins by one player playing cards from the top of his/her Play deck by flipping or turning them over one at a time to reveal their face. Dots on each turned over Battle card that match the color of the turned over Treasure card are counted, and anytime a player has more dots of the right color than the opponent, he/she stops turning over cards and the opponent starts turning over cards until he/she has a greater total of the right colored dots. Turns continue in this fashion until one player turn over a Battle card with no dots of the right color. That player loses the battle. The winner claims the revealed first Treasure card, and a new turn is begun by turning over the next Treasure card. When all the Treasure cards have been won, the player with the most Treasure cards wins the game. An advanced game includes the Advantage cards, but again involves the turning over or revealing of Battle cards and the counting of the right color dots to win a battle and claim a Treasure card.

Another embodiment of the game methods of the present invention may be summarized as follows:

"Cubix" Game

This game is played with cards which may be collected by potential game players by purchasing, trading or other wise accumulating them. There are two styles of cards, interface cards and evil cards. Each card has an ability and/or a personality or character with game attributes or powers. Any or all of the cards may carry information in the form of a bar code, magnetic strip, hologram, an embedded microprocessor or chip, or other suitable information storing and communicating devices or methods. More than one information storing and communicating device or method may be used on a single card. The interface cards play in a connected line, and the evil cards play on or effect the interface cards. The object of the game is to build a three foot long, uninterrupted circuit or line of cards. The line is made by matching or connecting an interface card's interface portion, which has colored interface dots, with a matching interface portion of another interface card. The evil cards are used to delay or foil an opponent's line. The game is begun by a player choosing a starting card (known as a Solex card) from that player's deck and placing it on the edge of the playing surface. The remaining cards in the deck are shuffled and placed face down as a play deck. The top five cards of the play deck are drawn by players to create a player's hand. Turns begin by a player drawing the top card from the play deck and placing it in his/her hand. The player may then play one of the cards in the hand on his/her own line, on an opponent's line, or discard. Cards are played or placed by matching interface portions to build a line and/or to stop, infect, break or block an opponents line. Cards may be played in North/South or East/West orientation relative to an already played card as long as the interfaces line up and the colors match.

The present invention may be embodied in other specific forms without departing from the essential spirit or attributes thereof. It is desired that the described embodiments be considered in all respects as illustrative, not restrictive.

What is claimed is:

1. A transforming interactive amusement device comprising:

(a) a body;

(b) at least two transport elements moveably connected to the body;

(c) at least two arms moveably connected to the body;

(d) a motor associated with the body, the motor operably coupled to the at least two transport elements;

(e) a microprocessor operably coupled to the motor, the microprocessor being configured to command the motor to perform an action;

(f) a key receiving device associated with the body, the key receiving device configured to receive a keying device which actuates data transfer to the microprocessor, wherein the data enables a function of the device;

(g) a swipe card reader configured to read a swipe card, the swipe card reader is associated with the body and the swipe card reader is operably coupled to the microprocessor;

(h) a wireless receiver associated with the body, the wireless receiver configured to receive a wireless communication and transmit the wireless communication to the microprocessor;

(i) a unit wireless transmitter associated with the body, the unit wireless transmitter operably coupled with the microprocessor and capable of wireless communication with a second interactive amusement device; and (j) a remote wireless transmitter operably coupled by wireless communication with the wireless receiver; wherein (k) the device transforms into at least two different forms.

2. The amusement device of claim 1, wherein the keying device is an electromechanical keying device.

3. An interactive amusement system comprising:

(a) a body;

(b) a motor associated with the body;

(c) a microprocessor operably coupled to the motor, the microprocessor being configured to command the motor to perform an action;

(d) a wireless receiver associated with the body, the wireless receiver configured to receive a wireless communication and transmit the wireless communication to the microprocessor;

(e) a unit wireless transmitter associated with the body, the unit wireless transmitter operably coupled with the microprocessor and capable of wireless communication with a second interactive amusement device;

(f) a remote wireless transmitter operably coupled by wireless communication with the wireless receiver;

(g) a key receiving device associated with the body, the key receiving device configured to actuate the microprocessor when a keying device is inserted into the key receiving device; and (h) a swipe card reader configured to read a swipe card, whereby a function of the microprocessor is modified.

4. The interactive amusement device of claim 3 further comprising at least two transport elements, the microprocessor being configured to control speed of travel by controlling the at least two transport elements.

5. The interactive amusement device of claim 3 further comprising armor, the microprocessor being configured to control positioning of the armor.

6. The interactive amusement device of claim 3 further comprising a weapon, the microprocessor being configured to control at least one function of the weapon.

7. The interactive amusement device of claim 3, wherein the keying device is a flag having a base, wherein the base is configured to be received in an engagement slot on the body.

8. The interactive amusement device of claim 7, wherein the base and engagement slot each have a mating shape so as to prevent a second flag having an incompatible shape from being received in the engagement slot.

9. The interactive amusement device of claim 3, wherein the keying device is an attachment having a peg, wherein the peg is configured to be received in an engagement slot on the body.

10. The interactive amusement device of claim 9, wherein the peg and the engagement slot each have a mating shape so as to prevent an attachment having an incompatible shape from being received in the engagement slot.

11. An amusement apparatus comprising:

(a) a body;

(b) a motor associated with the body;

(c) a microprocessor operably coupled to the motor, the microprocessor configured to actuate the motor to propel an action;

(d) a shape-specific key receiving device, the shape-specific key receiving device configured to be actuable by a shape-specific key whereby the microprocessor is actuated; and (e) a swipe card reader adapted to receive enhancement data from a swipe card and to transmit the enhancement data to the microprocessor after said swipe card has been swiped, wherein the enhancement data is adapted to provide an enhanced function of the apparatus, and wherein said swipe card reader of said apparatus is also adapted such that one or more additional swipes of said swipe card while the apparatus is in operation results in said enhanced function being further enhanced.

12. The amusement apparatus of claim 11, further comprising:

(a) a wireless receiver associated with the body, the wireless receiver configured to receive a wireless communication and transmit the wireless communication to the microprocessor;

(b) a unit wireless transmitter associated with the body, the unit wireless transmitter operably coupled with the microprocessor and capable of wireless communication with a second interactive amusement device; and (c) a remote wireless transmitter operably coupled by wireless communication with the wireless receiver.

13. The amusement apparatus of claim 11, further comprising at least two moveable elements moveably coupled to the body, each of the at least two moveable elements moveably coupled by one of at least two couplings.

14. The amusement apparatus of claim 13 wherein the body and the at least two moveable elements are reconfigurable whereby the apparatus is transformable.

15. The amusement apparatus of claim 14 wherein the at least two couplings are configured to allow the body and the at least two moveable elements to be reconfigurable.

16. The amusement apparatus of claim 11, wherein said function which is to be enhanced comprises one or more of mobility, speed and defense.

17. The amusement apparatus of claim 16, wherein said further enhanced function comprises increased speed of the device.

18. The amusement apparatus of claim 16, wherein said further enhanced function comprises increased mobility of the device.

19. The amusement apparatus of claim 16, wherein said further enhanced function comprises increased defense of the device.

20. An amusement apparatus comprising:

(a) a body;

(b) a motor associated with the body;

(c) a microprocessor operably coupled to the motor, the microprocessor configured to actuate the motor to propel an action;

(d) a shape-specific key receiving device, the shape-specific key receiving device configured to be actuable by a shape-specific key whereby the microprocessor is actuated; and (e) a swipe card reader adapted to receive enhancement data from one or more different swipe cards and to transmit the enhancement data from each of said one or more different swipe cards to the microprocessor to enhance one or more functions of said apparatus, said one or more functions enhanced will depend upon which of said one or more swipe cards has been swiped through said swipe card reader, and wherein said swipe card reader of said apparatus is also adapted such that one or more additional swipes of said one or more different swipe cards while the apparatus is in operation results in said one or more functions enhanced being further enhanced.

21. The amusement apparatus of claim 20, wherein said apparatus is a portable toy.

* * * * *